US009585454B2

(12) United States Patent
Wagner et al.

(10) Patent No.: US 9,585,454 B2
(45) Date of Patent: Mar. 7, 2017

(54) APPLICATION DEVICE

(76) Inventors: Anke Wagner, Salem (DE); Rainer Mühlberger, Salem (DE); Daniel Eiche, Gailingen (DE); Peter Roth, Horgenzell (DE); Andreas Mühlberger, Grasbrunn (DE)

( * ) Notice: Subject to any disclaimer, the term of this patent is extended or adjusted under 35 U.S.C. 154(b) by 0 days.

(21) Appl. No.: 14/124,843

(22) PCT Filed: Jun. 9, 2012

(86) PCT No.: PCT/IB2012/001116
§ 371 (c)(1),
(2), (4) Date: Feb. 4, 2014

(87) PCT Pub. No.: WO2012/168784
PCT Pub. Date: Dec. 13, 2012

(65) Prior Publication Data

US 2014/0251363 A1 Sep. 11, 2014

(30) Foreign Application Priority Data

| | | |
|---|---|---|
| Jun. 9, 2011 | (DE) | 10 2011 106 101 |
| Nov. 9, 2011 | (DE) | 10 2011 117 986 |
| Feb. 13, 2012 | (DE) | 10 2012 002 622 |
| Mar. 5, 2012 | (EP) | 12401035 |

(51) Int. Cl.
*A45D 24/22* (2006.01)
*A46B 11/00* (2006.01)
(Continued)

(52) U.S. Cl.
CPC ..... *A45D 24/22* (2013.01); *A45D 19/02* (2013.01); *A46B 11/00* (2013.01); *A46B 11/001* (2013.01);
(Continued)

(58) Field of Classification Search
CPC ..... A45D 24/22; A45D 24/24; A45D 24/26; A45D 24/28; A45D 34/042; A45D 34/045;
(Continued)

(56) References Cited

U.S. PATENT DOCUMENTS 1,698,631 A * 1/1929 Hutchings ..... A45D 24/24 132/109
1,707,665 A * 4/1929 Julien ..... A45D 19/02 132/112
(Continued)

FOREIGN PATENT DOCUMENTS

DE 10117856 A1 10/2001
WO WO 2012001611 * 1/2011 ..... A45D 19/02
WO WO 2011161647 * 12/2011 ..... A45D 19/00

*Primary Examiner* — Tatiana Nobrega

(57) ABSTRACT

An application device applies an active agent to a fibrous material. The application device has a housing defining a storage volume which is arranged in the housing and is intended for storing the active agent, and an applicator. By the applicator, the active agent located in an application volume is applied to the material. In order to make reliable and straightforward application possible, the applicator has an application volume, a number of hollow teeth which are arranged in a comb-like manner and have an upper wall and a lower wall, between which at least part of the application volume is arranged, and also gaps which are located between the teeth and are intended for introducing the material into the application volume.

17 Claims, 24 Drawing Sheets

(51) Int. Cl.
*A45D 19/02* (2006.01)
*A45D 34/04* (2006.01)

(52) U.S. Cl.
CPC ..... *A45D 34/042* (2013.01); *A46B 2200/104* (2013.01)

(58) Field of Classification Search
CPC .... A45D 19/00; A45D 19/02; A46B 11/0041; A46B 11/0062; A46B 11/0065; A46B 11/00; A46B 11/001; A46B 11/0006; A46B 2200/102; A46B 2200/104
USPC ..... 132/112, 113, 114, 116, 148, 901, 155, 132/125; 401/183, 186; 222/207, 478
See application file for complete search history.

(56) References Cited

U.S. PATENT DOCUMENTS 2,028,588 A * 1/1936 Carson ..... A45D 24/22 132/125
2,264,346 A * 12/1941 Tupper ..... A45D 24/02 132/122
2,276,886 A * 3/1942 Smith ..... A45D 24/32 132/112
2,596,296 A * 5/1952 Shields ..... A45D 24/24 132/108
4,516,591 A * 5/1985 Hierholzer ..... A45D 19/02 132/116
5,060,679 A * 10/1991 Christopher ..... A45D 19/02 132/114
6,079,420 A * 6/2000 Musum ..... A45D 19/02 132/125
6,588,433 B2 * 7/2003 Asano ..... A45D 24/22 132/116
2004/0016440 A1 * 1/2004 De Laforcade ..... B29C 45/2626 132/114
2005/0028833 A1 * 2/2005 Christine Vena ..... A45D 19/02 132/114
2007/0079843 A1 * 4/2007 Niv ..... A45D 19/0008 132/116
2009/0320868 A1 * 12/2009 Wang ..... A45D 19/02 132/116
2014/0056636 A1 * 2/2014 Gueret ..... A45D 19/02 401/268

* cited by examiner

FIG 11
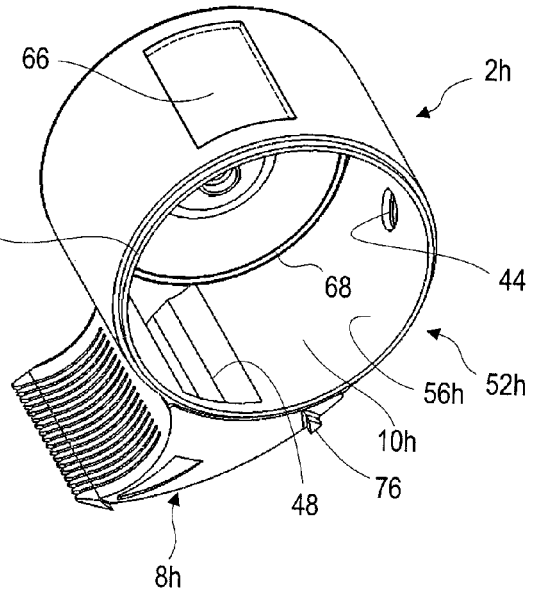
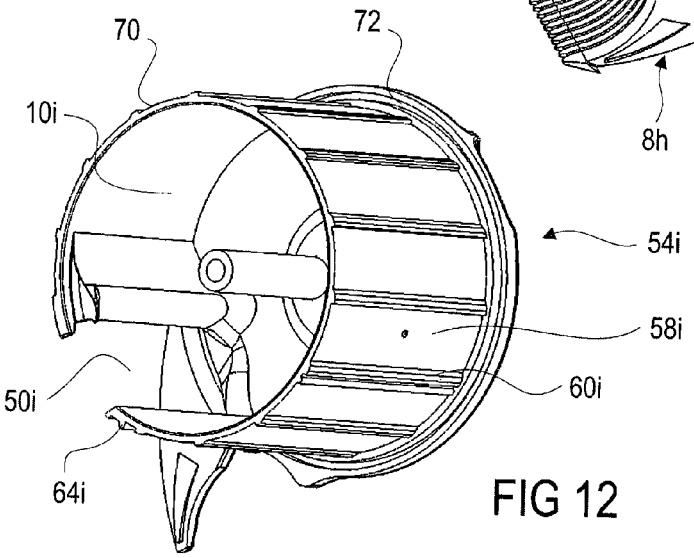
FIG 12
FIG 13
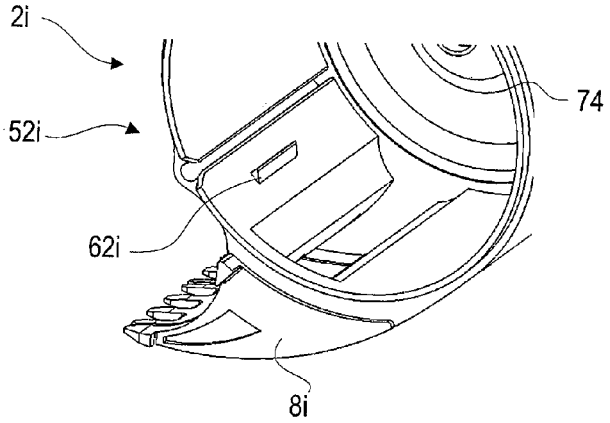

66

FIG 20
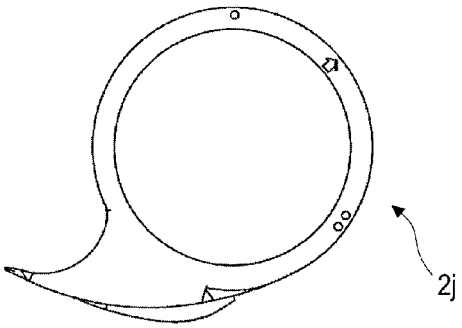
FIG 21
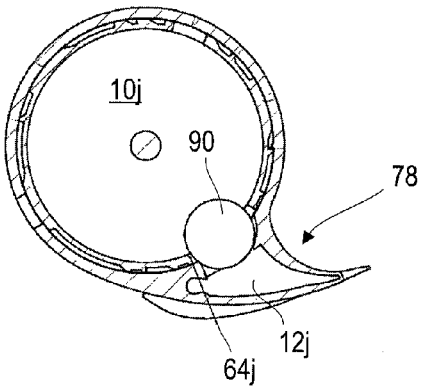
FIG 22
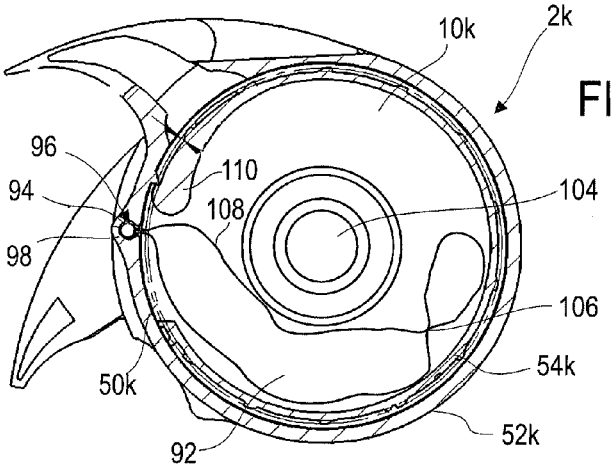
FIG 23
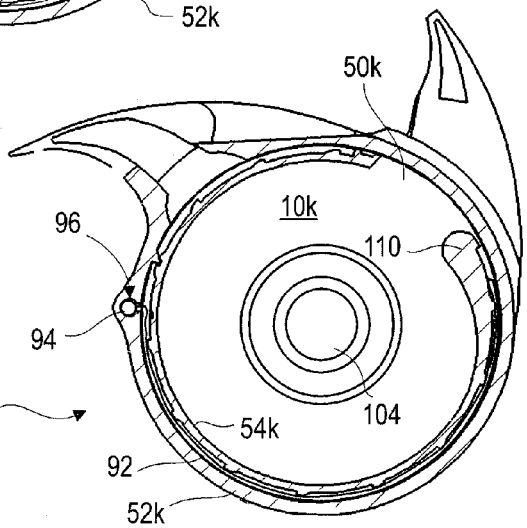
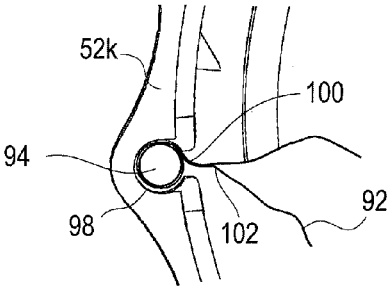
FIG 24

FIG 39
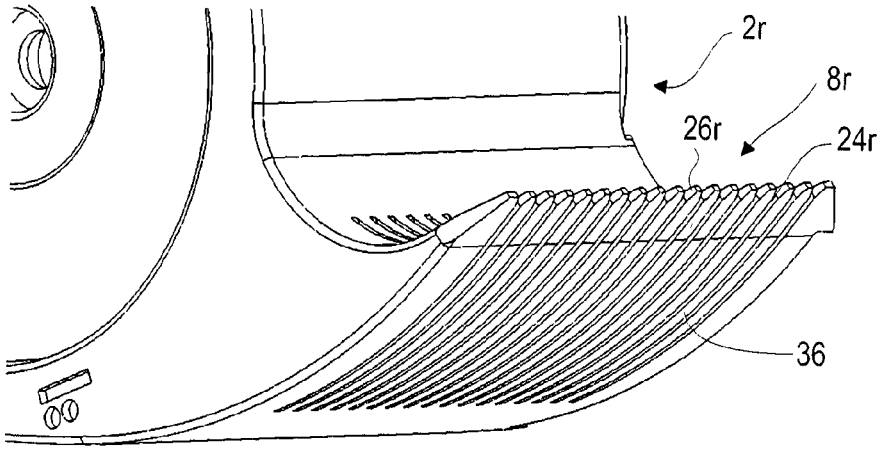
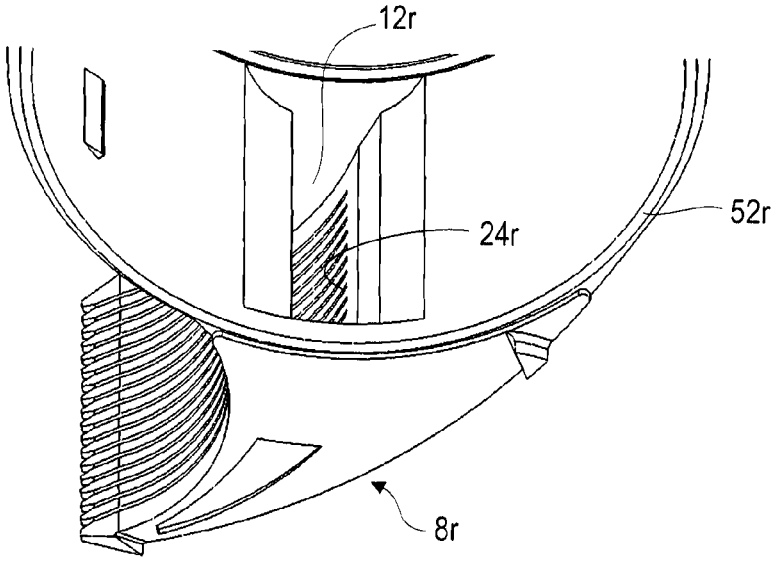
FIG 40

FIG 41
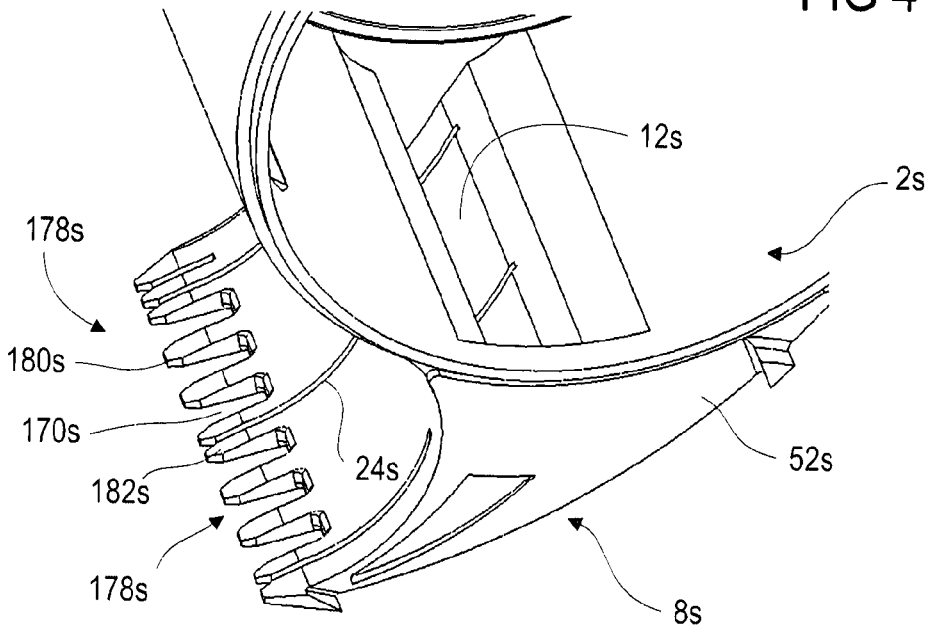
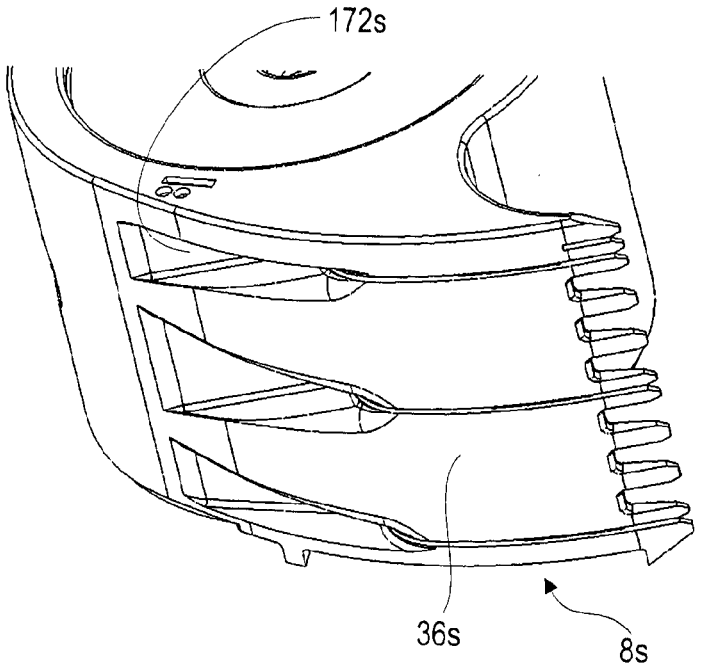
FIG 42

FIG 58
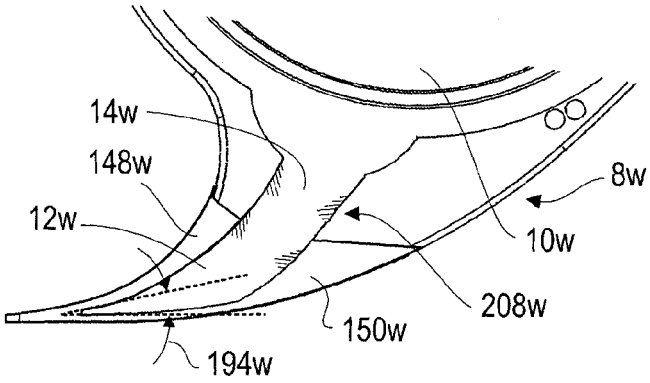
FIG 59
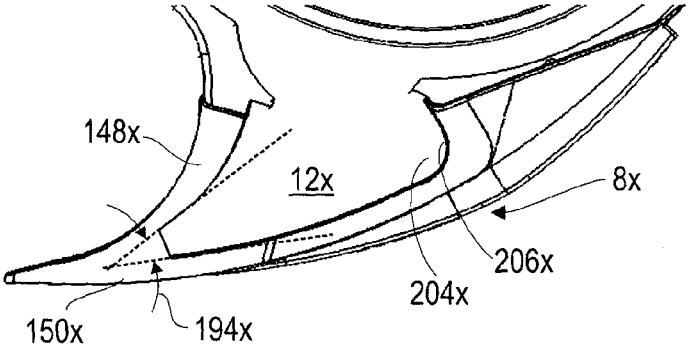
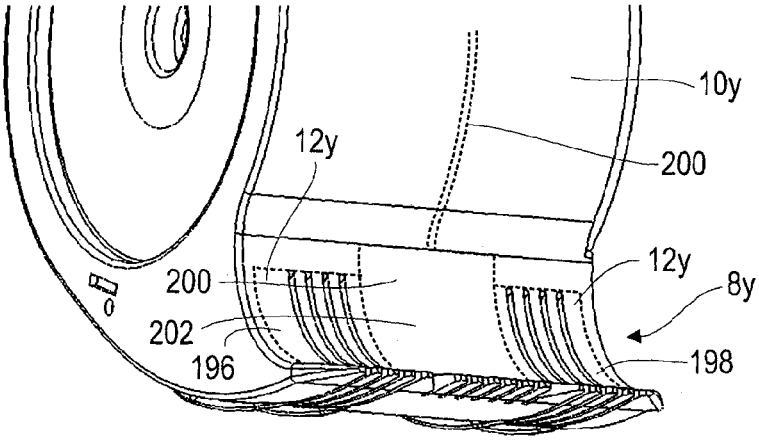
FIG 60

FIG 67
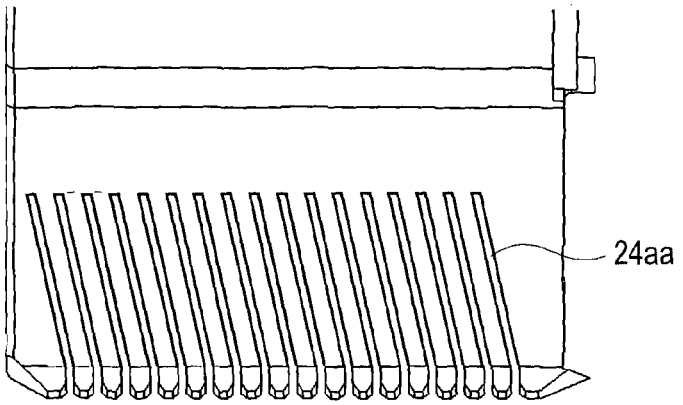
FIG 68
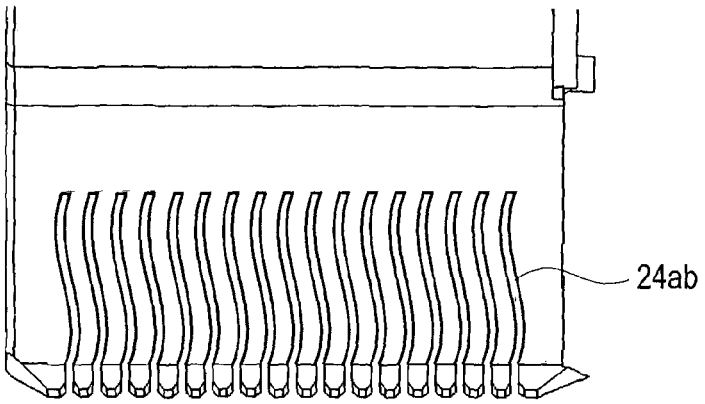
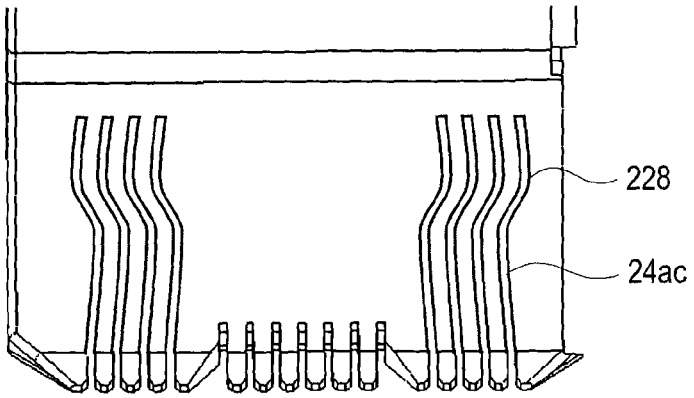
FIG 69

APPLICATION DEVICE

BACKGROUND OF THE INVENTION

Field of the Invention

The invention relates to an application device for applying an active agent to material, in particular, a fibrous material such as hair, the fur of an animal, a shaggy textile or the like.

BRIEF SUMMARY OF THE INVENTION

In particular, the invention is based on the objective of proposing an application device by means of which a manual application of active agent onto the, in particular, fibrous material is made possible in an easy and reliable manner.

To solve this problem, it is proposed that the application device is provided with a housing containing a reservoir volume for storing the active agent and an applicator for applying the active agent located in an application volume, in particular, to fibrous material. The applicator can be drawn through the material and the active agent can be applied onto the material.

An advantageous embodiment of the invention provides that the applicator has an application volume, a number of hollow teeth arranged like a comb with an upper wall and a lower wall between which at least a portion of the application volume is located, and gaps between the teeth for introducing the fibrous material into the application volume. Through the gap, the fibrous material can be introduced into the application volume easily, and moistened by the active agent. The gap can also be described as application gap, because the fibers passing through it can be moistened with application agent.

The directions top, bottom, front, rear and lateral are defined by way of example in FIG. 6. In general, it can be said that the teeth are aligned toward the front and correspondingly have a top side and a bottom side between which the hollow volume of the teeth is located. The upper wall is located at least partially above the hollow volume, and the lower wall is located at least partially below the lower wall, always viewed in a position in which the teeth point forward.

It should be avoided that active agent leaks out of the applicator in an unintended way. For this purpose, the gaps are expediently coordinated with the active agent's form, dimension and material so that the intended application tightness is achieved. Hereby, it is very desirable if no active agent discharges out of the applicator toward the top. For this purpose, the invention proposes that the gaps in the upper wall are smaller than those in the lower wall. Small is relative to the gap width, i.e. the lateral expansion of the gap between two teeth. The width of the gap can be the average gap width. Advantageously, it is the widest gap width.

Coloring hair close to the roots can be made easier if the lower wall has an even thickness in the longitudinal extension of a forward area. Thickness is to be understood as depth in a direction of top/bottom, whereby it relates to the direction front/rear and in particular, stands on it perpendicularly. The direction front/rear is not an absolute direction, but relates to a longitudinal extension of a gap, or in this detail of the invention, to the longitudinal extension of the lower wall.

Advantageously, the uniform thickness is less than 2 mm, in particular, more than a length of at least 5 mm, whereby the deviation from the constant thickness of this length is advantageously less than 20%, in particular, less than 10%.

Good application tightness toward the rear can be achieved if a top side of the lower wall bends upward subsequent to the distance that is uniformly thick. Advantageously, the bending angle is at least 15°, in particular, at least 20°, further, in particular, at least 25°, advantageously on a distance of a maximum of 3 mm.

For a good moistening of hair with active agent it is beneficial if the lower wall has an inner side that limits the application volume, the progression of which in the forward direction has an angle toward the rear with respect to a lower supporting surface of the applicator that increases up to at least 70°.

An inner surface of the lower wall is located on the interior side. Advantageously, the supporting surface is the outer side of the lower wall and is also referred to herein as the lower contact surface.

Advantageously, the angle is the angle through the lower wall, i.e. parallel to the gaps in a lateral cross sectional view. It can be the angle between tangents on the inner side and the supporting surface parallel to the gaps.

In an alternative or additional definition, the angle can be defined at the inner surface with respect to the supporting surface at a point of the inner surface as follows: A tangent oriented parallel to an adjacent gap at the inner surface of the point that is viewed includes the angle where the tangent is oriented parallel to the gap at the supporting surface at the point that is closest to the viewed point on the inner side.

In the following, this definition of the distance between the points can be used as the basis for corresponding passages. A starting point on a surface is considered and a corresponding point is sought on a corresponding surface, for example, on an opposite surface. Or a tangent to a surface is considered at a starting point and a further tangent is sought to a corresponding surface at a corresponding point. The corresponding point is that point on the corresponding surface that is closest to the starting point.

For a good moistening it is also beneficial if the inner side forms an angle of at least 60°, in particular, at least 80° to hair that is guided tautly and maximally deeply through the application volume. In particular, the angle is >90°, so that the rear wall continues to be tipped perpendicular to the hair.

The same advantage results when the inner side of the rear area of the application volume has a concave bulge in one area of at a maximum 10 mm with a bulge circumference of at least 70°.

A large application length combined with a compact design can be achieved when the inner side in its rear section together with the upper wall tapers the application volume toward the top.

Stripping active agent off hair unintentionally can be countervailed when at least one gap in the area of the lower wall has a rear gap outlet that extends from a lower supporting surface of the applicator into a recess in the supporting surface. In particular, the progression of gap outlets from the front to the rear have an angle of at least 70° to the supporting surface. If an angle is even larger, in particular, between 90° and 120°, the advantage described above can be combined with the further advantage that fiber can be pulled into the applicator particularly well. Depending on the active agent, it is even advantageous if the progression of the gap outlets takes on an angle between 120° and 150°.

The same advantage results when the recess forms a lateral gap widening, into which the gap widens laterally and laterally releases the fibers guided out of the gap. In particular, the width of the recess increases toward the rear as the distance from the gap outlet increases and its depth decreases.

It is beneficial for good bundling of moistened hair or fiber when the rear gap outlets of several gaps end in a single chamber that is designed as a recess. In particular, several gaps end in a single summarizing gap.

The same advantage is obtained when the chamber is tapered laterally towards the rear so that the chamber bundles hair that is guided towards the rear. Advantageously, the chamber becomes flatter towards the rear.

Good guidance of bundled hair can be achieved when the chamber has lateral spacers that always keep a lower supporting surface of the applicator in the area of the gap outlets at a distance of at least 0.5 mm from a fiber substrate, in particular, a scalp.

In particular, for coloring small strands, the gaps are advantageously arranged in at least two gap groups between which a gap-free bypass is located that has a size of at least twice the gap distance of the opposite, outermost gap of one of the gap groups.

Further, it is proposed that the lower wall of an application volume has an inner side limiting the application volume that extends in the direction from the front to the rear, at first in parallel with a lower supporting surface of the applicator and further towards the rear—just like the progression of the gap exits from the front to the rear—takes on an angle with respect to the contact surface of at least 70°, whereby several gaps in the section of the lower wall are wider than in the upper wall and end with their rear gap outlet in a single recess that is designed as a chamber.

The invention also addresses a system consisting of several application devices. The application devices are advantageously designed as described above and are different from each other in at least one geometric detail.

The system can be produced cost-effectively if the application devices are designed with an identical reservoir and a different applicator.

Depending on the type of active agent, various gap geometries are advantageous in order to always achieve a desired application tightness. Concerning this, it is advantageous if a first application device having gaps in an area of a lower wall with a gap width between 0.45 mm and 0.8 mm and a gap depth between 0.9 mm and 1.5 mm stores active agent having a viscosity of 120±35 Pa*s, and in a second application device with gaps in an area of a lower wall having a gap width between 0.05 mm and 0.45 mm and a gap depth of between 0.1 mm and 0.9 mm, stores active agent having a viscosity of 50±35 Pa*s.

Furthermore, it is expedient if in a first application device with teeth that have an average width of between 1.5 mm and 2.5 mm, active agent is stored having a viscosity between 5 Pa*s and 30 Pa*s, and a second application device with teeth that have an average width between 0.4 and 1.2 mm, stores active agent having a viscosity between 30 Pa*s and 120 Pa*s.

Leakage and an undesired running back of active agent out of the application volume can be countervailed if a first application device that has a bevel angle with an angle between 7° and 20° at the anterior tip of the application volume and stores active agent having a viscosity of <45 Pa*s, and a second application device that has a bevel angle with an angle between 20° and 40° at the anterior tip of the application volume stores active agent having a viscosity >45 Pa*s.

Further, the invention addresses an application method for applying an active agent to fibrous material, in particular, hair, in which an applicator of an application device, in particular, as recited in one of the preceding claims, is moved through the fibrous material at least with a partial section in such a way that active agent is applied to the fibrous material by the applicator.

An efficient and reliable application of active agent to the fibrous material can be achieved when the applicator surrounds an application volume through which the fibrous material is drawn.

The invention can be applied in a number of differently designed application devices. A few examples of such application devices are shown in the Figures. Moreover, the following describes many details of the invention, which can be combined with each other in many ways. In support of a better understanding, these details of the invention are described with the help of the Figures, without, however, being bound by the Figure that is specifically described, or the combination of features it illustrates.

To that extent, the exemplary embodiments serve not only to illustrate some specific exemplary embodiments of the invention, but particularly, to explain the general details of the invention that relate not only to the details of the invention in the examples, in order to provide a better understanding of these. The details of the invention that are described are therefore possible in combination with the specific exemplary embodiments, in general, however, they must be viewed independent of the specific exemplary embodiment. Thus, suitable features of each exemplary embodiment can also be considered explicitly isolated, removed from an exemplary embodiment, and inserted into a different exemplary embodiment to complement it, combined with each other and/or combined with an independent claim. Hereby, it is important that the details of the invention of different models or structural units can be combined so that special advantages of the invention result from their combination.

BRIEF DESCRIPTION OF THE SEVERAL VIEWS OF THE DRAWING

FIG. 11 shows an outer housing element of an application device with a transparent window.

FIG. 12 shows an inner housing element with a device for squeezing out an active agent container.

FIG. 13 shows a perspective view into the reservoir volume of an outer housing element and from there through a transition volume into the application volume.

FIG. 20 and FIG. 21 shows the application in an application position.

FIG. 22 shows a lateral cross section into the reservoir volume with an inserted active agent container.

FIG. 23 shows the active agent container clamped between the inner and outer housing element.

FIG. 24 shows a section of FIG. 22 with an attaching element for fastening the active agent container at the outer housing element.

FIG. 39 shows a perspective view of an applicator from the outside.

FIG. 40 shows a perspective view from the inside into the application volume of the applicator.

FIG. 41 shows a perspective view from the inside into the application volume of an additional applicator.

FIG. 42 shows the applicator in a perspective view transversely from below.

FIG. 58 shows back-flow barriers in an application volume or transition volume.

FIG. 59 shows an application volume bulging towards the rear.

FIG. 60 shows an application device with two chambers for different active agents.

FIG. 67 through FIG. 69 shows variants of arrangements of gaps in an applicator comb.

DESCRIPTION OF THE INVENTION

Figure 1:
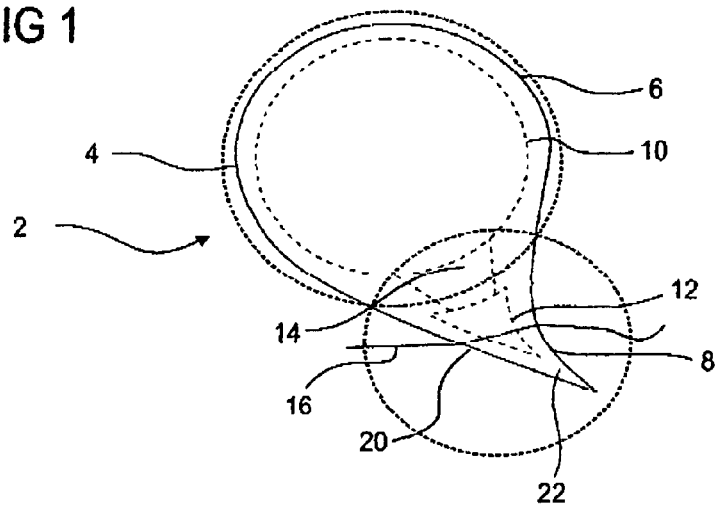
FIG. 1 shows a schematic lateral illustration of an application device arranged into a storage volume and an application volume.

Advantageously, an applicator device has a reservoir with a reservoir volume and an applicator with an applicator volume. FIG. 1 shows an example of this in an overview showing an application device 2 having a housing 4, a reservoir 6 having a reservoir volume 10, and an applicator 8 having an application volume 12.

The delineation between the reservoir and the applicator and also between the reservoir volume and the application volume does not need to be spatially or functionally strict; there can be a transition area as is shown, for example, in FIG. 1 by the dotted circles around reservoir 6 and applicator 8, and an intermediate volume 14. A transition area can be designed as a tapering between reservoir volume 10 and application volume 12, as indicated, for example, in FIG. 1, or also as a continuous transition between the two volumes. The transition area between reservoir volume 8 and application volume 12 can be designed as intermediate volume 14, for example, as a pump volume that is shown in FIG. 1 thinly dotted just like reservoir volume 10 and application volume 12.

Advantageously, the application volume in the applicator is designed in such a way that fibers or hair that traverse the applicator from one side to the opposite side thereby traverse the application volume, in particular, from the bottom to the top, i.e. enter on the bottom and exit on the top. This is shown in the overview in FIG. 1. Hair 16 extends through applicator 8 from its lower side up to its top side and thereby traverses application volume 12, which can contain an active agent, through which the hair is drawn and thereby moistened by it.

Advantageously, the housing surrounds the reservoir volume. The housing can limit the reservoir toward the outside. It is possible that the housing also surrounds the application volume and also forms the outer housing of the applicator.

Advantageously, the size of the application volume is smaller than the size of the reservoir volume. Thereby, an especially safe filling of the application volume can be realized. Preferably, the application volume is at most half as large as the reservoir volume.

Figure 2:
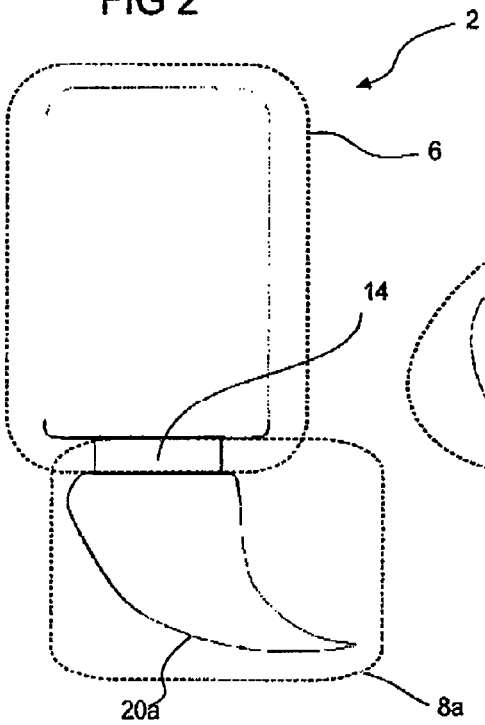
FIG. 2 shows a different application device with an analogous arrangement.
Figure 3:
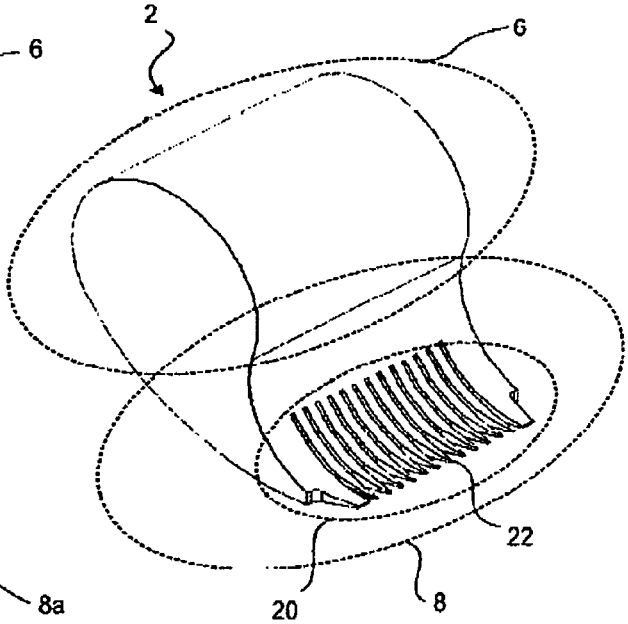
FIG. 3 shows an additional application device with such an arrangement.

Independent of the configurations of various application devices, a functional organization in the reservoir and the applicator can always be maintained. An example of this is shown in FIGS. 2 and 3 by the dotted lines around reservoir 6 and applicator 8. Hereby, it is important that an application volume is always present through which hair or fibrous material can be drawn for moistening with the active agent. For reasons of simplification—without any limitations being connected with such—the following will always refer to hair instead of more generally, to fibrous material.

In an advantageous embodiment of the invention, the application device includes a comb with at least one row of teeth. Such combs 20 with teeth 22 and interspersed gaps 24 are shown schematically in FIGS. 1 through 3, and specifically in an exemplary embodiment in FIGS. 4 through 6.

In the description of the Figures, the letters behind the reference numbers indicate various exemplary embodiments. Reference numbers without letters represent a common description of several exemplary embodiments. If no reference numbers are identified, general explanations are being made, rather than explanations referring to exemplary embodiments.

Figure 4:
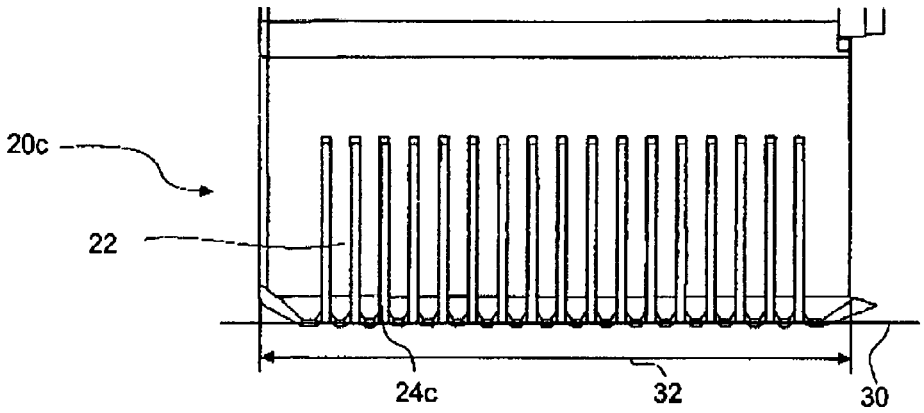
FIG. 4 shows a comb of an application device in a top view.

FIG. 4 shows an example of a comb 20*c* in a top view, FIG. 5 a further example of a comb 20*d* in a perspective view transversely from below and FIG. 6 a further example of a comb 20*e* in a lateral cross sectional view.

In general, a comb can have one or more rows of teeth. The teeth of one row can be designed identical or variable, for example, they can be sectioned into various tooth groups. Two teeth can form a gap between them that is limited by both adjacent teeth. If a tooth is surrounded on both sides by respectively one gap, the tooth can then be used as separator element between two gaps.

Figure 5:
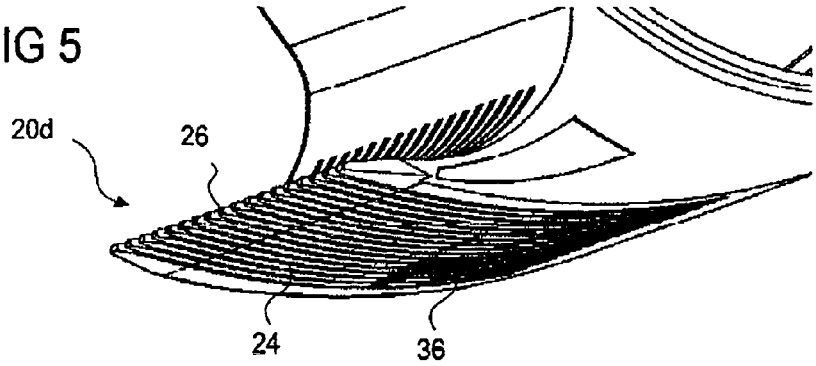
FIG. 5 shows the comb in a perspective view at an angle from the front.
Figure 6:
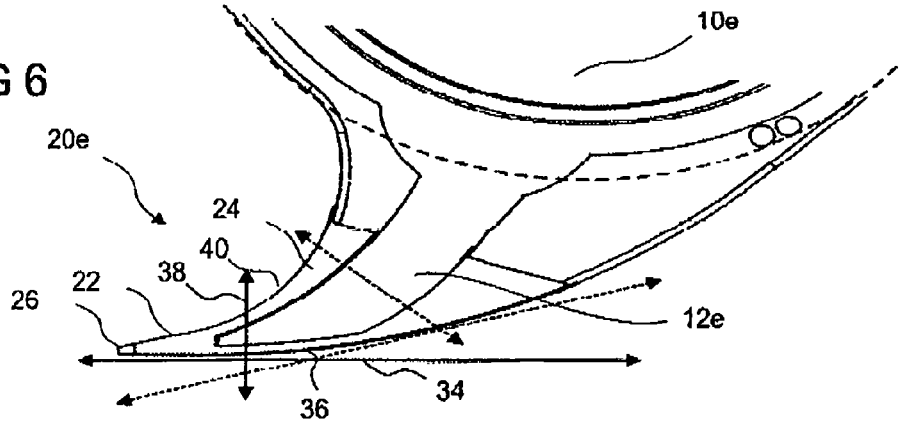
FIG. 6 shows a cross section through the applicator of an application device.

As shown in FIGS. 4 through 6 by way of example, teeth 22 have a tooth tip 26 at the front, by means of which a head line 30 can be defined that extends from tip 26 to tip 26. In the exemplary embodiment of FIGS. 4 through 6, head line 30 is straight, whereby in general, headlines having other shapes are also conceivable, for example, curved backward or forward and/or upward or downward.

In the following, the following directional definitions will be used: A width 32 of comb 20 extends transverse to the direction of teeth 22, as indicated in FIG. 4. Correspondingly, the directional information "lateral" is to be viewed in the direction of a width. The direction forward is specified by the direction of tooth tips 26, the direction and backward extends counter to their direction as shown, for example, in FIG. 6 by the horizontal double arrow. Lengths 34 are defined correspondingly. The direction forward and backward and, in particular, a length, for example, of a tooth can also—in a direction of a lower supporting surface of the applicator shown by way of example in FIG. 6 by 36—simultaneously rotate, as indicated in FIG. 6 by the long dotted double arrow.

The top and the bottom and a depth 38 are defined transverse to the front and rear, as well as the width. This depth 38 can also rotate with supporting surface 36 or an upper concave surface of a top side 40 of applicator 8, as indicated in FIG. 6 by the short dotted double arrow.

Various Configurations

Figure 7:
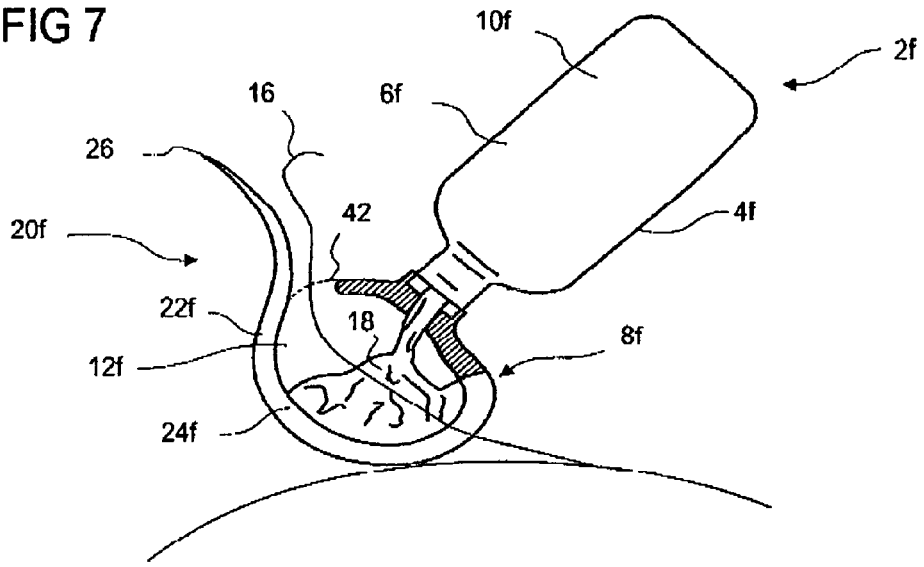
FIG. 7 shows an applicator with an application volume open toward the top.
Figure 8:
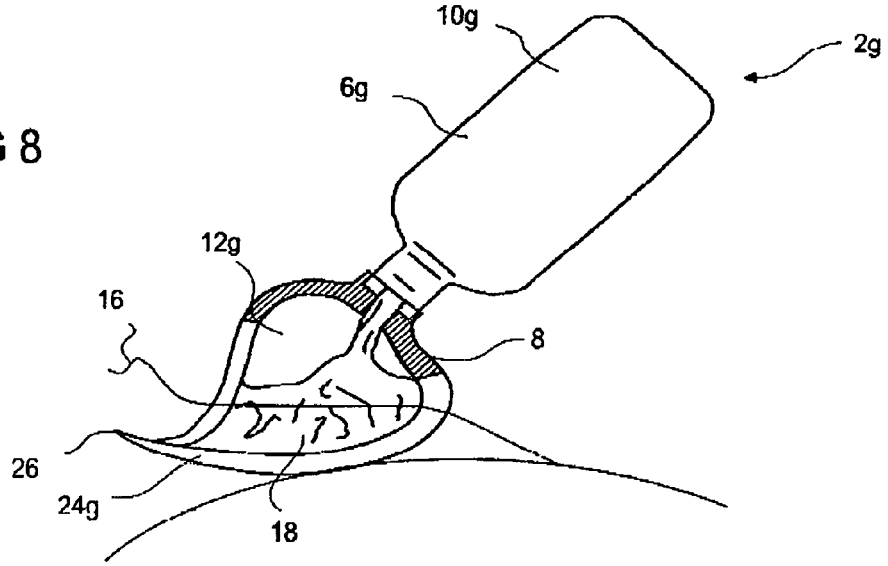
FIG. 8 shows an application device with an application volume closed on all sides.

The type of teeth of a comb can vary significantly. To demonstrate by way of example, FIGS. 7 and 8 are consulted. FIG. 7 shows an application device 2*f* with a housing 4*f*, a reservoir 6*f* and an applicator 8*f*. Applicator 8*f* includes a row of teeth 22*f*, which are shown in lateral cross section in FIG. 7, analogous to the illustration in FIG. 6. Teeth 22*f* thus—except for the outermost teeth 22*f*—form a gap 24*f* between themselves, respectively pair-wise.

Teeth 22*f* are curved in such a way that they form an interior cavity that serves as application volume 12*f*. Into it, active agent 18 can be introduced from reservoir volume 10*f* through an intermediate volume—not shown—into application volume 12*f*, as indicated in FIG. 7. Active agent 18 is now in the cavity or application volume 12*f* on teeth 22*f*. Teeth 22*f* and the gaps 24*f* between them and formed by teeth 22*f* are now dimensioned in such a way that active agent 18 remains on them and does not leak out through gap 24*f* to the outside, and thus leak or drip out of applicator 8*f*. The corresponding dimensions are coordinated with the flow properties of active agent 18, as described below in the description of a barrier width.

In general, the gaps are dimensioned in such a way that the active agent comes to rest on or in the teeth of the comb for at least 30 seconds, without penetrating downward through the gap. This time applies to a pressure exerted on the comb by the active agent of up to 5 cm of an active agent column.

In general, a comb of an applicator for moistening hair with the active agent can be guided through the hair in such a way that the hair is combed by the comb. Correspondingly, the hair passes through the comb, as indicated in FIG. 7 by way of example. Hereby, they traverse the application volume of the applicator in which the active agent is located. With its supporting surface, the applicator can be guided over a base surface, for example, the scalp, which is indicated in FIGS. 7 and 8, so that the hair is successively passed through the application volume and thus through the active agent. In preparation for this moistening, the active agent can be brought from the reservoir volume into the application volume. To do so, the active agent is guided through a transition, for example, an intermediate volume that is formed by the housing or by another component of the application device.

This application of active agent to hair can be performed with the exemplary embodiments in FIGS. 7 and 8 as well as with all other exemplary embodiments, so that the operating principle that is described is always the same. The application or introduction of the active agent out of or into the comb can be different.

In the exemplary embodiments in FIGS. 7 and 8, the passage is formed in such a way that active agent 18 discharging from it flows onto comb 20*f,g*. This motion of active agent 18 can be supported by increasing the pressure in reservoir volume 10*f,g*, for example, by an elastic housing 4*f,g* around reservoir volume 10*b*, which is, for example, compressed manually.

In most cases, comb 20 forms an inner volume so that active agent 18 flowing out onto comb 20 actually flows into comb 20. The inner volume surrounded by a comb 20 can form or be application volume 12. Application volume 12 is always open to the outside by gap 24, so that hair 16 can be introduced into application volume 12 from the outside. Whether the inner volume or application volume 12 of an applicator 8 is open upwards not only through gap 24, but is also open through a larger opening such as, for example, shown in FIG. 7, depends on the embodiment of the invention. In the example in FIG. 7 it is possible in order to close the inner volume or application volume 12*f* laterally, to locate lateral closure elements 42 at comb 20*f*, as indicated in FIG. 7 by the dotted line.

FIG. 8 shows a further exemplary embodiment of an application device 2*g* in which application volume 12*g* is closed toward the top or closed on all sides, of course, except for the openings formed by gap 24*g*. The operating principle is the same, namely, that active agent 18 is brought out of reservoir volume 10*g* into application volume 12*g*, and is located there on or within comb 20*g*, so that hair 16 that is drawn through application volume 12, also passes through active agent 18. In general, teeth 22 can be curved as shown in FIG. 7 and FIG. 8, have angles or also be straight, i.e. aligned in one plane. It is important that active agent 18 can be placed onto or into comb 20, so that hair 16 can be passed through active agent 18 by being drawn through application volume 12.

The application device according to the invention is particularly advantageous as a hair treatment device, for example, a hair coloring device, hair bleaching device and/or hair structuring device. Advantageously, the application device is

- a hair root coloring device for coloring hair roots—for example, starting at a distance of 1 mm from the scalp, in particular, closer than 0.5 mm to the scalp,
- a highlighter for coloring small strands and leaving the hair between the strands uncolored, and/or
- a hair marbling device for marbling hair in a way that only fewer than ¼ of the hair that is combed by the applicator is colored and the other combed hair remains uncolored.

Correspondingly, an active agent that can also be described as an application agent to be applied to hair, can be a fluid, a pasty or a powdered agent that is intended to be applied to hair such as, in particular, hair color, hair treatment agents, hair gloss, dispersions, structure altering agents and/or pharmaceutical hair treatment agents. Generally, the active agent can be designed as a one-component agent or as a multi-component agent. A "one-component agent" is intended to mean an agent that is stored in the reservoir volume ready for use. A "multi-component agent" is intended to mean, in particular, an agent in which at least one component is added to another component prior to an application, in particular, an agent that has two separately stored components that are intended to be mixed for an application.

Housing

In an advantageous design of the invention, the application device has a drop-like profile in which a housing part is designed essentially as round as a drop around the reservoir volume and the applicator is designed as the tip of the drop. Such a design is shown by way of example in FIG. 9, which shows an application device **2*h*** in a perspective view from the outside.

To facilitate the production of the application device, the drop shape of the drop-shaped profile is advantageously designed two-dimensional so that the drop-round part is essentially cylindrical or shaped like a cylinder segment and the drop tip is designed to have a lateral, at least substantially uniform profile.

The cylindrical part is advantageously formed by reservoir 6. It advantageously houses the reservoir volume. Advantageously, applicator 8 is formed by the tip of the drop. It advantageously houses the application volume. This can be seen in FIG. 9, in particular, in combination with FIG. 6, which shows the same embodiment. The cylindrical part with reservoir volume **10*e* is indicated by the dotted line. Application volume 12*e*** is located radially on the outside and in the area of the tip of the drop. Advantageously, the housing part is formed around the reservoir volume in such a way that in a cross section, it has at least an 180°, in particular, at least a 270° circular outer profile.

An especially reliable protection against leakage of the active agent through the gap can be achieved if the interior pressure of the application volume does not rise above a specified level of pressure relative to the exterior pressure outside of the applicator. If the housing is flexible, the interior pressure can be increased by applying pressure to the housing, so that a certain risk of a leakage is present. On the other hand, if the housing part around the reservoir volume is hard to such a degree that upon compression with an opposite compressive force of 5N on both sides—distributed over at least 1 $mm^2$, in particular, 10N on both sides distributed over at least 1 $mm^2$, it is maximally deformed at any position to such an extent that the reservoir volume decreases by less than 5%, advantageously by less than 2% and, in particular, by less than 0.5%, an expulsion of active agent out of the application volume into the environment can be prevented. The percentages are percentages by volume.

Before active agent can be introduced into the application volume, it will normally be necessary to remove the active agent from a closed container and make it freely available in the reservoir volume, for example, by filling it into the reservoir volume, or by opening a container located in the reservoir volume. To facilitate and monitor this type of process it is advantageous if the housing part around the reservoir volume is transparent to the extent that the active agent located in the reservoir volume is visible as such from the outside, for example, in normal lighting suitable for reading.

For coloring or treating hair, the application device is held in one hand and guided through the hair. This can be done especially easily because the applicator has a comb with a row of teeth and the housing is shaped in such a way that it can be held in a pincer grip between thumb and index finger in such a way that the row of teeth is aligned parallel to a line between the tips of the thumb and index finger. Deviations of up to 15° can be seen as falling within the scope of being parallel.

In order to position the housing that is held by hand using a pincer grip in a steady manner, it is advantageous if the housing is shaped in such a way that when it is held, it can be supported with a lateral surface of the middle finger from the bottom. Hereby, it is advantageous for an ergonomic treatment of the hair if the lateral surface is located opposite to the applicator.

When the application device is held in the hand it is convenient if it does not attempt to rotate in the hand as a result of its own weight. For this reason it is advantageous if the housing is shaped in such a way that the line between thumb and index finger extends through the center of gravity of the reservoir volume. It is advantageous for the same reason when the housing is shaped in such a way that a center of gravity of the reservoir volume is located in the center between thumb and index finger. The center of gravity can refer to the housing by itself, without active agent.

A convenient way of holding the application device in the hand can be achieved if a rear section of the housing has a shape that is rounded like a circular arc around the line between thumb and index finger.

In order to achieve good coloring results or application results it is important on the one hand, that the hand remains relaxed, and on the other hand, remains flexible in a wide angle during a standard use of the application device, i.e. when the comb of the applicator is guided through the hair in a standard way. This can be achieved if the line between thumb and index finger is aligned at an angular range of 90°±20° to the longitudinal direction of the tips of the teeth of the comb. By way of example, the longitudinal direction is shown in FIG. 6 by a double arrow with reference number 34.

The same advantage results if the line between thumb and index finger is aligned at an angular range of 0°±20° to the head line of the comb.

Good manual guidance of the application device can be achieved if the line between thumb and index finger has a distance range of 70 mm±20 mm from a head line of the comb.

Figure 9:
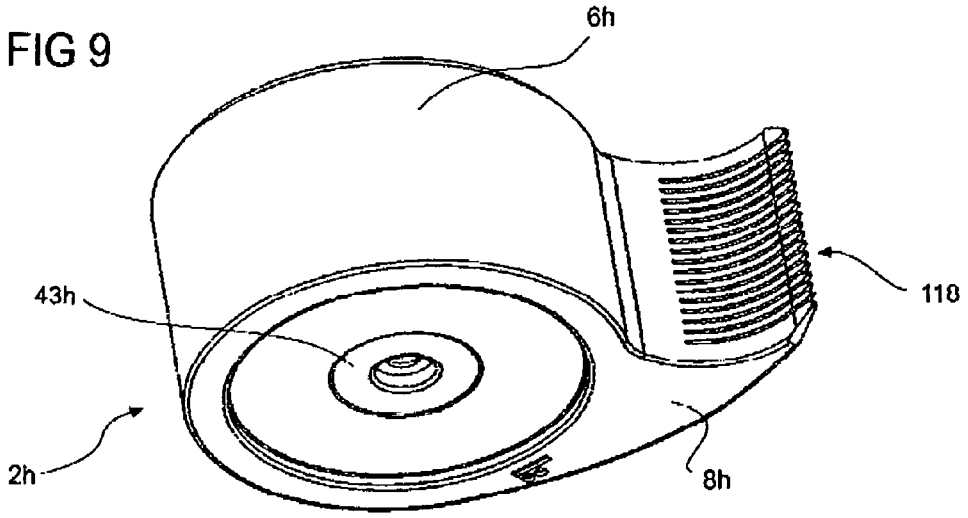
FIG. 9 shows a perspective view of a drop-shaped application device.
Figure 10:
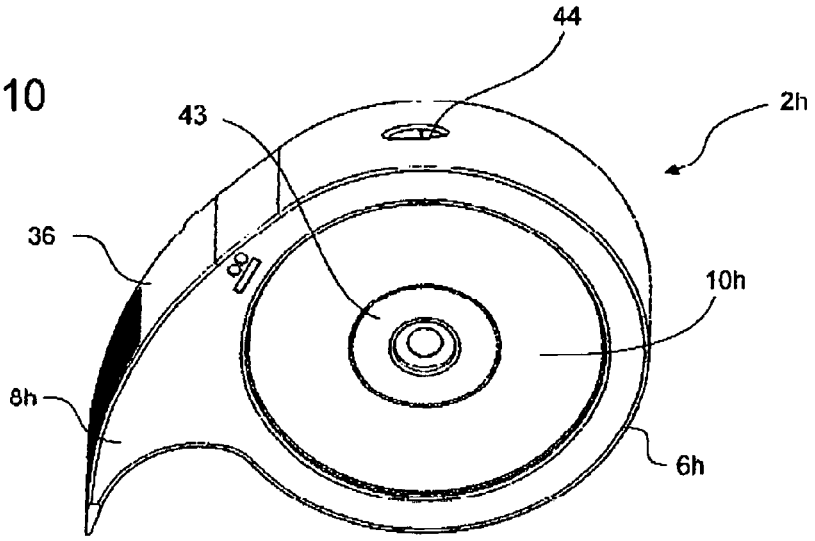
FIG. 10 shows a perspective view—slanted from the top—of the application device with a fill opening for inserting active agent into the reservoir volume.

In a further advantageous embodiment of the invention, the housing part around the reservoir volume has two opposite handle recesses. Advantageously, the handle recesses are laterally opposite, whereby the lateral direction is aligned analogous to the definition provided relative to FIG. 7. Handle recesses 43 are shown in FIGS. 9 and 10.

When thumb and index finger are positioned in the handle recesses, the advantageous position details recited above regarding thumb and index finger are given relative to the application device. Advantageously, the handle recesses are located around the reservoir volume in such a way that the line between thumb and index finger—when the thumb is placed in one handle recess and the index finger in the opposite handle recess—at least one detail, in particular, several details, advantageously meet all the details of this line described above.

It is especially advantageous if the handle recesses are designed as molded elements projecting into the reservoir volume. As a result, a radially outer section around the handle recesses can be created that is laterally broader than the central area of the handle recesses. The additional area is particularly suited for storing an active agent container that can be positioned securely in the reservoir volume due to the lateral tapering in the area of the handle recesses.

Good manual guidance can further be favored if the longest dimension of the application device is smaller than 12 cm.

The same advantage is given if the dimensions of the housing are such that the average hand of an adult can reach around the housing from the side opposite to the applicator extending over an area of at least 80% of the circumference in the direction of the applicator.

In order to bring the application device into ready-to-use condition it is necessary that liquid, viscous or pasty active agent is present in the reservoir volume in such a way that it can advance into the application volume and that hair can pass through it there.

A simple possibility of placing the active agent in this form into the reservoir volume consists of providing a fill opening in the application device. For this purpose, one housing part around the reservoir volume advantageously contains a fill opening for filling active agent into the reservoir volume from the outside. Such a fill opening 44 is shown, for example, in FIG. 10, which shows application device 2*h* of FIG. 9 from the other side.

Advantageously, the fill opening has a closure means with which it can be closed, so that the fill opening is locked impervious to active agent toward the outside. An example of closure means 46 is shown in FIG. 10, which is a component of an additional housing part that is mounted displaceable opposite the housing part having fill opening 44. As a result, fill opening 44 can be opened and closed again by a relative motion of the two housing parts toward each other. Advantageously, the closure means is a part of the housing, which surrounds the reservoir volume in open as well as in closed condition.

It is also possible that the closure means is an element that is separate from the housing, for example, an elastic or fixed bottle that can be attached to the housing. A stopper-like closure means is also conceivable.

Furthermore, it is advantageous when the application device can be placed securely on an even surface. This can be achieved especially easily when the application device has a comb with a row of teeth, and the application device can stand securely on a flat substrate, in which it is supported on the substrate by the row of teeth, advantageously extending over the entire length of the row of teeth.

This is also shown in FIG. 10 by way of example. The firm substrate is indicated by a lower straight line on which applicator 8*h* stands along its head line 30. Likewise, in particular, applicator 2*h* stands on the level substrate linearly with reservoir 6*h*, so that two linear supports of application device 2*h* are achieved on the level substrate. Of course, it is alternatively possible to provide only point-shaped supports instead of the linear supports, for example, in the case of a head line that is curved concavely inward.

An especially simple possibility for filling active agent into the reservoir volume can be achieved if the fill opening points upward in a standing position. This is also shown by way of example in FIG. 10. Application device 2*h* stands firmly on the substrate, and fill opening 44 points upward, so that the active agent can be filled into reservoir volume 10*h* from the top to the bottom.

While using the application device, the fill opening should be firmly closed to safely preclude an undesired discharge of active agent from the reservoir volume while the application device is being used. In an advantageous embodiment of the invention this can be achieved thereby, that the application device is provided with a closure means for closing the fill opening and for closing an application volume that is surrounded by the applicator with respect to the reservoir volume.

The closure means is advantageously designed in such a way that it has a recess that is positioned in such a way that the fill opening is closed when the recess allows passage from the reservoir volume to the application volume. This can be realized if the closure means has one recess for the passage and one for the fill opening respectively, whereby the two recesses are positioned relative to each other in such a way that either the passage or the fill opening is opened. In a different realization, the closure element has only one recess that can be positioned upstream of the passage or the fill opening so that it releases either the fill opening or the passage from reservoir volume to the application volume for the passage of active agent. The closure means thus mandatorily closes either the fill opening or the passage from reservoir volume to application volume. Advantageously, there is also a position in which the closure means closes both openings, i.e. the fill opening as well as the passage.

This detail of the invention is shown in FIGS. 11 and 12. Shown are two housing elements 52*h*, 54*i* of application device 2, whereby housing element 52*h* is an outer housing element and housing element 54*i* is an inner housing element. Both housing elements 52*h*, 52*i* can be stacked into each other in such a way that the reservoir volume 10*h* is surrounded by both housing elements 52*h*, 52*i* toward the outside impervious to active agent. Both housing elements 52*h*, 54*i* can be used in an application device 2*h* or in two different application devices 2*h,i*.

The exemplary embodiment in FIG. 12 contains the lower case letter i in the reference numbers, whereas the exemplary embodiment in FIG. 11 contains the letter h. In principle, these are two different exemplary embodiments, whereby however, this is irrelevant for the following description, as inner housing element 54*i* can also be used together with outer housing element 52*h*. To that extent, all inner housing elements can generally be combined with all outer housing elements.

FIG. 11 shows fill opening 44 and also passage 48 of reservoir volume 10*h* to the application volume within applicator 8*h*. Both housing elements 52*h*, 54*i* are advantageously displaceable toward each other in stacked condition, in particular, rotatable counter to each other, impervious to active agent.

Further, it is advantageous when in an assembled condition impervious to active agent, one of the housing elements, in particular, the inner housing element has a recess that is displaceable relative to the other housing element. This is shown by way of example in FIG. 12. Recess 50*i* in inner housing element 54*i* is designed as slot that can be brought in alignment with passage 48 in outer hosing element 52*h* in assembled condition of the two housing elements 52*h*, 54*i*. In this condition, active agent can flow from reservoir volume 10*h,i* through recess 50*i* and passage 48 into the application volume.

FIG. 11 and FIG. 12 show that inner housing element 54*i* hereby closes fill opening 44. However, inner housing element 54*i* can be rotated in outer housing element 52*h* in such a way that recess 50*i* covers fill opening 44 so that active agent can be filled from the outside through fill opening 44 and recess 50*i* into reservoir volume 10*h,i*. In this position of the two housing elements 52*h*, 54*i*, however, passage 48 through inner housing element 54*i* is closed, so that the active agent cannot flow from reservoir volume 10*h,i* into the application volume.

Housing Elements

In an advantageous design of the invention, the housing includes a housing part around the reservoir volume. This housing part advantageously includes at least two housing elements that are displaceable toward each other, jointly surround the reservoir volume and advantageously form such. Advantageously, the two housing elements can be inserted into each other so that they are first separate from each other, then stacked into each other and engage with each other in stacked condition. These details are shown by way of example in FIGS. 11 and 12.

Advantageously, the housing elements can be rotated toward each other, in particular, around a common cylinder axis. Hereby, these two housing elements advantageously have, at least partially, a cylindrical or partially cylindrical shape. Advantageously, the outer housing element is equipped with an outer rotation surface element that surrounds an inner rotation surface element of the inner housing element.

These types of rotation surface elements 56*h*, 58*i* are shown by way of example in FIGS. 11 and 12. Rotation surface elements 56*h*, 58*i* are designed cylindrical and in stacked condition of the two housing elements 52*h*, 54*i*, aligned in parallel. When the two housing elements 52*h*, 54*i* are rotated, rotation surface elements 56*h*, 58*i* move parallel to each other.

In a further advantageous design of the invention, at least one of the rotation surface elements has ribs that are aligned to the other rotation surface element. The ribs are advantageously aligned perpendicular to a direction of rotation. This is shown by way of example in FIG. 12, which shows inner housing element 54*i* that bears several ribs 60*i* on its rotation surface element 58*i*.

The ribs can fulfill one or more of the following functions:

For a first function, the ribs are designed advantageously asymmetric in rotational direction and form catch means for interlocking with an opposite catch means, which is located at the other housing element. This is shown by way of example in FIG. 13, in which catch means 62*i* is located at outer housing element 2*i*.

Housing elements 2*h*, 2*i* are different exemplary embodiments, for example, with a different applicator 8*h*, 8*i*. The two applicators 8*h*, 8*i*, and also all other applicators 8 that are illustrated can, however, be interchanged as desired. A further difference is catch means 62*i*, which can, however, also be mounted at application device 2*h* or on its housing element 52*h*.

In general, ribs 60 at a housing element 52, 54 in combination with a catch means 62 at the other housing element 54, 52, allow a relative rotational motion of both hosing elements 52, 54 toward each other in one direction, and block a rotational motion relative to each other in the other direction. As a result, the two housing elements 52, 54 can only be brought toward each other in a correct direction in several functional positions.

Advantageously, the ribs are designed transversely tooth-shaped having a direction counter to a relative rotational direction of the two housing elements. The result is a reliable catch function.

A further function of the ribs can consist of taking on a gasket function of the two housing elements 52, 54 relative to each other. This is shown by way of example in the exemplary embodiment shown in FIG. 12. One or more ribs 64*i*—in FIG. 12 these are two parallel ribs 64*ih*—are designed in such a way that they abut at the opposite housing element 52, 54, in this example 52*h,i*. As a result of recess 50*i*, active agent discharging from reservoir volume 10*h,i* into application volume 12*h,i* is prevented by ribs 64*h* from entering between the two housing elements 52*h*, 54*h*.

Advantageously, at least two ribs are located parallel to each other and, in particular, at a distance of less than 5 mm from each other, in particular, extending over their entire length. As the result of such a double rib, a capillary connection of an active agent film can be burst, so that the gasket effect between the two housing elements is higher.

A third function is that of maintaining a distance. For this, the ribs are located advantageously at the inner housing element of the two housing elements. As described later, an active agent container, in particular, consisting of an elastic film, can be drawn-in between the two rotation surface elements of the two housing elements. Hereby, the active agent container is displaced relative to at least one of the two housing elements, in particular, relative to the inner one of the two housing elements. Thus, it slides along on this housing element. As it could be that the active agent container is also somewhat moistened by active agent on the outside, the active agent container can stick to the inner housing element around which it is guided. In this way, high frictional forces can be generated between the active agent container and the housing element that slides alongside it. These frictional forces can be reduced by the ribs as spacers, because the active agent container is then at a distance from at least one part of the surface of the housing. The two housing elements can thus be more easily rotated counter to each other.

Advantageously, the ribs are located at a constant distance to each other at least extending over an area of the rotation surface element, but advantageously at least over one quarter of the circumference of the rotation element, i.e. at least over 90° along the rotation surface element. This regularity does not have to relate to each rib, as the ribs can also be grouped in pairs or in groups of other multiples, so that the groups are respectively located at a constant distance to each other. In particular, at least four ribs, or four groups of ribs have a constant distance, in particular, with a distance in the rotational direction of the two housing elements toward each other. An exemplary configuration of this is shown in FIG.

12. Ribs 60*i* are located extending over the entire outer surface of rotation surface element 58*i* at a distance of 1 cm relative to each other.

In particular, to achieve a reduction in the friction of the two housing elements toward each other during a displacement of the two housing elements relative to each other, it is advantageous if these ribs have a height so that a gap remains between the ribs and the opposite housing element. In the exemplary embodiment shown in FIG. 12, the gap is approximately 0.5 mm wide, so that the ribs have this distance from outer housing element 52*h,i*.

A further embodiment of the invention provides that at least one of the housing elements is transparent, at least in sections or zones, for example, in such a way that writing located behind the transparent section, for example, a newspaper cutting, can be read through that section. As a result, writing can be read from the outside, for example, operating instructions, which make it easier to operate the application device.

Advantageously, the transparency is limited to one or several transparent zones of the housing, in particular, the outer housing element, so that during a motion of the two housing elements toward each other, different characters are made visible or covered by motions of the inner housing element. In this way, for example, handling instructions can be displayed and covered again depending on the relative position of the two housing elements.

An example of such an embodiment is shown in FIG. 11. The outer housing element 52*h* contains a transparent zone 66, which is surrounded by non-transparent material, so that zone 66 forms a window in housing element 52*h*. When housing elements 52*h*, 54*i* are rotated relative to each other, different sections of inner housing element 54*i* become visible or—in the case of an active agent container between the two housing elements 52*h*, 54*i*—this active agent container, which can have imprinted handling instructions.

In a further advantageous embodiment of the invention, the two housing elements are inserted into each other and interlocked with each other. Advantageously, the interlock blocks a disassembly of the housing elements in such a way that the two housing elements are again separated from each other. To do this, the interlock must first be released. Advantageously, the interlock is established by the elastic deformation of at least one of the two housing elements, whereby the elastic snapping in the direction of the relaxed starting position creates a positive connection of the two housing elements that blocks disassembly of the two housing elements.

Advantageously, the interlock is designed in such a way that the inner housing element is pushed elastically inward and snaps radially outward into the interlock. This can be explained with the help of the exemplary embodiment in FIGS. 11 and 12. Outer housing element 52*h* has a groove 68 into which a front edge 70 of an inner housing element 54*i* is inserted. The radial inner side of groove 68 hereby has a slight undercut and front edge 70 a small, bead-shaped, inward molded element, which engages with the undercut in stacked condition. When inner housing element 54*i* is inserted, front edge 70 is first pressed somewhat apart and hereby elastically deformed, which is easily possible because of recess 50*i*. When the interior molded element at front edge 70 completely engages with the inner undercut of groove 68, front edge 70 snaps back inward, and forms the snap interlock with groove 68 or outer housing element 52*i*.

Advantageously, the interlock connects the two housing elements with each other, which then cannot be detached from the outside without destroying the elements. Hereby, an unintentional coming apart can be prevented, as well as an objectionable recycling of the application device.

Further, it is advantageous if the housing elements are connected with each other by a gasket in the interlocked position that seals the reservoir volume leak-proof toward the outside. In the exemplary embodiment in FIGS. 11 and 12 that can be used as examples of this detail of the invention, the inner of the two housing elements 54*i* has a groove 72 with which an annular molded element 74 of the outer housing element engages. Groove 72 and molded element 74 form a groove-spring-closure, which forms an outward gasket of reservoir volume 10*h,i* by means of an annular force-fit connection.

Advantageously, the gasket is designed in such a way that it is locked as a result of the process of an interlocking snap.

Moreover, it is proposed that the two housing elements—as has also been shown above already—are cylindrically rotatable counter to each other. Advantageously, the two housing elements include catch means that limit the rotation of the two housing elements toward each other in one rotational direction. By way of example, this is described with the help of FIGS. 12 and 13 with ribs 60*i* and catch means 62*i*.

Functional Positions

Further, it is advantageous if at least one of the two housing elements has a blocking element that blocks any further rotation of the two housing elements after a rotation in one rotational direction. Advantageously, the blocking element blocks the two housing elements in one, or successively in several functional positions. The blocking element can be located at one of the two housing elements, whereby the other housing element advantageously has a counter-element that butts against the blocking element when the two housing elements reach the functional position relative to each other. Such a functional position can be a delivery position, a fill position, a mixing position and/or an application position.

An example of a blocking element 76 is shown in FIG. 11. It is located at outer housing element 52*h* and in this exemplary embodiment, designed as a triangular molded element. An example of a counter-element or a different blocking element at the other housing element is shown in FIGS. 14 through 19.

FIGS. 14 through 21 show an application device 2*j* in four different functional positions, respectively from the front and the back. The functional positions are a delivery position (FIGS. 14 and 15), a fill position (FIGS. 16 and 17) a mixing position (FIGS. 18 and 19) and an application position (FIGS. 20 and 21) FIGS. 14, 16, 18 and 20 show application device 2*j* in a view from the outside onto inner housing element 54*j*. FIGS. 15, 17, 19 and 21 show application device 2*j* from the other side in a cross sectional view, so that inner housing element 54*j*, outer housing element 52*j* and applicator 8*j* is visible, which is molded onto other housing element 52*j*.

Advantageously, the inner housing element has a handle element, the shape of which is adapted to the profile of the applicator. The adaptation takes place in so far that the handle elements are located laterally next to the applicator in such a way that the handle element forms a lateral continuation of the profile of the applicator and thus has a profile that is at least largely identical to that of the applicator when viewed from the side.

This is shown by way of example in FIGS. 20 and 21. In the lateral view of FIG. 20, handle element 78 covers applicator 8*j*, whereby applicator 8*j* covers handle element 78 when viewed from the opposite lateral side, as shown in FIG. 21.

Figure 14:
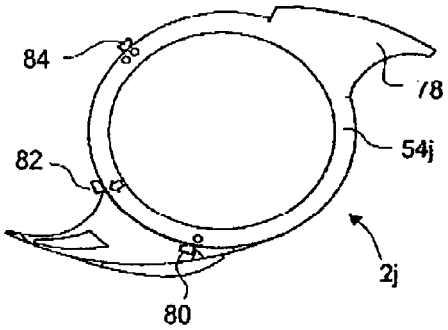
FIG. 14 shows a lateral view of an application device in a delivery position.
Figure 15:
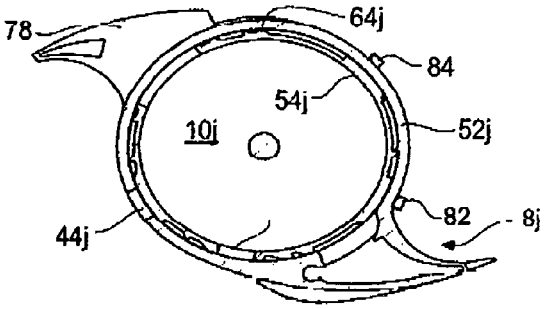
FIG. 15 shows the same application device in a lateral cross sectional view.

In the delivery position shown in FIGS. 14 and 15, the two housing elements are advantageously prevented from a relative rotation counter to directional rotation or a rotational direction of the application by a catch means and blocked in the rotational direction of the application by a blocking element, so that the delivery position is fixed. This can be seen in FIGS. 14 and 15.

FIG. 14 shows three blocking elements 80, 82, 84 that are advantageously molded into the substance of a housing element. In this exemplary embodiment, this is at inner housing element 54*j*. Blocking elements 80, 82, 84 respectively have predetermined breaking points that break counter to each other upon a forceful rotation of the two housing elements 52*j*, 54*j* counter to each other, so that the corresponding blocking element 80, 82, 84 breaks away from housing element 54*j*. Rotational direction 86 is marked by an arrow in FIGS. 14 and 15. This rotational direction 86 is a rotational direction of the application that is intended for an application using the application device. Rotational direction 86 relates to one of the housing elements, in the exemplary embodiment, to inner housing element 54*j*, which is to be rotated in rotational direction 86 relative to the other housing element 52*j* from one functional position to any other functional position.

In order to bring the application device from the delivery position into the next functional position, for example, the fill position, the two housing elements must be rotated relative to each other. If this is done forcefully, the blocking element breaks and releases rotation in rotational direction 86. In the exemplary embodiment shown in FIGS. 14 and 15, this is blocking element 80, which butts against opposite blocking element 76 in the delivery position, and upon a rotation of the two housing elements 52*j*, 54*j*, breaks off inner housing element 54*j*. The rotation of the housing elements is now released in rotational direction 86, advantageously until a subsequent blocking element 82 abuts at an opposite blocking element 80. This is shown by way of example in FIGS. 16 and 17. The subsequent blocking element 82 butts against stationary blocking element 76, as a result of which continued rotation in rotational direction 86 is once again blocked. The first blocking element 80 has broken off.

If the application device is intended to be used, it is advantageously brought from a first functional position, for example, a delivery position, into an adjacent functional position, for example, a fill position. This is shown by way of example in the transition from the functional position in FIG. 14 into the functional position in FIG. 16.

Figure 16:
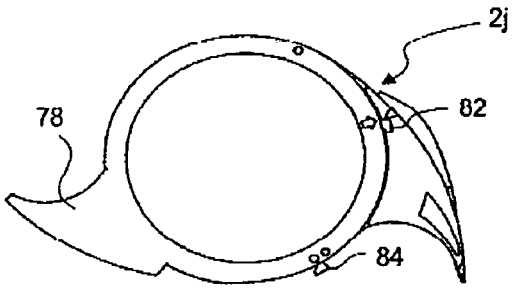
FIG. 16 and FIG. 17 shows the application device in a fill position.
Figure 17:
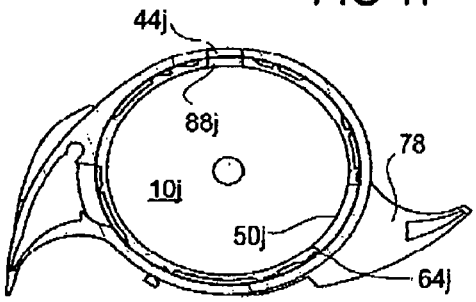

FIGS. 16 and 17 show application device 2*j* in a fill position. In this exemplary embodiment, not only the outer housing element 52*j* has a fill opening 44*j*, but also inner housing element 56*j* has a fill opening 88*j*. Fill opening 88*j* is separate from recess 50*j* of inner housing element 54*j* and is adapted in its dimensions to outer fill opening 44*j*, in particular, designed identical to it.

The two fill openings 44, 88—or in another exemplary embodiment, fill opening 44 and recess 50—are covered in the fill position so that a passage is available from the outside into reservoir volume 10*j*. Through this passage, active agent can be filled into the reservoir volume 10*j* from the outside.

In the fill position, the passage from the reservoir volume to the application volume is always closed impervious to fluids, so that the active agent that has been filled into the reservoir volume cannot reach into the application volume.

In order to make filling of the application device easier, it is advantageously designed in such a way that it can stand securely on a flat substrate and the fill opening points upward in this stable standing position. This is shown in FIGS. 16 and 17 by way of example. Application device 2*j* abuts with its applicator 8*j*—in this exemplary embodiment with the head line, i.e. the tips of the teeth of applicator 2*j*—on the level supporting surface indicated by the horizontal line. This is analogous to the exemplary embodiment in FIG. 10, whereby an additional advantage is realized in the exemplary embodiment in FIGS. 16 and 17.

Generally speaking, a handle element in the fill position is positioned relative to the applicator in such a way that the handle element countervails a tipping of the opening or fill opening. In particular, the applicator and the handle element are positioned in such a way that the applicator countervails a tipping in one direction, and the handle element prevents a tipping of the application device in the other direction, or at least countervails this tipping.

This can be seen in FIG. 17. Fill opening 44*j* points upward and applicator 8*j* prevents any counterclockwise tilting, and handle element 78 a tilting of fill opening 44*j*, or the entire applicator 2*j* in clockwise direction. Hereby, a very secure stand of application device 2*j* is achieved on a level substrate.

Figure 18:
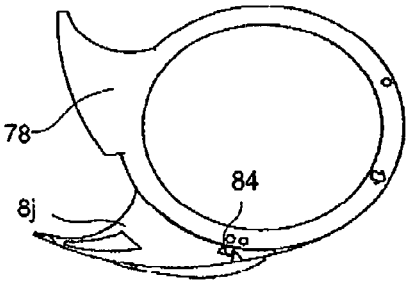
FIG. 18 and FIG. 19 shows the application device in a mixing position.
Figure 19:
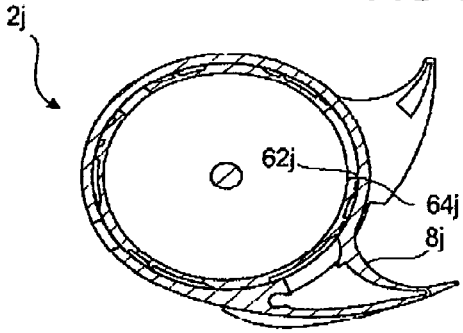

A further functional position is shown in FIGS. 18 and 19. This functional position is a mixing position. In order to bring both housing elements from a fill position into the mixing position, a blocking element must be overcome once more. This is shown in FIGS. 16 and 18. If inner handle element 54*j* continues to be rotated in rotational direction 86 out of the mixing position, blocking element 82 breaks off blocking element 76 and releases rotation in rotational direction 86. Both housing elements 52*j*, 54*j* can be brought into the adjacent mixing position, which is shown in FIG. 18. In the mixing position, there is once again a blocking element inhibiting rotation—in the illustrated exemplary embodiment blocking element 84—at blocking element 76, so that an unintended continued rotation through the mixing position into the subsequent application position is prevented.

In the mixing position, the reservoir volume is completely closed toward the outside, so that active agent cannot penetrate to the outside, even upon intense shaking of the reservoir volume, and can also not reach into the application volume. A possibly present fill opening is closed, as well as a passage from the reservoir volume to the application volume. The active agent in the reservoir volume can now be mixed by shaking the application device, in order to be prepared for use or an application.

The following application position is advantageously a position for applying active agent to the hair. Even during transitioning into the application position, a blocking element must be overcome, in the shown exemplary embodiment, this is blocking element 84, which is broken off in the application position that is shown by way of example in FIGS. 20 and 21. In the application position, the passage from the reservoir volume to the application volume is released, so that active agent can flow from the reservoir volume into the application volume.

In the exemplary embodiment shown in FIG. 21, a pump element 90 in the form of a metal sphere is located in passage 48, through which active agent can be pumped from reservoir volume 10*j* into application volume 12*j*.

Advantageously, the two housing elements can be interlocked with each other in the rotational direction in various positions. In particular, they can be locked in the functional positions. When the housing elements are rotated relative to each other in the rotational direction, the housing elements lock into each other in the various functional positions. A reverse rotation, i.e. a rotation of the housing elements counter to the rotational direction is blocked by the interlock.

A delivery position can be characterized by an interlocking position of the two housing elements with each other, in which the reservoir volume of both housing elements is closed to the outside and to the application volume, impervious to active agent. An application position can be characterized by an interlocking position in which the reservoir volume of both housing elements is closed to the outside, impervious to active agent, and is open toward the application volume.

Gaskets

As has already been mentioned, it is advantageous if the housing element that engages inward has an opening or a recess that connects, given a corresponding position of the housing elements relative to each other, the reservoir volume with the application volume that is surrounded by the applicator. In order to prevent an undesired transfer of active agent from the reservoir volume into the application volume, it is further advantageous if a gasket is located between the two housing elements, which seals the recess—in a position of the two housing elements relative to each other in which the reservoir volume is closed toward the application volume—against the application volume impervious to active agent in such a way, that active agent that has run into the opening does not reach into the application volume. This gasket was realized as a rib in the exemplary embodiment in FIG. 12, whereby, however, other types of gaskets are also possible and advantageous. FIGS. 15, 17, 19 and 21 also illustrate such a gasket 64*j*.

Further, it is advantageous if a gasket element of the gasket is a catch means for blocking a reverse rotation of the two housing elements. Hereby, the gasket element can serve a dual function. This is shown by way of example in FIG. 19. Catch means 62*j* engages with gasket or rib 64*j*, so that a reverse rotation of inner housing element 54*j* counter to rotational direction 86 [68] is prevented.

In this exemplary embodiment, gasket 64*j* has two gasket elements in the form of ribs, or lips, both of which serve as catch means and counter piece to catch means 62*j*. Because the gasket abuts at catch means 62*j*, an additional advantage is achieved in that the sensitive mixing position, in which the active agent is forcefully moved back and forth in the reservoir volume, a large supporting surface of gasket 64*j* is achieved on catch means 62*j*, and thus a large gasket effect. This is because the gasket abuts not only radially outward at outer housing element 52*j*, but also counter the rotational direction at catch means 62*j*.

Advantageously, the gasket includes at least one lip-shaped molded element on the outside of the inner housing element as is shown, for example, in FIG. 19. Hereby, gasket 64*j* is also designed as a rib analogously to gasket 64*i*, just like rib 60*i*.

A particularly large gasket effect can be achieved if the gasket has at least two lip-shaped molded elements with a deepening between them on the outside of the inner housing element. Hereby, a continuous capillary layer can be interrupted so that even small flows of active agent are prevented. This can also be seen in FIGS. 15, 17, 19 and 21.

Active Agent Container

Most of the time it is advantageous when the active agent is not stored directly in the reservoir volume, but in an active agent container that is adapted to the active agent. In this way, the active agent can be stored particularly leak-proof within the application device during transport, or while shelved for sale. Hereby, it is advantageous if the active agent container is already mounted within the housing so that it can be avoided that a buyer, for example, will have to insert the active agent container into the housing.

Advantageously, the active agent container contains active agent in such a way that the active agent does not moisten the walls of the reservoir volume. The active agent container is thus a container that is available within the reservoir volume and in addition to the housing.

It is especially advantageous if the active agent container is a flexible bag, in particular, a plastic bag. Depending on the type of active agent and the amount of active agent, several active agent bags can be located in the reservoir volume, or the active agent container can have several chambers.

Advantageously, the application device includes an attaching means with which the active agent container is attached to a housing element within the reservoir volume. An example of this is shown in FIG. 22. Active agent container 92 is a plastic bag that is attached to an attaching element 94 of an attaching means 96, for example, by adhesion. Attaching element 94 can be inserted form-fit into one of the housing elements, for example, outer housing element 52*k*.

In the exemplary embodiment shown in FIG. 22, attaching element 94 is cylindrical, for example, a small bar consisting of wood or plastic, and is inserted into a cylindrical cut-out 98 of outer housing element 52*k*. Cut-out 98 and attaching element 94 are components of attaching means 96.

FIG. 24 shows a cut-out of outer housing element 52*k* around attaching element 94, which is designed as a cylindrical bar consisting of plastic. It is likewise inserted into cylindrical cut-out 98. Active agent container 92 is designed as plastic bag that is wound around attachment element 94 at one end, in FIG. 24, counterclockwise, and attached to attaching element 94 by adhesion. Only an edge 100 of active agent container 92 is wound around attaching element 94, whereby an interior cavity of active agent container 92 that contains active agent is closed against edge 100. In this exemplary embodiment, edge 100 is separated from the interior cavity section of active agent container 92 by a weld seam 102.

Furthermore, it is advantageous if the housing has at least one interior molded element extending into the reservoir volume, around which the active agent container is guided, and which reduces the lateral dimensions of the reservoir volume in such a way that the active agent container cannot pass over the interior molded element without buckling because of its dimensions. This type of interior molded element 104 is shown by way of example in FIGS. 22 and 23. Advantageously, the interior molded element is a handle recess just like above, for example, and, in particular, as described relative to FIGS. 9 and 10. Because the interior molded element reaches into the reservoir volume, it can be achieved that the active agent container places itself relatively uniformly onto the outer interior contour of the housing, or the reservoir volume, and does not, for example, buckle into zigzag folds. This is advantageous for expelling active agent with little friction, as described further below.

The interior molded elements advantageously respectively extend laterally at least 3 mm, in particular, at least 5 mm into the reservoir volume.

Advantageously, the active agent container is wider than the width of the reservoir volume in the area of the interior molded element. It can be countervailed that the active agent container unintentionally slides past the interior molded elements so that the active agent container remains in rounded position in the reservoir volume and attached to the inner housing element. Advantageously, the interior molded elements form a guide for the active agent container, in particular, in such a way, that the active agent container can only pass the interior molded elements transverse to the cylinder axis by buckling.

Advantageously, the active agent container includes a predetermined opening position that automatically opens at a predetermined interior pressure of the active agent. The interior pressure is an excess pressure relative to the environment of the active agent container. Opening can consist of a tear in the wall of the active agent container, in particular, at a predetermined opening position.

Advantageously, the active agent container includes a predetermined opening position that automatically opens at a predetermined interior pressure of the active agent. The interior pressure is an excess pressure relative to the environment of the active agent container.

Advantageously, the reservoir volume has a cylindrical shape and the active agent container is inserted into the reservoir volume. In the area of the reservoir volume, the housing, in particular, in the section of the cylinder axis, has at least one handle recess, that reaches into the reservoir volume as an inward-pointing interior molded element. Advantageously, the active agent container is guided around the handle recess. Furthermore, it is advantageous if the active agent container is wider than the width of the reservoir volume in the area of the interior molded element, and the interior molded element forms a guide for the active agent container. Advantageously, the active agent container that is filled with active agent is designed having such dimensions so that it can only pass transverse to the cylinder axis of the interior molded element by buckling.

A further advantageous embodiment of the invention provides that the application device has at least two actuation elements that are displaceable toward each other, of which one is form-fit, in particular, firmly attached to the active agent container, and the other is mounted in such a way that its displacement moves the active agent container that is advantageously located in the reservoir volume by force. Hereby, the active agent container that is not accessible from the outside can be displaced inside the housing, in particular, within the reservoir volume, by an actuation of the actuation elements.

Ideally, the application device is designed in such a way that an emptying of the active agent container takes place if an inner housing element that is facing the user is rotated relative to the outer housing in clockwise direction from the viewpoint of the user. As a result, optimal handling is achieved for right-handed persons.

Advantageously, at least one of the actuation elements includes an attaching means for attaching the active agent container in such a way that upon a movement of the actuation elements relative to each other, the active agent container is forced to follow the actuation element with the attaching means. Advantageously, the active agent container has one piece wound around the attaching element, in particular, at least one turn and/or at least as far as 5 mm. Advantageously, the actuation elements are housing elements of the housing of the application device. This is shown by way of example in FIG. 22. Active agent container 92 is attached to attaching element 94 and it in turn is attached to outer housing element 52*k*. If the two housing elements 52*k*, 54*k* are moved counter to each other, active agent container 92 is forced to move along with outer attachment element 52*k*.

Further, it is advantageous if the other attachment element is located in such a way that its movement compresses the active agent container. This detail of the invention is shown in FIGS. 22 and 23. If the inner housing element 54*k*—based on its position shown in FIG. 22—is moved counterclockwise relative to the outer housing element 52*k*, it butts against active agent container 92 and displaces it in reservoir volume 10*k*. Upon further rotation, the front bead of inner housing element 54*k* slides over a cut-out 98, so that the part of active agent container 92 projecting directly out of cut-out 98 is compressed between these two housing elements 52*k*, 54*k*. In this way, this part of active agent container 92 is emptied by compression.

Upon further rotation of inner housing element 54*k* relative to outer housing element 52*k*, an increasingly larger part of active agent container 92 is pressed between the two housing elements 52*k*, 54*k*, or expressed in another way—based on a static inner housing element 54*k* and an outer housing element 52*k* that is displaced relative to it—upon continuing rotation of the two housing elements 52*k*, 54*k* toward each other, active agent container 92 is drawn further and further or deeper in between the two housing elements 52*k*, 54*k*. Hereby, active agent container 92 is compressed and thus its interior volume is reduced, so that it will be at least largely emptied.

Advantageously, the actuation elements are connected with the active agent container in such a way that their displacement relative to each other exerts an opening force on the active agent container within the housing. This can also be seen in FIGS. 22 and 23. As a result of compressing active agent container 92 and the accompanying increase in interior pressure, in particular, by the active agent contained in active agent container 92, an opening force is exerted on the active agent container, subject to which active agent container 92, for example, ultimately bursts open.

This can be promoted by the presence of a predetermined breaking point on an active agent container 92, which is shown by way of example in FIG. 22, as predetermined breaking point 106. At this predetermined breaking point 106, the walls 108 of the active agent container are attached relative to each other in such a way that active agent is present all around this attachment position—predetermined breaking point 106. This presses the attachment position apart from all sides so that wall 108 ultimately tears open at this predetermined breaking point 106. Predetermined breaking point 106 can also be designed in such a way that the active agent is not present all around it, but only at an angular range of at least 270° around predetermined breaking point 106.

Advantageously, the actuation elements are located relative to each other in such a way and at least one of the actuation elements is located relative to the active agent container in such a way that the active agent container is displaced, for example, pulled between the actuation elements upon a relative motion, in particular, a rotation, of the two actuation elements. Advantageously, the active agent container is completely displaced between the actuation elements so that it is located, in particular, two-dimensionally between the actuation elements.

This is shown by way of example in FIG. 23. Active agent container 92 is pulled completely between the actuation elements, in this exemplary embodiment, the two housing elements 52*k*, 54*k*. It has thus moved out of reservoir volume 10*k* completely.

In a further advantageous embodiment of the invention it is proposed that at least one of the actuation elements has a pressure means that is prepared to press the active agent container to another element upon a displacement of the two actuation elements toward each other, for example, a rotation of the two actuation elements toward each other. This is also shown by way of example in FIG. 22. Pressure means 110, which is designed as a bead at the edge of recess 50*k* in this exemplary embodiment, presses active agent container 92 onto outer housing element 52*k*.

Advantageously, the pressure means is prepared to press active agent out of the active agent container, in particular, at least most of the active agent, preferably at least 90% of the active agent contained in the active agent container. In the exemplary embodiment shown in FIG. 23, pressure means 110 has emptied active agent container 92 almost completely, so that the active agent is now freely available in reservoir volume 10*k*, and the active agent container is empty and located outside of the reservoir volume, in this exemplary embodiment, between the two housing elements 52*k*, 54*k*.

Advantageously, the pressure means includes a reinforcement of the actuation element. This reinforcement can, for example, be designed in the shape of a bead, which advantageously extends at least over the length of the width of the active agent container. This embodiment of the invention is also shown in FIGS. 22 and 23. The bead, or pressure means 110, which is only shown in cross section in FIGS. 22 and 23, extends at a width that is shown perpendicular to the surface in the Figures, extending over a distance that is larger than the average width, in particular, the largest width of active agent container 92 in reservoir volume 10*k*. In particular, the width of pressure means 110 extends over the entire width of reservoir volume 10*k*.

As shown by way of example in FIGS. 14 through 21, several actuation steps can be required until the application device is transitioned from a delivery state to an application state. In order to make it easier for the operator to use the application device, it is advantageous when it has visual instructions, for example, pictograms or lettering that instructs the operator how to perform the actuation steps. With the help of a transparent section or a transparent zone, just like zone 66 in FIG. 11, through which such information is visible, this can be implemented in an especially advantageous way.

This is particularly advantageous then, when the actuation elements are located relative to each other and to the active agent container so that the active agent container is pressed onto a wall of the housing when the actuation elements are displaced counter to each other. Now, it can lie two-dimensionally against the transparent zone on the inside, so that from the outside, information can be viewed that is advantageously printed onto the active agent container. Advantageously, the wall of the housing is a wall of the housing around the reservoir volume. Advantageously, the active agent container will be pressed against the wall two-dimensionally.

The information can be a visual marking that can be viewed from outside the housing, in particular, in normal lighting suitable for reading, for example, an actuation marking, an arrow, a line, writing or the like.

Further, it is advantageous if the active agent container is displaced relative to the outer housing element, and the housing element is guided along such from the inside when the actuation element is moved. Hereby, various information sections can be placed along the transparent zone, so that depending on the position of the actuation elements, or the housing elements, different information becomes visible in the transparent zone.

Further, it is advantageous if the part of the active agent container that is pressed to the housing wall is a part of the active agent container that has been squeezed out. Hereby, an especially two-dimensional and smooth abutment of the expelled active agent container can be achieved against the wall of the housing.

As described above, it is advantageous if the housing part around the reservoir volume has two housing elements that engage with each other, in particular, jointly surround the reservoir volume, and the housing elements are the actuation elements. This is shown by way of example in FIGS. 11 through 24.

Advantageously, the two housing elements can be interlocked at several different positions, whereby the active agent container is located relative to the housing elements in such a way, and shaped in such a way that an engaged position holds the active agent container without pressure from the outside and the two housing elements, in particular, after the active agent container has been squeezed out completely, interlock in a subsequent engaged position, in particular, in such a way that a relative motion backward into the direction of the expelling motion is blocked.

Further, it is advantageous if the housing elements are designed in such a way that the active agent container will be squeezed out upon a rotation of the housing elements relative to each other from a delivery position into a mixing position.

A further advantageous embodiment of the invention provides that the application device has a pressure means for squeezing out the active agent container against a wall. Advantageously, the squeezing out occurs when the pressure means slides along the wall and is advantageously also displaced relative to the active agent container and slides along such. While it is sliding along, the pressure means presses the active agent container against the wall so that it will be at least partially squeezed out.

Advantageously, the pressure means includes an expelling element and a volume expansion that is located behind it so that the area of the active agent container that will be expelled is pressed through a narrow point at the expelling element and can then expand again in the volume expansion.

Figure 25:
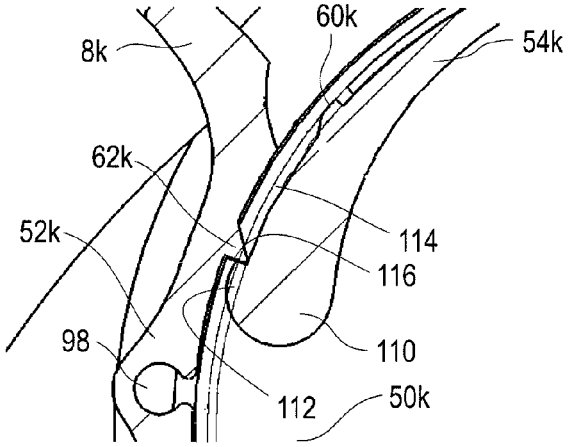
FIG. 25 shows a further enlargement of FIG. 22 of a pressure means of the inner housing element.

This detail is shown by way of example in FIG. 25, which shows an enlarged cut-out of the application device 2*k* in FIG. 22. Inner housing element 54*k* with pressure means 110 at the edge of recess 50*k* can be seen. On its radial outer side, pressure means 110 has an expelling element 112, which, in a relaxed state of pressure means 110, is advantageously located at a small distance of at least 1 mm from outer housing element 52*k*. Behind expelling element 112, the terms front and back are to be understood as the direction of movement of pressure means 110 forward for expelling active agent container 92, if there is a volume expansion 114 in whose area pressure means 110 does not reach as far radially outward as expelling element 112, active agent container 92 is pressed through the narrow point at expelling element 112, so that it can expand again in volume expansion 114. This has the advantage that the frictional forces between active agent container 92 and pressure means 110 are reduced so that an actuation of the housing elements or actuation elements is made easier.

Advantageously, the volume expansion starts behind the expelling element with an undercut at the expelling side of the pressure means. Even this undercut 116 is illustrated in FIG. 25. It is a recess behind expelling element 112 radially inward, hereby starting volume expansion 114. Hereby, starting means from the front to the back so that volume expansion is formed behind undercut 116 and thus extends from undercut 116 backward.

Furthermore, it is advantageous if the undercut forms a recess for engaging with a catch means. Hereby a twist-safety of the two actuation elements or housing elements can be achieved. The catch means is advantageously provided to elastically deform the pressure means for snapping into an engaged position.

An exemplary embodiment that shows this detail of the invention can be seen in FIG. 25. Catch means 62*k* engages from the back at undercut 116, so that a reverse rotation of inner housing element 54*k* counter to rotational direction 86 is prevented.

Upon rotation in rotational direction 86, pressure means 110 or inner housing element 54*k* is deformed inward, when expelling element 112—in the view shown in FIG. 25 counterclockwise—is guided past catch means 62*k*. The same applies if additional catch means 60*k* are guided past catch means 62*k* that can be ribs, for example.

In a further advantageous embodiment of the invention, the actuation elements are designed in such a way that they bring the active agent container between themselves when activated. This embodiment of the invention is shown in FIG. 23.

Advantageously, the radial inner actuation element includes spacers on which the active agent container rests. These spacers have already been described in connection with FIG. 12, whereby in the exemplary embodiment in FIG. 12, they are ribs. However, other non-rib-shaped designs are also conceivable, i.e. even spacers in the rotational direction and not transverse to the rotational direction as shown in FIG. 12. Advantageously, the active agent container rests on the spacers that retain the active agent container at a radial distance of the largest part of the outer surface of the inner actuation element. Hereby, the frictional resistance of the active agent container relative to the actuation element can be kept low.

Advantageously, the expelling element projects radially further outward than at least the preponderant part of the spacer. This is shown in FIG. 25 by way of example. Expelling element 112 projects radially further outward than spacer 60*k*. Spacers located further in the rear and spacers not shown in FIG. 25, likewise project radially far outward, just like the illustrated spacer 60*k*.

With respect to opening the active agent container, the following variants of embodiments of the invention are advantageous. Advantageously, the active agent container includes a closure and at least one of the actuation elements has an opening means that is designed in such a way that it opens the closure upon a displacement of the actuation elements against to each other. This can be done, for example, in such a way that the active agent container is pulled apart in such a way that it bursts upon a movement of the actuation elements relative to each other. Hereby, the opening means would be an attachment of the active agent container at the actuation element, so that the active agent container is firmly attached, at both actuation elements, for example. The closure would then be that position at which the active agent container rips open, advantageously a predetermined breaking point. Other closures are also possible, for example, a valve, an opening that is closed by the closure and is opened upon opening, or a different design. Thus, the closure can, for example, be a tearing element for tearing into an opening that is made-to-measure underneath. It is likewise advantageous if the closure includes a film on a tear-off layer.

It is also possible and advantageous when several active agent containers are stored in the housing, which are opened in different ways. Thus, for example, one active agent container containing a liquid can be opened as described in FIGS. 22 and 23. A likewise present container containing granulate can, for example be torn open as described above. Both processes can be triggered by the same actuation elements.

What has been described above makes it clear that the idea of opening the active agent container by compressing an active agent container within housing is also applicable to applications other than to an application device. With the help of this invention, active agent containers can be opened without having to be touched.

For this reason, the invention also addresses an opening device for opening an active agent container. The opening device includes two elements that are displaceable relative to each other, whereby the active agent container is attached to at least one of the elements, so that it is displaced relative to the other element upon a movement of the two elements relative to each other.

Advantageously, at least one of the elements is a housing element, in particular, both elements are housing elements.

The relative motion is preferably a rotation of the two elements toward each other.

Further, preferably, one or several, up to all of the aforementioned and following features concerning the active agent container and those for opening the active agent container can be combined with this idea individually or in any combination. In particular, a device such as the application device is intended to be protected that, and even though it has both elements, it is not required to have been created either for applying an active agent to a fibrous material, or to contain an applicator for applying the active agent contained in an application volume to the fibrous material.

The device is particularly suited for use with an active agent container for, and especially with an active agent for the treatment of hair, for example, coloring, bleaching, hair care, hair conditioning, hair removal, in particular, by applying a surfactant, for example, exfoliator, which penetrates the roots through capillaries, or for mechanical hair removal, for example, wax or adhesive.

The device is particularly suited for use with an active agent container for and especially with an active agent that can be a pharmaceutical product, a medical product and/or a cosmetic product.

Further, the device is especially suited for use with an active agent container for and especially with an active agent consisting of several active agent components that must be stored separately and which must be prepared or mixed prior to use, such as lacquers, foaming substances, for example, foam and/or mouse colors, resin, sealing mass, e.g. acrylic, silicone, putty, adhesive, pesticides, e.g. weed or vermin control, etc.

The active agent can also be a detergent, a cleaning agent, a cosmetic product, e.g. cream, milk, lotion, a care product or the like, e.g. for skin, floors, car, etc. Equally good possibilities are groceries such as soups, sauces, dressing or dietary supplements, e.g. vitamins, or drinks, e.g. mixed drinks, carbonated drinks, or active agents, freshness agents or the like.

An advantageous embodiment of the device has an applicator for applying the active agent to an object, for example, fiber, hair, a level surface and the like. The applicator can be designed as described for the application device, or it can have a roller, a brush or a textile or a mesh for applying the active agent, for example, a cloth such as a moist cloth, care cloth or cleaning cloth, even a wash fleece is possible and advantageous.

Applicator

With respect to the application device, a further advantageous variant of an embodiment of the invention provides that the applicator surrounds the application volume and has an introduction means for introducing fibers of the fibrous material or hair into the application volume. Advantageously, the introduction means has gaps through which the hair is guided and that is done advantageously in such a way that the hair located in the gaps passes through the application volume.

The introduction of hair into the application volume can be facilitated if the applicator has a lower supporting surface for two-dimensional support on a fiber substrate, in particular, a scalp. Such a supporting surface 36 is shown by way of example in FIGS. 5 through 10.

The applicator can be manufactured in various ways and can be connected with the reservoir. Thus, the introduction means, or also the entire applicator can be integrally connected with the reservoir or the housing of the application device. Such an integrated connection is shown by way of example in FIG. 9, in which the introduction means 118, applicator 8*h* and reservoir 6*h* are manufactured consisting of plastic in one piece.

Figure 26:
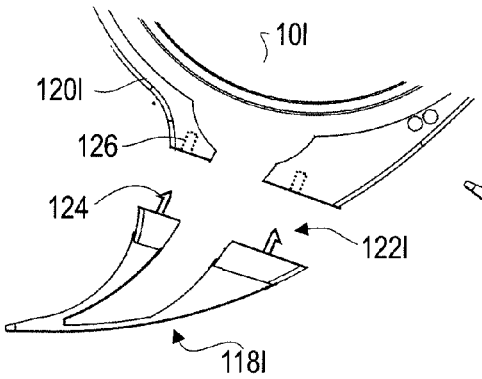
FIG. 26 shows a section of an application device with an insertable applicator.

A further possibility consists of connecting the introduction means or the applicator with a housing element that surrounds the reservoir volume. For this, the applicator or the introduction means can be manufactured separate from this housing part. A possible exemplary embodiment illustrating this is shown in FIG. 26. Introduction means 118*l* is manufactured completely separate from housing part 120*l*, which surrounds reservoir volume 10*l*. For connecting introduction means 118*l* and housing part 120*l*, connecting means are present by means of which introduction means 118*l* and housing part 120*l* can be connected with each other in such a way that no active agent is expelled at the connection point. In the exemplary embodiment shown in FIG. 26, connecting means 122 has catch means 124 that respectively engage with a recess 126 of housing part 120*l*, and engage there thereby firmly connecting introduction means 118*l* with housing part 120*l*.

Figure 27:
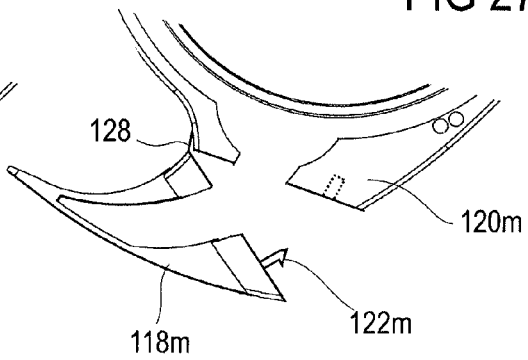
FIG. 27 shows a section of an application device with an applicator that can be opened.

A further embodiment provides that the applicator is connected with a housing part surrounding the reservoir volume via a movable element. A movable element can be a hinge, for example, an integral hinge. An exemplary embodiment of this design of the invention is shown in FIG. 27. An introduction means 118*m* is connected with the other housing part 120*m* via a movable element 128, in this exemplary embodiment, an integral hinge. In general, the movable element is to be understood in such a way that the introduction means, in the condition of being attached to the housing part, is displaceable relative to such, as shown by way of example in FIG. 27. By using catch means 122*m*, the two elements 118*m*, 120*m* can be connected with each other.

An advantageous refinement of the invention provides that the applicator has a comb with a number of teeth and a top side and a bottom side, whereby the bottom side forms a supporting surface for two-dimensional support on a fibrous substrate, in particular, a scalp.

Figure 28:
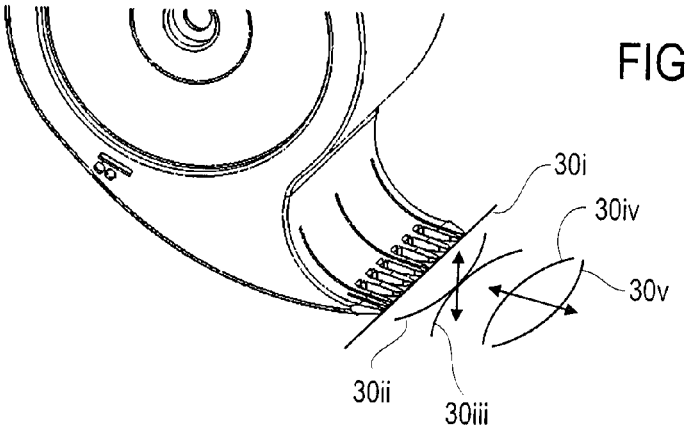
FIG. 28 shows various head lines of the tooth tips of an applicator.

Advantageously, the tooth tips of the comb form a straight line, which can also be described as head line. Alternatively, the tooth tips of the comb, or the head line, can form a curved line, that is, in particular, at least partially curved downward, in particular, concave. Additionally or alternatively, an at least partially concave curve towards the front is advantageous. These types of details are shown by way of example in FIG. 28. Alternative to straight head line 30*i*, a concave head line 30*ii* is possible with concave opening upward, or a head line 30*iii* with a concave opening downward, is possible. Likewise possible is a concave opening toward the front (head line 30*iv*) or with a forward convex arch (head line 30*v*). The direction of the arch is indicated in FIG. 28 by double arrows upward and downward or forward and backward. Of course, it is also possible to combine two or more of the curved variants and to provide several curves within head line 30.

Figure 30:
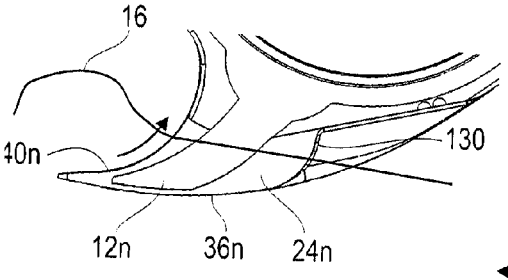
FIG. 30 shows an introduction process of hair into the applicator.
Figure 29:
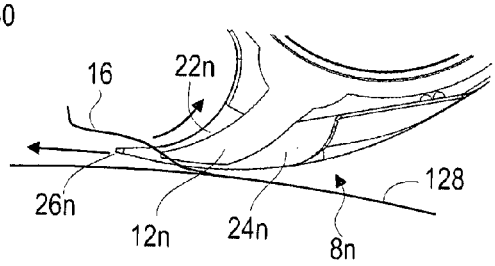
FIG. 29 shows a movement progression of an applicator over a fiber substrate.

With respect to the outer shape of the applicator it is advantageous, if the applicator's supporting surface or bottom side is curved convexly, in particular, in the direction of traction through the fiber or hair. It is further advantageous if the top side is curved concavely upward. Advantageously, the curve is respectively a curve in a view from the side. An advantageous embodiment concerning this is shown in FIGS. 29 and 30. The bottom side or supporting surface 36*n*, as well as the top side 40*n* are designed convexly or concavely curved.

The two curved surfaces are preferably located with respect to each other in such a way that a fiber located in the longitudinal direction of the teeth and pulled through the teeth is automatically drawn deeper into the teeth and the application volume due to the reduction of friction. The exemplary embodiment in FIG. 29 and FIG. 30 shows how hair 16 is picked up by comb-like tips of teeth 26*n* and guided in a gap 24*n* between teeth 22*n*.

In the situation shown in FIG. 29, hair 16 just reaches the front end of application volume 12*n*. As hair 16 is attached to scalp 128 only on one side, and the hair can otherwise be moved freely, hair 16 tends to fall downward out of gap 24*n* so that it is not or barely guided through application volume 12*n*. But the outer shape of applicator 8*n* has the effect that hair 16, as indicated by the curved arrow in FIG. 29, is pulled into gap 24*n* and thus into application volume 12*b*. This happens because hair 16, when it erects in applicator 8*n*, is guided through applicator 8*n* extending over a shorter length. Thus, the frictional forces of hair 16 in the applicator decrease the more erect hair 16 passes through applicator 8*n*. Because of the consequence of the physical principle that fiber or hair seeks the path of least resistance through applicator 8*n*, hair 16 erects and is thus drawn another piece further into applicator 8*n* or application volume 12*n*.

This process takes place even though applicator 8*n* is moved forward and thereby hair 16 appears to be moved backward relative to applicator 8*n* upon first blush. As hair 16 can be moved freely in front, the hair would simply follow the applicator movement and would, without the effect described above, not penetrate deeper into gap 24*n*. Only the two curves of the top side and the bottom side lead to the described effect, in particular, in connection with the angle of the comb, which is described in the following.

In order to pull the hair into the applicator as far as possible, it is advantageous, if the gap between two teeth shortens in length with increasing penetration depth of the hair. This is shown by way of example in FIG. 30. As the result of a return element 130 of the lower end of the gap, for example, relative to supporting surface 36*n*, the depth of gap 24*n* becomes shorter with increasing penetration depth of hair 16.

Figure 31:
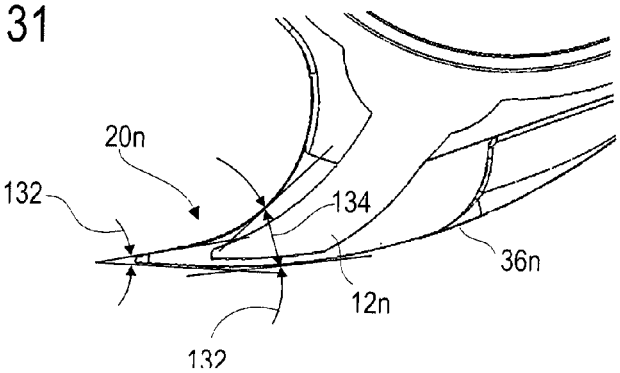
FIG. 31 shows angle information on an applicator.

Advantageously, the applicator forms a comb angle between the top side and the bottom side that increases continually toward the back by at least 15 mm, in particular, by at least 20 mm. FIG. 31 is useful for understanding the comb angle. Shown is the exemplary comb angle 132 at the anterior tip of comb 20*n* and comb angle 132 slightly more than 1 cm behind that. In the front, comb angle 132 is approximately 12°, whereby in general, an angle between 7° and 20°, especially between 10° and 15° is advantageous. It is also advantageous when the comb angle does not exceed 20° in the first 5 mm behind the tip of the comb. Further, it is advantageous if the comb angle does not exceed 45° in the first 10 mm behind the tip of the comb. As the result of the design of such a comb angle it can be achieved that hair automatically erects during its movement through the gap to such a degree that its falling out of the gap is largely countervailed.

Comb angle 132 continually increases toward the rear as is shown by way of example in FIG. 31. At the position shown in the rear, it is approximately 35° and continues to increase toward the rear. In the exemplary embodiment shown in FIG. 31, comb angle 132 increases steadily and does not decrease anywhere. But this is not absolutely required.

It is advantageous if the comb angle steadily increases, at least in the area of the gap. When defining the gap angle it matters whether the straight lines describing the gap angle are applied to the top side or bottom side of the applicator. The contact points can define themselves by the smallest distance between the contact points relative to each other. This is shown in FIG. 31 by double arrow 134. If, for example, an upper contact point is specified—the point in FIG. 31 that is at the upper end of double arrow 134—that point on the supporting surface is sought that has the smallest distance to the upper contact point. The second imaginary straight line is placed on this lower point, so that now the comb angle results.

Further, it is advantageous if the comb angle at the applicator reaches at least 60°, in particular, in the area of the application volume. Hereby, a well-defined introduction length of hair into a gap can be specified, because when the comb angle is large, the hair tends to move in the direction toward a smaller comb angle.

Figure 32:
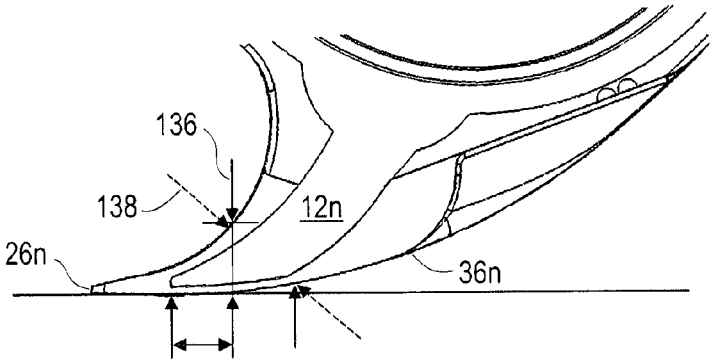
FIG. 32 shows lengths information on an applicator.

According to a further preferred variant of an embodiment of the invention, 5 mm behind the anterior tip of an application volume, the applicator has a height of a maximum of 8 mm perpendicular to the supporting surface, in particular, a maximum of 6 mm. Reference is made to FIG. 32 for an explanation of this detail of the invention. The position of the anterior tip of application volume 12*n* is marked by the lower and foremost arrow. The lower arrow points to a distance of 5 mm behind. In this exemplary embodiment, height 136, perpendicular to supporting surface 36*n*, is approximately 5.5 mm.

Further, it is advantageous if the applicator—10 mm behind the anterior tip of the application volume—has an applicator thickness of a maximum of 9 mm, in particular, a maximum of 7 mm. Concerning this, reference is also made to FIG. 32. Applicator thickness 138 also relates—just like it is explained in FIG. 31 by double arrow 134—to the smallest thickness of the applicator, based on a specified point on the lower supporting surface. In this detail of the invention, the specified point lies 10 mm behind the anterior tip of application volume 12*n*. This position is indicated by the lower arrow pointing upward at the furthest right. At this position, applicator thickness 138 is indicated by the two dotted arrows. In this exemplary embodiment, it is 7 mm.

With an applicator having dimensions in the ranges indicated, introducing hair into a gap can be achieved easily without the hair being pushed out downward.

Teeth

As described above, the applicator advantageously has a comb with teeth so it can be pulled through the fibrous material or the hair like a comb. Hereby, the teeth advantageously form a lower side or supporting surface of the applicator, at least partially. Advantageously, the teeth are made of plastic, as a result of which manufacturing can be achieved that is particularly easy and cost-effective. Particularly precise gap dimensions and, in particular, a very narrow gap can, on the other hand, be created better when the teeth are metallic teeth. These are preferably used in a rear part of the applicator, which is advantageously made primarily of plastic.

Figure 33:
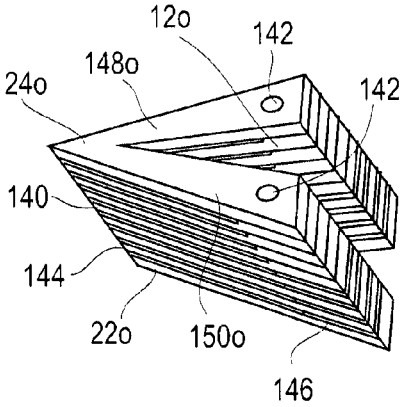
FIG. 33 through FIG. 35 shows various teeth for applicators.

An advantageous refinement of the invention proposes that the teeth are formed out of plates that form a stack of plates. This is shown in FIG. 33 by way of example. A number of plates 140 are stacked on top of each other into a plate stack and held together by connecting elements 142 that are only implied in FIG. 33, and are held together rivet-like, screw-like, or can be designed in another way.

In FIG. 33, two types of plates 140, 144 are shown. The different types are only shown for the sake of clarity, whereby a stack is usually formed by only one type of plate 140 or 144. The upper plates have a front notch by means of which a gap 24*o* is formed respectively. The lower plates do not have a notch, whereby gap 24*o* is established by a spacer element 146, which is located in the rear section between two plates 144. The width of gap 24*c* can be adjusted with the thickness of spacer elements 146. Each spacer element 146 respectively forms a tooth base of a gap 24*o*. Between them, the plates form application volume 12*o* by respectively forming a part of an upper wall 148*o* and a lower wall 150. Thus, application volume 12*o* is limited upward by upper wall 148*o*, and downward by lower wall 150*o*. Each tooth 240*o* forms a part of upper wall 148*o* and lower wall 150*o*.

If the teeth are formed by a stack of plates, these can be connected with each other by an integral hinge. In order to be able to make the wall thickness' of the injection mold thicker, the plates are expanded counter to each other in such a way that adjacent plates respectively release the side of the adjacent plate spatially for tool elements. After the injection molding process, the expanded plates are rotated counter to each other in such a way that a uniform stack is created as illustrated in FIG. 33. The integral hinge is preferably provided at tooth tip 26, and can be removed as soon as the stack is securely retained.

For production, the plate elements can be pulled apart like an accordion and then mounted while pushed together for installation.

A further embodiment of the production of a stack packet is possible by using a helical spiral, which is advantageously produced in an expanded form and then brought into tooth shape and mounted when pushed together.

Figure 34:
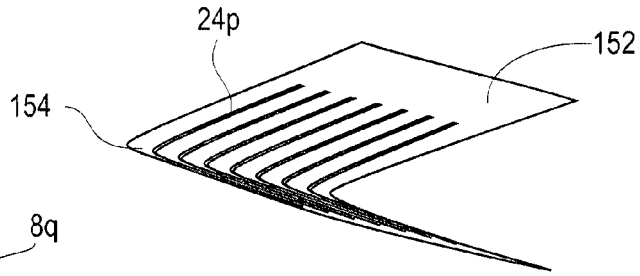

Alternatively, it is advantageous when the teeth are at least partially formed by bent sheet metal that has cuts at the bending edge. This is shown in detail by way of example in FIG. 34. A sheet metal element 152 is bent in such a way that an anterior bending edge is created. Sheet metal 152 is sawed from the anterior bending edge towards the rear so that gaps 24*p* are created. Advantageously, sheet metal 152 is connected with a rear part of the applicator, for example, glued on, snapped in, wedged in or the like. Sheet metal element 152 is shown very thin in FIG. 34, whereby a thickness of several millimeters can be assumed in reality. Hereby, it is advantageous when the sheet metal at the tooth base has a greater sheet metal thickness than at the turn-around edge, or bending edge. Hereby, an advantageous discharge behavior of the active agent out of the application volume into the gap can be achieved. Advantageously, the sheet metal is respectively thicker at the top as well as at the bottom at the tooth base than in the proximity of bending edge 154.

Figure 35:
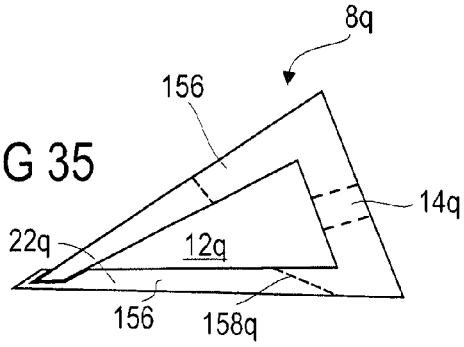

A further advantageous possibility of forming the teeth is, that the teeth are formed by two applicator legs that are connected with each other in the front and open toward the back. This is shown by way of example in FIG. 35. Two applicator legs 156 extend forward in tapered manner and are connected with each other at the front. Upper applicator leg 156 forms an upper wall and the lower leg a lower wall so that they form application volume 12*q* between them. A tooth base 158*q* of teeth 22*q* is indicated by two dotted lines in FIG. 35. Likewise indicated is an intermediate volume 14*q*, which forms a connection from application volume 12*q* to a reservoir volume that is not shown. The two applicator legs 156 can be designed in one or several pieces and advantageously, they are firmly connected in the rear. The connection in front is shown in FIG. 35 by way of example as an insertion, for example, of the upper applicator leg 156 into lower applicator leg 156. However, a different positive fit, and, in particular, a material connection, for example by gluing, is conceivable and advantageous. At least one part of the lower wall can be replaced by taut, parallel fibers.

Good combing and separation of the hair can be achieved with the applicator when the teeth—1 mm, in particular, 1.5 mm, further, in particular 2 mm behind their tooth tips—have a tooth height of less than 1 mm. Providing the same advantage, 0.5 mm behind their tooth tips, the teeth have an anterior cross section of less than 0.5 $mm^2$. These details are illustrated in FIGS. 31 and 32, in particular, in connection with FIG. 5.

Further, it is advantageous when the tooth tips of the teeth are rounded. For a comfortable and precise guidance of the application devices on a scalp it is beneficial when the teeth form a supporting surface with their lower side, which transitions in a smooth curve into a convex outer surface of the housing part, which surrounds the reservoir volume. This is shown by way of example in FIG. 10.

For easy handling of the application device, it is beneficial if the comb has a maximum comb width of 50 mm, in particular, a maximum of 40 mm. Advantageously, the width of the comb is hereby the width from the first to the last tip of the comb.

The description of the additional details of the invention is essentially supported by a few exemplary embodiments that are shown in overview in FIGS. 36 through 44. These three exemplary embodiments were selected from many different application devices in order to keep the number of exemplary embodiments reasonable, and the descriptions understandable. However, the invention is, of course, not limited to these exemplary embodiments, nor is it restricted to the exemplary embodiments cited above. The details that are described are not mandatorily assigned only to the exemplary embodiment relative to which they are described. In particular, the details of the invention described without reference numbers are generalized, and are to be viewed as interchangeable in any way.

Figure 36:
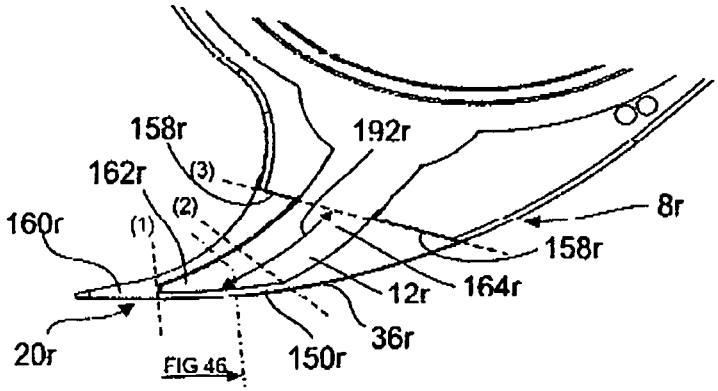
FIG. 36 through FIG. 38 shows the organization of areas in three different applicators.
Figure 37:
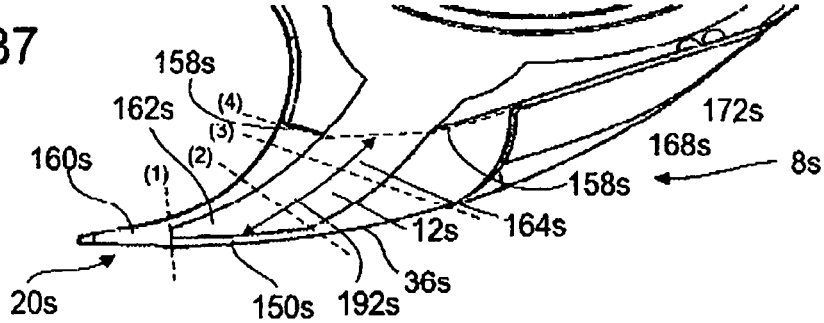
Figure 38:
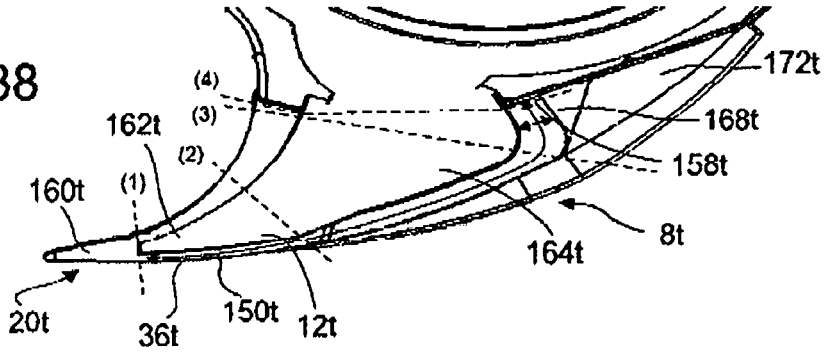
Figure 43:
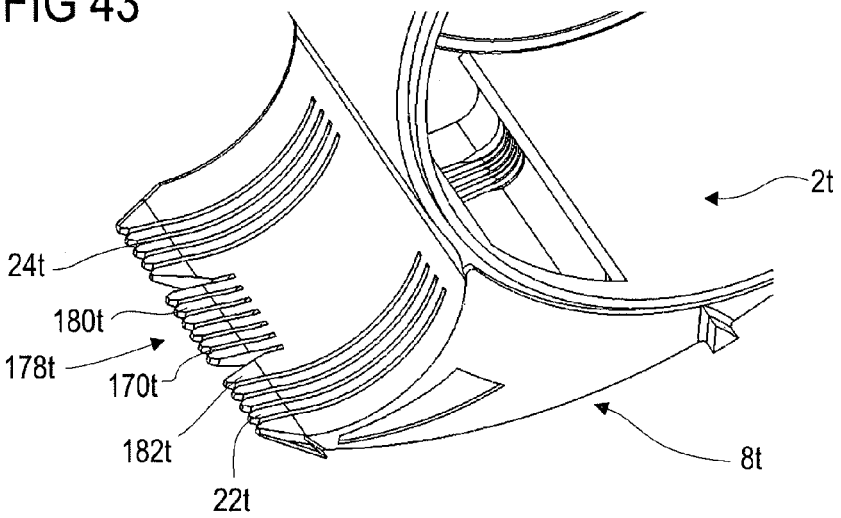
FIG. 43 shows a perspective view of an additional applicator.

FIGS. 36 through 38 respectively show a lateral cross sectional illustration of applicator 8*r*, 8*s*, 8*t*, so that application volume 12*r*, 12*s*, 12*t* becomes visible within comb 20*r*, 20*s*, 20*t*. Applicator 8 and thereby application volume 12 can hereby be imagined as divided into different areas. All three exemplary embodiments have a tip area 160 in common, which is designed free of any application volume. This tip area 160 thus extends from the anterior tip of the application volume forward and is identified in FIGS. 36 through 38 by the area in front of the dotted line (1).

Starting at the anterior tip of application volume 12, a forward application area 162 extends backward and is followed towards the rear by a main application area 164. A border between forward application area 162 and main application area 164 of applicators 8 is shown in FIGS. 36 through 38 by the dotted line (2). In the forward application area, the top side of the lower wall extends parallel to supporting surface 36. The borderline between forward application area 162 and main application area 164 can be drawn through that point at which the top side moves away from the lower side of the lower wall, for example, in a bend in the top side of lower wall 150. From this point, the borderline can extend to top side 40, whereby the direction is identified by the shortest connection to the top side, as described, for example, relative to FIG. 31. In the exemplary embodiment shown in FIG. 38, the border is specified by a different continuity in the top side of the lower wall, in this case a convex bend.

In the illustrated, advantageous exemplary embodiment, the application volume bends upward toward a forward bottom side that is aligned parallel to the support—the lower side of the application volume is the top side of the lower wall. The inner surface of the lower wall thus first extends parallel to the supporting surface and then bends upward.

Forward application area 162 and main application area 164 form the application area of applicator 8. The posterior end of the application area is determined by tooth base 158, which is also the gap base. Gap base and tooth base 158 are thus parallel in lateral direction.

In FIGS. 36 and 37, a rear application area 166 follows main application area 164 toward the rear. It is identified thereby, that its rear gap outlet 168 lies in a recess of supporting surface 36. Gap outlet 168 thus moves backward, away from supporting surface 36 into the interior of applicator 8. Even rear application area 166 is a part of the overall application area.

Applicator 8*r* that is shown in cross section in FIG. 36 is shown in FIGS. 39 and 40 in a perspective view. FIG. 39 shows applicator 8*r* from the front and transversely from the bottom and FIG. 39 shows a view into outer housing part 52*r* from the inside into applicator 8*r*, or its application volume 12*r*. It can be seen that gaps 24*r* extend in parallel and in one plane perpendicular to supporting surface 36. All gaps are equidistant and have the same width. The tooth tips are rounded at the front, so that they form a funnel-shaped gap entry. This embodiment is especially suited for coloring hair roots, and can therefore also be called hair root coloring device.

The second exemplary embodiment with applicator 8*s* is shown in FIGS. 41 and 42 in a perspective view. While the view in FIG. 41 is analogous to the view in FIG. 40, FIG. 42 shows applicator 8*s* transversely from the bottom, i.e. at an incline to supporting surface 36. Applicator 8*s* is different from applicator 8*r*, because it has bypass gaps 170*s* between individual gaps 24*s* that do not reach up to application volume 12*s*.

Bypass gaps 170*s* are for the purpose of combing the hair. As hair routinely crisscrosses and is somewhat disheveled, the hair directly in front of gaps 24*s* is also slightly entangled with the hair in front of bypass gaps 170*s*. Without bypass gap 170*s*, the hair would now be pressed downward under applicator 8*s*, so that this hair, and also the entangled hair that lies in front of gap 24*s*, pushes downward. Hereby, introducing this hair into gap 24*s* is made more difficult.

However, because of bypass gap 170*s*, the hair is combed and also goes through the applicator from the bottom toward the top. In this way, even the hair before gaps 24*s* is held upward, so that it can enter gap 24*s* easier and thus be guided through application volume 12*s*. One embodiment with at least one bypass is especially suitable for marbling hair, as always only relatively little of the combed hair is introduced into application volume 12*s* and brought in contact there with active agent, in this case, hair coloring agent.

A further feature of this embodiment of the invention lies in the rear application area 166*s*, or in cut-outs 172*s* in supporting surface 36*s*, in which gap outlet 168*s* ends. These cut-outs 172*s* or the introduction of gap outlet 168*s* into the interior of applicator 8*s* has the consequence that the gap depth does not increase as the gap length increases or at a maximum at a ratio of a maximum of 1 mm of increasing gap depth per 3 mm of increasing gap length. This can be seen in FIG. 37. The gap depth along the dotted line (3) increases only slightly in the direction toward tooth base 158*s*, and in the proximity of tooth base 158*s* only because the transition length through application volume 12*s* becomes steeper and thus longer. This design of applicator 8 has the advantage that the hair in gap 24*s* slides slightly backward in the direction toward gap base 158*s* and thus remains firmly in gap 24*s*. In this way, individual hairs or very small bundles containing only a little hair can be reliably and evenly colored over large length, as it is advantageous for marbling.

The third exemplary embodiment that is shown in FIGS. 38 and 42 through 44 is especially well-suited for coloring small strands. Similar to the marbling coloring device 2*s*, the strand coloring device 2*t* has bypass gaps 170*t*, which are located between coloring gaps 24*t*. Here as well, not all of the combed hair is colored, but only smaller sections, in this case, small strands. The coloring gaps 24*t* are grouped into groups of respectively several gaps 24*t*—in this exemplary embodiment, these are respectively four gaps 24*t*—between which a group of bypass gaps 170*t* is located. Generally, bypass gaps 170 do not reach into application volume 12. Hair combed by bypass gaps 170 are therefore not brought in contact with active agent.

A further feature of applicator 8*t* is the rear application area 166*t*, or the gap outlets 168*t* that immerse in applicator 8*t*. Advantageously, several, in particular, all coloring gaps 24*t* of a group of little strands lead into cut-outs 172*t*, so that the hair in these gaps 24*t* can be combined in cut-out 172*t*. Guide surfaces 174 that project outward out of supporting surface 36*t* advantageously bundle several, preferably all hair exiting a gap group into a single strand, by working together with the outer surfaces of the cut-out. Because the coloring of strands usually consists of bleaching or lightening, in which the active agent must act upon the hair for a period of time, the formation of the strand of hair consisting of several gaps 24*t* has the effect that the hair that is moistened by active agent is pressed together and forms a single strand. This strand is surrounded by active agent and penetrated, so that an unintended stripping off of the active agent is countervailed. The active agent remains on the hair for a long period of time and can act for a long time.

Figure 44:
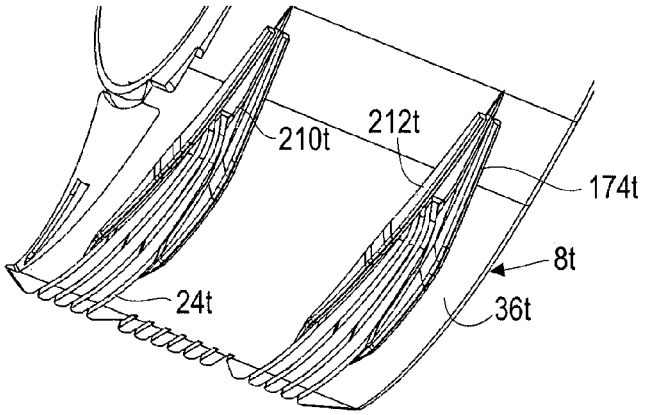
FIG. 44 shows a view of the applicator transversely from below.

Guide surfaces 174 are shown from the side in FIG. 44, so that their radially outward projection from the supporting surface or downward, is easily visible.

Especially preferred, a width of the hair outlet opening or the hair outlet gap as measured parallel to the head line, is smaller than 3 mm, whereby a width smaller than 2 mm is advantageous. It is also conceivable that the hair outlet opening or the hair outlet gap are designed as a V-shaped deepening, whereby the angle of the surfaces to each other is smaller than 90°, whereby an angle that is smaller than 60° is particularly advantageous. Other shapes and dimensions that shape at least some of the captured hair of a separation unit into a strand that is smaller in its cross sectional surface than a circle having a diameter of 3 mm, are also conceivable.

Embodiments having several separation units are also conceivable in which different application means are made available, for example, with different colors. Thereby, the various application means are made available in separate reservoir volumes and application volumes.

The hair outlet opening refers to the area starting at which, when the hair is taut, lateral guidance through lateral surfaces of cut-out 172 and/or guide surfaces 174 is not operative.

Figure 72:
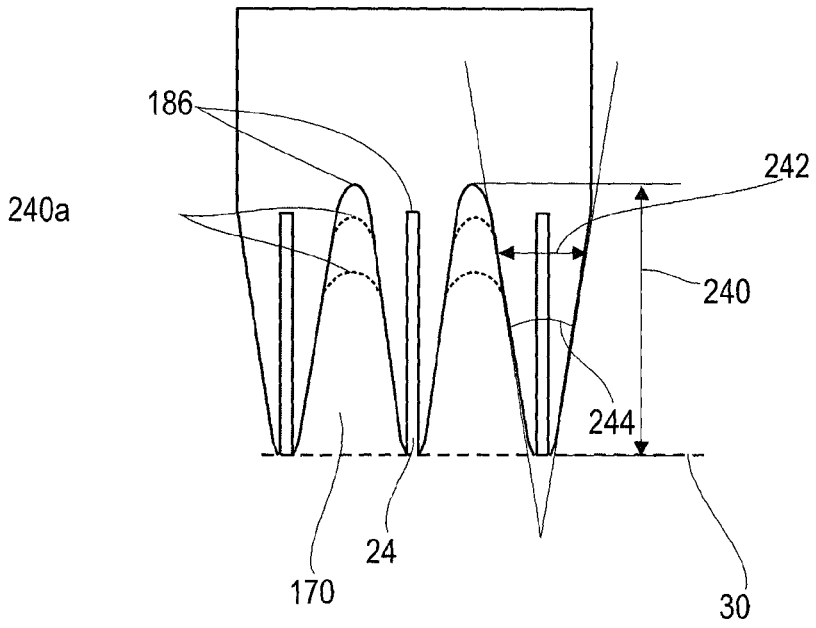
FIG. 72 and FIG. 73 shows various bypass variants.

In order to achieve good moistening of the hair and simultaneously good guidance of the hair that is not to be moistened, at least one bypass gap of a bypass can be designed especially long. One example of this is illustrated in FIG. 72. Suitable lengths 240 of a bypass gap 170 are in the range of 0.15 times up to 1.2 times the maximum gap length of an application gap 24, particularly suitable is the range between the 0.3 times and 1.2 times, in particular, between 0.5 times and 1.12 times. The length of an application gap 24 relates to the distance from the head line 30 to the upper gap base 186. Bypass depth 24*o* that is being addressed relates to the distance between head line 30 and the rear end of a bypass gap.

In order to achieve an advantageous in-feed and pull-through behavior in or through the hair, one or several of the bypass gaps 170 can be configured with a greater depth and a larger gap width than an application gap 24. Thereby, it is achieved that the hair that is not to be colored is introduced evenly into the applicator, just like hair introduced into application gap 24.

In the case of a long bypass gap length, in particular, if it is longer than the length of an adjacent application gap, the forward application volume will no longer be laterally continuous, as the bypass gaps are not intended to reach the application volume. For this reason, the application volume can therefore have forward pockets toward an application gap or a group of application gaps. When the application device is used, these pockets are intended to be filled reliably. The dimensions influencing the filling are, in particular, bevel angle 194 of the application volume and the channel width 242 (FIGS. 72 and 73) of the pockets or the application volume. The entire channel width of the entire application volume is divided by a deep incisive bypass. Via the channel width, the size of the pockets of the application volume and the required fill pressure can be controlled. The wider the channel, the larger is the application volume and the smaller the required fill pressure.

Figure 73:
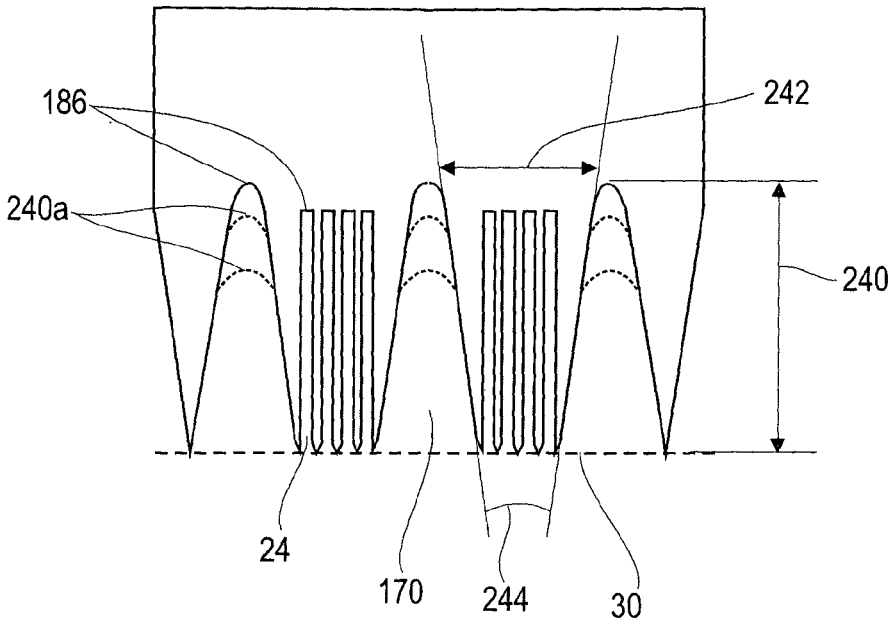

In FIGS. 72 and 73, the channel width that is defined by channel width angle 244 of outer teeth 22 of the bypass is shown. A suitable angle 244 ranges between 5° and 45°, well suited is an angle between 10° and 45°, and particularly well suited is an angle between 15° and 45°. Angles between 10° and 35° have also shown to be well suited.

The application volume in the area of the tooth cavity volume is thereby designed in such a way that the pockets make an inflow of active agent into the pockets possible at low feed pressure, as well as prevent a back-flow of active agent upon rotation of the applicator in an overhead position, at least in the forward 6 mm, better 8 mm, best 12 mm of the application volume.

Applicator variants 8 shown in FIGS. 72 and 73 include precisely one bypass gap 170 between precisely one or several application gaps 24. Embodiment variants with several bypass teeth such as, for example, illustrated in FIG. 41 and FIG. 42 are likewise conceivable. The bypass teeth can extend beyond the head line or be shorter.

Advantageously, the applicator includes a number of hollow teeth arranged comb-like with gaps in between. These teeth form an upper wall, a lower wall and a tooth cavity volume between upper wall and lower wall. The tooth cavity volumes are a part of the application volume. The application volume includes the tooth cavity volume of the teeth and, in particular, at least a part of the volume of the gap between teeth. In particular, the application volume consists of the tooth cavity volume of the teeth and the volume of the gaps between the teeth.

Figure 46:
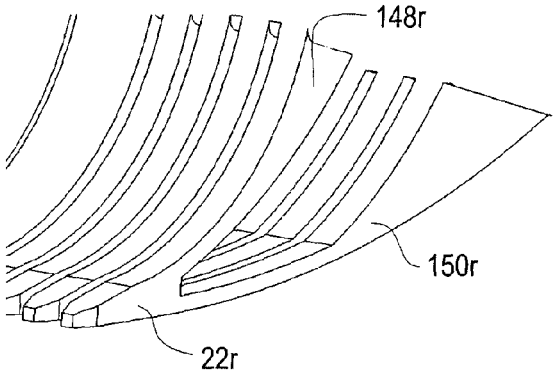
FIG. 46 shows a schematic illustration of an application volume.

This is shown in FIG. 46 by way of example, which shows a perspective view of a number of teeth 22*r*. Between upper wall 148*r* and lower wall 150*r*, the teeth have a cavity that has the width of tooth 22*r* and is described as tooth cavity volume. This tooth cavity volume is a part of application volume 12*r*.

Further, it is advantageous if the wall thickness of the upper wall is at least 1.1 times as thick as the wall thickness of the lower wall, in particular, 1.3 times as thick, respectively measured at the same distances from the anterior tip of the application volume. This is shown by way of example in FIG. 47, which shows a cross section through applicator 8*r* along the dotted line of FIG. 36. Corresponding to the dotted line, the distance of the cross section through upper wall 148*r* and lower wall 150*r* is equidistant from the anterior tip of application volume 12*r* respectively. Wall thickness 176 of upper wall 148*r* is 1.2 mm at this position. The wall thickness is measured in the direction of the depth of gap 24*r*. At this position, the corresponding wall thickness of lower wall 150*r* is 0.8 mm, so that the wall thickness of upper wall 148*r* is 1.5 times as thick as the wall thickness of lower wall 150*r*.

This embodiment has the advantage that the applicator is sealed significantly better against any discharge of active agent through the gap upward than downward, so that active agent escapes more easily toward the bottom. This has the advantage that the active agent can be carried along easier by the hair exiting downward or towards the rear. This embodiment is particularly advantageous with an equal gap width on the top and bottom or front and rear, as shown in FIG. 46. The steps to be taken that lead to the same goal when the gap is wider toward the bottom or rear than toward the top or front will be discussed later. The thickness of the upper wall or lower wall refers to an effective thickness of the wall. In the case of gaps opening through the thickness of the wall, the thickness of the wall can be measured from that plane at which the gaps are at their narrowest up to that plane, at which the gap width is 1.5 times the size of this narrow point.

Further, it is advantageous if the ratio of wall depth divided by the narrowest gap width of the upper wall is at least 1.1 times, in particular, at least 1.5 times the value of the lower wall. In the exemplary embodiment in FIG. 46, the ratio of wall depth divided by the narrowest gap width of the upper wall of 1.2 mm, divided by 0.6 mm gap width=2. In the case of the lower wall, on the other hand, the ratio is 0.8 mm wall depth divided by 0.6 mm gap width=1.33. The ratio of the upper wall is thus 1.5 times as large as the ratio of the lower wall. Advantageously, the effective wall thicknesses are used in this calculation as well.

In a further embodiment it is proposed that the lower wall gap between the teeth opens funnel-shaped toward the application volume. Hereby, an undesired stripping off of active agent can be countervailed by the hair that is exiting the application volume through the gap in the lower wall.

Figure 48:
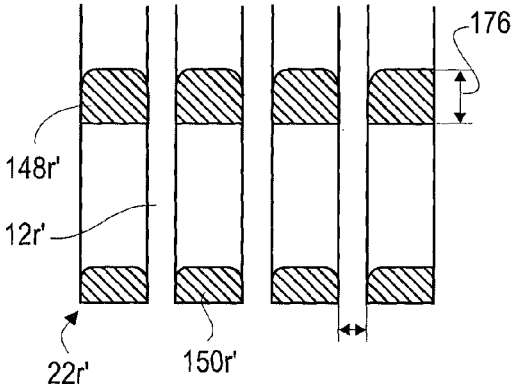

Further, it is advantageous if the tooth edge of the lower wall facing the application volume is convexly rounded in lateral direction toward the application volume. Hereby, a curve radius of at least 0.3 mm, in particular, at least 0.5 mm, is especially advantageous. An embodiment of these details is shown in FIG. 48. The lower wall 150*r'* of each tooth 22*r'* is rounded on both sides toward the application volume, and also upper wall 148*r'* is rounded on both sides toward the top, i.e. outward. The rounding radius is 0.5 mm. As a result, the lower wall gaps between teeth 22*r'* open funnel-shaped toward application volume 12*r'*.

As shown in FIG. 46, it is also generally advantageous if the upper wall gaps between the teeth open funnel-shaped upward, in particular, with a rounding as described above. Hereby, introducing hair into the gap from above is made easier. Advantageously, the funnel width is at least 10% of the gap width on both sides, in particular, at least 20%. In FIG. 48, it is approximately 40%.

Bypass

In a further advantageous embodiment variant of the invention it is provided that teeth directly adjacent to a gap have gap tooth tips, teeth located in a bypass have bypass tooth tips and/or respectively, teeth between a gap and a bypass, have transition tips. This can be explained by way of example with the help of FIGS. 41 and 43. Both embodiment variants have one or two bypasses 178 respectively, which are equipped with bypass teeth 180 and bypass gaps 170 respectively. Between color gaps 24 and bypass 178, transition teeth 178 are located respectively, which are designed differently than bypass teeth 180 and gap teeth 22, whereby the embodiment variant in FIG. 41 has no gap teeth 22 that are located between gaps 24. As a result of the different design of the various teeth 22, 180, 182, the hair can be guided advantageously corresponding to the desired application, for example, it can be introduced into a coloring gap 22 or in a bypass gap 170.

Advantageously, the bypass tooth tips have a length equal to that of the gap tooth tips and the transition tooth tips. Hereby, a linear head line can be achieved, which is advantageous for combing and easy handling of the application device.

Further, it is advantageous if the bypass tooth tips are wider, i.e. the gap tooth tips and/or the transition tooth tips. This is shown in FIG. 41 and facilitates combing of curly hair. Moreover, it is advantageous if several bypass teeth are located in one bypass. Hereby, the bypass can be designed wide and the hair can be thoroughly combed, so that it can be countervailed that hair slides out of the coloring gaps because some hair sticks together.

A good coloring result for marbling can be achieved if a bypass is always located between two coloring gaps. Thus, the coloring gaps are arranged individually. Hereby, an especially even marbling result can be achieved as each time the applicator is pulled through the hair, only a relatively small amount of hair is guided through the application volume and hereby colored.

In contrast to that, for coloring small strands, a particularly good result can be achieved if several directly adjacent coloring gaps form a gap group and a bypass is located between two such gap groups. Because in contrast to marbling, a strand as such is intended to be emphasized, hair must be colored in larger groups when coloring small strands, than in marbling. Therefore, providing coloring gap groups consisting of a number of coloring gaps is expedient, in particular, those that are located directly adjacent to each other. A bypass is located between two gap groups respectively, which leaves hair between the small strands uncolored, yet combed.

In particular, in the case of coloring small strands, it is advantageous if at least 0.6 gaps per millimeter, in particular, 0.8 gaps per millimeter are located in the gap group. Here, the millimeter specification relates to the width. To achieve a suitable moistening of the hair with an especially highly viscous, i.e. stiff application agent, in particular, for achieving a good effect when dyeing hair blond, the hair strand to be colored should be expanded. A relatively wide small strand gap is therefore less suitable than a group of narrow, connected small strand gaps. As a result of several individual gaps in a group and the expansion of hair into the individual gap, overall, significantly more contact surface of the hair relative to the application means is achieved than in the case of a single and thicker strand. Hereby, better coloring or a better effect of dyeing the hair blond is achieved.

Moreover, it is advantageous if the application width of a gap group is a maximum of 15 mm in order to achieve a fashionable appearance. Especially preferred, the application width is smaller than 10 mm, whereby an application width smaller than 6 mm is especially advantageous. The application device has at least one gap group, with which individual strands of the hair can be colored.

In application devices with several gap groups, the individual gap groups are separated by one bypass respectively. Thereby, it is achieved that several strands can be created simultaneously in one pass of the application. The sum of the widths of the bypasses can be smaller than the sum of the gap group, but is preferably larger, particularly preferred, the sum of the bypasses is at least twice as large.

Advantageously, one gap group is formed of at least three coloring gaps from which respectively adjacent coloring gaps are separated by at least 0.8 mm and at most 3.0 mm.

To better distinguish bypass gaps, the term coloring gap is generally used for a gap that extends up to the application volume which guides hair that is drawn through it through the application volume. The term coloring can mean any color-changing process of a fiber or hair.

Gaps

Advantageously, the introduction means has gaps between comb-like teeth that transition into the application volume.

Advantageously, several gaps form a gap group with outer and inner gaps, whereby the gap length above which hair is located in the gap upon being introduced into the gap to the maximum, is less in the outer gaps than in an inner gap.

To achieve good processing of the hair with the application device it is required that the active agent does not run unintentionally out of the application volume and through the gap to the outside. Thus, the applicator should be manufactured in such a way that the active agent is retained in the application volume without leaking out in an unintended way, and yet allow guidance of the hair from the outside through the gap and through the application volume for moistening with the active agent. Hereby, it is necessary that the gaps ensure perfect imperviousness of the application volume to the outside. Slow leakage, for example, downward when the application device rests on the table for a while, is acceptable. But it should be avoided that the active agent unintentionally drips out downward during an application treatment of the hair.

Such a relative imperviousness in which the active agent remains, for example, in the application volume for a predetermined time, and if necessary, remains in the gap volume and does not leak unintentionally out of the applicator, is described in the following as application tightness.

Various parameters influence the application tightness:

1. The viscosity and the surface tension of the active agent
2. The flow limit of the active agent
3. The width of the gap of the applicator that establishes a connection from the application volume to the outside
4. The depth of a gap or the gaps of the application volume towards the outside
5. The pressure the active agent exerts from the application volume into the gap
6. The surface consistency of the teeth in the area of the gap.

It is clear that the application tightness depends on the design, in particular, the configuration of the applicator, as well as on the properties of the active agent. To that extent, it is advantageous if the configuration of the applicator is adapted to the active agent used. Stated the other way around, when using several active agents, advantageously, different applicators are used, or an applicator with several separately mounted application volumes and different applicator features.

Corresponding to the different physical properties of the active agent and the different configurations of applicators, different definitions of application tightness can be used. A particularly simple possibility consists of assuming the application tightness only then, when the active agent does not leak out of a filled application volume through the gap, even for a longer period of time, for example, 1 hour. But this requires a flow limit, i.e. that the active agent has the property of flowing only then, when a certain minimum shearing stress is present to trigger a flow. Below this minimum shearing stress there is no flow, so that the active agent in the application volume continues to remain in the gaps and does not leak through them.

If there is no flow limit or only a low flow limit, the active agent can leak out of the application volume after a certain amount of time and leak downward through the gap. The active agent will therefore flow through the gap, collect underneath the gap at the supporting surface and ultimately drip down. A sufficient application tightness that is adequate for the purpose of treating hair would also be given, if the active agent has leaked out of the completely filled application volume on least at one position of a gap only after a predetermined amount of time, and has reached the lower side, i.e. the supporting surface. A reasonable predetermined time is 20 seconds, in particular, 30 seconds, particularly advantageous is 1 minute.

A somewhat weaker definition of application tightness is to be seen analogous to the previous definition, whereby the active agent may penetrate the gap faster, however, it may not drip out downward from a freely swinging applicator within the predetermined time. The active agent thus collects prior to the elapse of the predetermined time already on the supporting surface, i.e. it thus has leaked earlier through at least one gap and forms a drop there over the course of time.

Instead of the parameter of the application volume that is filled with active agent, it can be assumed that pressure is exerted on the gap by the active agent, for example, an active agent column of 5 cm, in particular, 10 cm. With respect to the customary use of an application device, the following the definition is reasonable, which assumes an application volume that is filled with an active agent and an additionally predetermined pressure in a transition volume into the application volume. A reasonable pressure of 5 mbar, in particular, 10 mbar and in a case of a special load, 20 mbar can be estimated.

This definition takes the configuration of the application volume into consideration and, in particular, also the circumstance that the active agent, in its path from the rear to the front of the application volume, causes frictional resistance, which countervails the compressive forces. The larger these frictional forces, i.e. the narrower the forward application volume, the larger can be the pressure from the rear in order to still continue to ensure application tightness.

In the definition of application tightness, a differentiation should be made between the application tightness in idle condition and the application tightness when in use, i.e. during the application of active agent to hair. In the following, the basis of application tightness always refers to the tightness in idle condition, unless otherwise cited or specified.

Which of the cited definitions of application tightness is ultimately used essentially depends on the intended use of the application device. If application tightness is mentioned in the following, all of the aforementioned definitions can be used, or a reasonable definition can be selected that is advantageously the best for the planned application of the application device and, in particular, is adapted to the active agent.

For achieving a good moistening of the hair with active agent, it is advantageous if the volume of the application volume is relatively large, so that the active agent does not become scarce upon the hair being continually drawn through the application volume. Moreover, it should be relatively easy to fill the application volume with active agent, so that it does not unintentionally run on empty. All of this can easily be achieved when at least the largest part of the application volume is formed by the hollow tooth volume. The application volume can thus form a continuous cavity that is easily fillable and has an adequate volume. In particular, the gaps have an upper wall and a lower wall between which at least the largest part of the application volume is located.

Further, it is advantageous for achieving an application tightness if the gaps, in particular, in an area in a lower wall, have a gap width of at least between 0.05 mm and 0.3 mm and preferably between 0.05 and 0.2 mm, and especially preferred between 0.05 and 0.15 mm, in particular, connected with a gap depth of at least between 0.05 mm and 4.0 mm. These dimensions are especially advantageous for the use of an active agent that is stored in the reservoir volume and fed into the application volume having a viscosity between 0.4 to 4.0 Pa*s.

Providing the same advantage, the gaps, in particular, in an area in a lower wall, have a gap width of at least between 0.05 mm and 1.5 mm, preferably between 0.1 and 1.0 mm, and especially preferred, between 0.1 and 0.7 mm, in particular, connected with a gap depth between at least 0.05 mm and 4.0 mm. These dimensions are especially advantageous for the use of an active agent that is stored in the reservoir volume and fed into the application volume having a viscosity between 40 to 100 Pa*s.

Especially when using an active agent having a viscosity between 4 and 40 Pa*s, it is advantageous if the gap, in particular, in an area of a lower wall, has a gap width of at least between 0.05 mm and 1.0 mm, preferably between 0.1 mm and 0.7 mm, and especially preferred between 0.1 and 0.4 mm, in particular, connected with a gap depth of at least between 0.05 mm and 4.0 mm.

Figure 47:
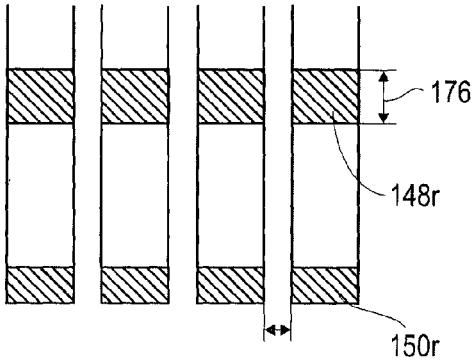
FIG. 47 and FIG. 48 shows schematic cross sections from the front through the teeth of an applicator.

The dimensions cited above are not explicitly shown in the Figures. FIGS. 47 and 48 can, however, be easily imagined in modification, so that they correspond to the dimensions.

As shown by way of example in FIGS. 36 to 38, applicator 8, and with it application volume 12 can be divided into a forward application area 162, a main application area 164 and, if necessary, a rear application area 166. Correspondingly, the lower wall can be divided into a forward part of the lower wall and a rear part of the lower wall, whereby the rear part includes the main application area 164 and perhaps also the rear application area 166. The same definitions can also be applied to a forward and a rear part of the upper wall.

Advantageously, the forward part of the lower wall measures at least 30% of the length of the application volume.

To achieve a moistening of the hair with active agent in the lowermost area already, i.e. very close to the hair root, it is advantageous if the depth of the lower wall, at least in a section of its forward area, is 0.5 mm to 1.5 mm. The application volume is hereby brought very close to the supporting surface, so that the active agent—upon abutting on the supporting surface of the scalp—can be brought very close to the root of the hair. Advantageously, the lower wall in the forward part has a uniform thickness. This significantly facilitates bringing active agent close to the root of the hair in a reliable way. In particular, the thickness is between 0.35 mm and 0.95 mm and further, especially between 0.6 mm and 0.8 mm. The uniform thickness of the lower wall advantageously extends uniformly over the entire forward area. But the gap depth of the lower wall can also extend continuously unchanged or discontinuous.

Applying active agent close to the root of the hair is additionally improved by elastic teeth 22 that can adapt to the fibrous substrate. In this context, those teeth 22 are elastic, which upon an exertion of pressure by applicator 8 of 0.5 kg downward and perpendicular to the linear head line, abut on an imagined, stiff sphere the size of a soccer ball, to the convex rounding of the sphere, so that all teeth abut at the sphere.

Further, it is advantageous if the lower wall in the forward area has a length of at least 5 mm and advantageously a maximum of 12 mm of a uniform thickness. In particular, the thickness of the lower wall following the forward area continually rises to a maximum thickness of between 3 mm and 10 mm. As a result, a high degree of application tightness can be achieved in combination with coloring near the roots.

Advantageously, the depth of the lower wall increases in its rear area to at least 4 mm, in particular, to at least 5 mm, further, in particular, to at least 6 mm. Hereby, it is especially advantageous, if the rear area grows to at least 4 mm and the depth of the forward part is between 0.05 mm and 0.5 mm, in particular, the depth. in the rear area grows to at least 5 mm when the depth of the lower wall in the forward area is between 0.2 mm and 0.7 mm, and further, in particular, in the rear part to at least 6.0 mm when the depth of the forward part is between 0.5 mm and 0.8 mm.

An especially good moistening of hair with active agent can be achieved if the teeth have a rear application area, in which the gap outlet extends into a recess of the supporting surface. Advantageously, the rear gap outlet extends at an angle of at least 30°, in particular, at least 60° and further, in particular, at least 80° relative to the respectively closest area of the supporting surface upward or into the recess of the supporting surface.

Good moistening is achieved when hair 16 can penetrate deeper into the application volume in the area of the gap outlet because of a recess in the supporting surface.

Advantageously, the gap depth decreases in the rear application area with increasing distance to the tip of the comb, or to the forward end of the application volume. Hereby, any penetration friction of hair in the rear gap area can be reduced, so that the hair can preferably be immersed in this area and kept there in a stable way. It can thus be countervailed that the hair slides out and a good coloring result can be achieved. The same advantage results if the gap depth decreases upon an increasing distance of the gap outlet from the supporting surface.

It is advantageous especially when using a turbo setting, if the lower wall of the gap, as seen from the front to the back, first extends over a distance of at least 15 mm with an essentially constant gap depth. In a rear area, the lower wall can then extend upward, i.e. away from the supporting surface, in particular, with its lower gap outlet at least 5 mm, in particular, at least 8 mm, upward, in particular, at an angle of its top side and/or lower side between 65° and 90° to the supporting surface. This is shown by way of example in FIG. 38, where the lower wall in the rear application area bends away upward with its top side and its lower side and extends at an angle of approximately 90° to supporting surface 36*t*.

Advantageously, the gap depth is also substantially constant in the part of the lower wall that is bent. This is also shown by way of example in FIG. 38.

The dimensions of the gap width cited above are especially advantageous in connection with an active agent that is stored in the reservoir volume and is flowing into the application volume having a viscosity between 0.4 Pa*s and 120 Pa*s, in particular, between 0.4 Pa*s and 60 Pa*s.

Especially in the case of active agents with low viscosity, primarily for those that have no flow limit, it can be difficult to establish a satisfactory application tightness. In order to achieve such in spite of that it is advantageous if the teeth have a base material and a coating facing the gaps. Advantageously, this coating is designed in such a way that it inhibits the penetration of active agent through the gap more than the base material. In particular, the coating material is more hydrophobic than the base material. To that extent, the coating can be a material that reduces surface moistening by active agent when compared with that of the base material.

Such coatings can also be used in the area of the application volume to improve sliding or adhesion of the active agent, depending on the type of coating.

Likewise, a coating having fibers inhibits penetration of the active agent. The coating can have irregular fibers that project out of the coating, or fibers that project out of the coating in an orderly manner.

A further possibility of inhibiting penetration of the active agent through the gap consists of covering the gap with closing fibers toward the bottom. The closing fibers can be anchored in the base material or in the coating. They can form a curtain that is directed transverse to the flow direction of the active agent from the application volume through the gap into the environment. Advantageously, the closing fibers are located in the upper half of the lower wall, i.e. further toward the application volume, i.e. toward the supporting surface or the lower opening of the gap. A high degree of tightness of the gap can further be achieved if the closing fibers are gathered at both ends and are, in particular, tautened. To that extent, they can reach transversely over the gap and be anchored in teeth defining the gap. The closing fibers can lie parallel to each other or form a lattice.

Active Agent in the Application Device

The invention further addresses an application device as described above, in the housing of which an active agent is stored, in particular, in the reservoir volume.

Advantageously, the active agent and the design of the applicator are coordinated with each other in such a way that the application device is application-tight.

Further, advantageously the active agent and the gap dimensions are coordinated with each other in such a way that the active agent automatically runs into the gap when the application volume is completely full, but active agent does not drip out of the gaps downward even after a period of at least one minute after the application volume has been filled.

Especially advantageous for this, the gap depths are dimensioned just like described above, and the barrier feature of the applicator is dimensioned by adjusting the gap width in such a way that the desired application tightness is achieved, for example, active agent runs into the gap, but does not drip out downward. Hereby it is most likely to be assumed for most active agents that the suitable section of the gap width is a very small section, as the active agent does not enter into the gap if the gap is too small and in the case of a gap that is too large, it leaks downward and drips out of the gap. The range between a gap that is too thin and too thick can—depending on the active agent—be between 0.05 mm and 0.2 mm. The higher the viscosity of the active agent, the larger is the suitable area.

While the adjustment of the suitable gap width for achieving the desired application tightness in an idle condition of the application device is relatively easy, establishing application tightness during an application is clearly more complicated.

To achieve the application tightness, one or more of the geometric details of the applicator are to be used advantageously which—depending on the application—are especially effective for establishing the application tightness individually or in combination.

With respect to an effective moistening of the hair with active agent, it is advantageous if the active agent and the gap width of the gap are coordinated with each other in such a way that the active agent—in idle condition of the applicator—penetrates for a distance, e.g. a maximum of 1 mm deep into the gap, advantageously within a predetermined time, for example, 20 seconds, further, in particular, at a predetermined pressure, e.g. a maximum of 10 cm of active agent column.

A further possibility of reaching the desired application tightness consists of reducing the ease of flow and/or viscosity of the active agent up to a suitable degree. With respect to the ability to penetrate through the gap, it is especially advantageous to add solid bodies to the active agent, whereby the following refers to elastically deformable materials, up to elastomers.

In an advantageous embodiment of the invention, the active agent contains small rod-like particles. The length of these is advantageously such that they can lie transversely across a gap and have a width, in particular, of such dimensions that they can pass through the gap. The penetration property of the active agent through the gap can hereby be significantly reduced, so that a desired application tightness can be established. In particular, the active agent can contain fibers.

When using the application device for moistening hair with active agent, it can often not be avoided that the application device is held in such a way that the opening of the application volume toward the reservoir volume or toward the intermediate volume points downward. The geometry of the application volume is hereby advantageously adjusted to the active agent in such a way that at least a predetermined portion remains in the application volume in each position of the application device. Advantageously, the predetermined portion is at least 25%, in particular, at least 50%. The application volume is to be viewed hereby as the hollow tooth cavity area of the teeth with all laterally adjacent gap volumes in the profile of the hollow tooth area.

By an adherence of the active agent to the inner wall of the application volume, it can be achieved that active agent remains in the application volume. For this, the adhesion behavior must be adapted to the weight of the active agent in such a way that the adhesion of the active agent holds for a duration of at least the predetermined portion in the application volume. A further possibility consists of providing a restriction between the reservoir volume and the application volume that prevents active agent from running out of the application volume in the predetermined way. Advantageously, the predetermined portion remains in the application volume for a predetermined period of time. Advantageously, the period of time is 10 seconds, in particular, 20 seconds.

In a further preferred embodiment of the invention it is provided that the teeth have an average width of between 0.3 mm and 3.0 mm, in particular, between 0.5 mm and 2.0 mm, further, in particular, between 0.6 mm and 1.5 mm, and further, in particular, between 0.9 mm and 1.2 mm. The more precisely the range of values is adapted in the direction of the latterly cited numbers, the better the result of an even coloring of hair. In order to achieve an even coloring, it is expedient that as large a proportion of the combed hair as possible can actually penetrate into the application volume. As the width of the application gap cannot be enlarged at will, the width of the gap and the width of the teeth should be coordinated with each other. When using conventional active agents, the average tooth widths cited above are advantageous for uniform, full coloring results.

In order to have an especially even coloring result, it is expedient if the average tooth width is adapted to the viscosity of the active agent. Hereby, the following ranges have shown to be particularly advantageous.

At a viscosity of between 0.4 Pa*s and 4 Pa*s, an average tooth width between 0.4 mm and 4.0 mm, preferably between 0.4 mm and 2.5 mm and especially preferred between 0.4 mm and 1.5 mm. At a viscosity between 4 Pa*s and 40 Pa*s, an average tooth width between 0.4 mm and 2.5 mm, preferably between 0.4 mm and 1.5 mm and especially preferred between 0.4 mm and 1.0 mm. At a viscosity of the active agent that is larger than 40 Pa*s it is an average tooth width between 0.4 mm and 2.0 mm, preferably between 0.4 mm and 1.5 mm and especially preferred between 0.4 mm and 1.0 mm.

A color volume is the maximum volume of active agent that can be applied by a single gap in one color pass to hair passing through it with a length of 10 cm. The volume is defined by multiplying the relevant gap width with the penetration surface through which the hair can pass in the individual gap. The relevant gap width can be the average gap with plus 0.2 mm. This is intended to take it into consideration that the active agent replenishes in a lateral flow. Suitable are color volumes between 4 $mm^3$ and 100 $mm^3$, well suited are color volumes between 15 $mm^3$ and 75 $mm^3$, and especially well suited are color volumes between 20 $mm^3$ and 50 $mm^3$.

Moreover, it is also advantageous for an even coloring result if at least the largest part of the gap, in particular, all gaps of the comb are located at an equal distance to each other and the gap distance is, in particular, between 0.3 mm and 3 mm.

In contrast to uniform full coloring, it is expedient when coloring small strands, when the gaps are positioned in gap groups that have at least one bypass zone between them that does not have a coloring gap. Hereby, a part of the combed hair is moistened with active agent and another part is guided through the bypass zone and not moistened.

The size of the gap groups depends on the desired coloring result. However, it has been shown that a good highlighting effect is achieved when the gap-free bypass zone has a width the size of at least three times the gap distance in a gap group.

Providing the same advantage, the lateral size of the bypass zone is at least twice as large as the gap distance of the furthest opposite gap in a gap group.

When the hair is guided through the application volume, the hair enters through the upper wall into the application volume and exits the application volume through the lower wall. Hereby, it is advantageous if the hair exits the application volume via the main application area or the rear application area. If the hair exits the application volume in the forward application area already, on the one hand, the transition path of the hair through the application volume is relatively short, so that there is a danger that it is not being moistened adequately. There is an added complication that the forward area of the application volume is furthest removed from the reservoir volume so that refilling the consumed active agent in the forward part of the application volume can progress at the slowest rate. There, the active agent can be depleted and the hair is drawn through the empty forward application volume.

In order to avoid all this as much as possible, the geometry of the upper and lower wall are designed in such a way that the hair slides into the applicator and the application volume as far as possible toward the rear and exit via the main application area and preferably via the rear application area—if available. The transition path through the application volume is relatively high and these parts relative to the application volume are relatively close to the reservoir volume and can be refilled more easily.

Correspondingly, the teeth have four different tasks in four different areas. Aside from the subdivisions of the gaps shown in FIGS. 36 through 38, in connection with the following details of the invention, the following subdivision is expedient. The first area includes the tooth tips, which comb the hair and are intended to guide it to the gaps. The second area consists of the upper wall, whereby the tip area is generally not taken into consideration. The third area consists of the forward part of the lower wall, i.e. the lower wall in the forward application area, and the fourth part consists of the rear or the middle and rear section of the lower wall, i.e. the lower wall in the main application area and in the rear application area—if available.

Figure 49:
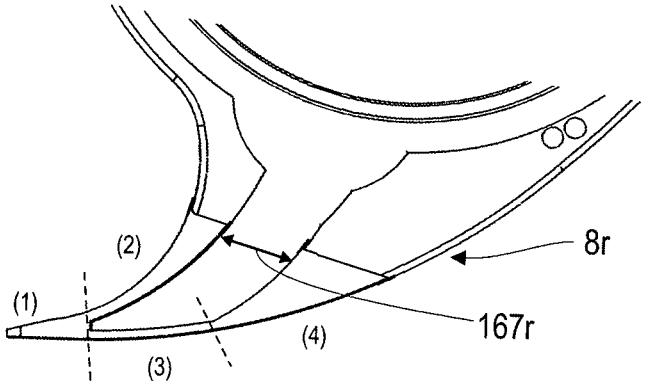
FIG. 49 through FIG. 51 shows the arrangement of areas in three different applicators.
Figure 50:
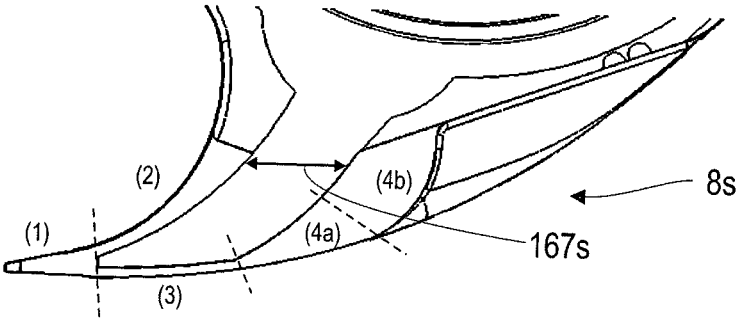
Figure 51:
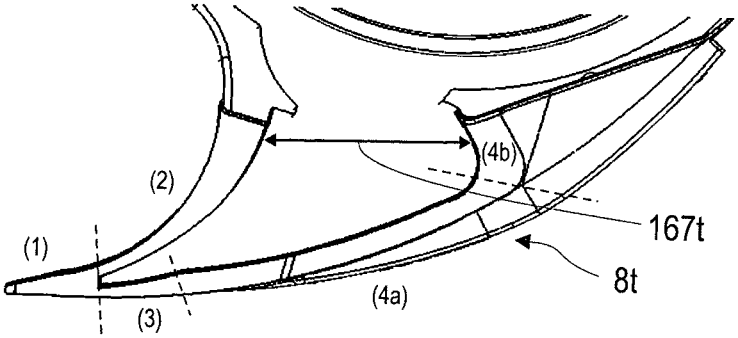

These areas are illustrated in FIGS. 49 through 51 with the help of examples from FIGS. 36 through 38. As refinement, the fourth area is divided into areas 4*a* and 4*b*, as the hair is intended to preferably exit from the application volume in area 4*b*, and less so in area 4*a*. In principle, however, the gap properties of area 4*a* and 4*b* are the same, or at least very similar.

The first and second areas have the task of introducing the hair into the application volume. The third area has the task of guiding the active agent as close as possible to the fiber substrate, in particular, the scalp. The fourth area has the task of guiding the hair out of the application volume. While it is advantageous that all areas have application tightness in idle condition, the cited tasks make additional and other demands on the areas making a corresponding adaptation of the geometry of the areas advantageous.

The second area introduces the same amount of hair into the application volume as is being guided out of it by the fourth area. However, in the second area the hair is dry and in the fourth area, the hair is moistened by the active agent that should surround the hair. Hereby, the diameter of the moistened hair, including active agent is larger than that of the un-moistened hair. Therefore, it is expedient if the width of the gap in the fourth area is larger than in the second area. At a gap width ratio of areas 4 and 2 of >1 to 5.0, suitable moistening results, from >1 to 3.0, advantageous moistening results, and from >1 to 1.5, especially advantageous moistening results are achievable.

As the third area has the task of guiding the active agent very close to the scalp, its gap depth is correspondingly low. As it is also not the goal to guide the hair out of the application volume in the third area, the gap width can be smaller in the third area than in the fourth area. Or, expressed differently: The gap width in the lower wall in the forward application area is advantageously smaller than in the main application area and—if present, the rear application area. The opening of the gaps of the third area into the fourth area further has the advantage that the hair primarily remains in the fourth area and because of the relatively high friction in the third area, wanders to the rear of it into the fourth area.

In order to achieve application tightness even while the hair is drawn through the application volume, it is advantageous if the gaps in the fourth area has a larger depth on average, than those in the second area.

Because of the distribution of tasks it is also extremely advantageous if the average depth of the gaps in the second area is larger than the average depth of the gaps in the third area. If a rear area 4*b* is present, i.e. that area in the lower wall that is located in the rear application area, it is the goal to guide as much hair as possible in this area out of the application volume, because in this area, the reliable moistening of the hair with active agent takes place, as the application volume in this area is closest to the reservoir volume and in this area, the hair is guided into the recess in the supporting surface and can thus, in particular, in the case of the highlighter, be bundled into a strand, which surrounds the hair especially intensively with active agent, and makes it stable against a stripping off of active agent from the hair.

It is advantageous for this reason when the gap width in section 4*b* is larger on average than the gap width in area 4*a*. Hair tends to slip into the wider gap and thus reach to the rear.

Even with respect to the application tightness, it is advantageous if at positions having a lower gap depth, the gaps are rather narrower. In particular, in section 4*a*, the gap depth grows from the front to the rear. Correspondingly, it is advantageous if the gap width in section 4*a* increases from the front to the rear, in particular, continuously over the entire area.

The tasks of the four areas are not the same for all possible applicator forms. Thus, it can be seen that the highlighter, as shown, for example, in FIG. 51, does not have an important task of coloring near the root. Therefore, the third area is only weakly developed or can even be eliminated entirely.

As can be seen in FIGS. 49 through 51, a transition path length 167 of the hair through the application volume is of different length in all three application devices 8*r*, 8*s*, 8*t*. The three application devices form a system of application devices that have different transition path lengths 167. The transition path lengths increase with the viscosity of the active agent used. While application device 2*r*, e.g. a root coloring device is best used with an active agent having low viscosity, application device 2*s*, for example, a marbling device is best used with an active agent having average viscosity, and application device 2*t*, for example, a highlighter, is best used with a highly viscous active agent. Advantageous transition path lengths 167 are 5 mm to 10 mm, 6 mm to 15 mm and >15 mm.

The transition path length can be measured at the furthest rear position at the hair line, i.e. at hair that has entered the gap to the maximum extent. A hairline that is 2 mm anterior to the furthest rear position of the hair line is also possible, because most hair comes to lie in the area of the furthest rear 5 mm of a gap for optimal moistening.

The amount of hair introduced into the gap can also be influenced at the tooth tip by a trapping filter. This is especially advantageous for the marbling device, which has only individual gaps between bypasses. If only a small amount of hair is to be introduced into the gap, it is advantageous if the gap runs in one line up to the tip so that no trapping filter is present. On the side of the tooth facing away from the coloring gap, however, an incline is advantageously present, so that the tooth, per se, has a tip.

Advantageously, at least some teeth of the comb have a thickening at their tooth tip that makes the gap smaller in the tip area than in the areas behind the tip area.

Further, it is advantageous if on, or in the tip area, an insert is attached or inserted that closes some of the available gaps in the front. With such an insert or top piece, the amount of hair that is colored in each combing can be changed, so that the color picture can be adapted to a desired result.

The first area has the task of introducing the hair into the gap and to thereby specify the amount of hair per gap length and gap width in the gaps. If the first area introduces too much hair into the gap, it could lie too tightly in the gaps and is not adequately moistened. It is therefore expedient if only as much hair is introduced into the gap as can be moistened all the way around by active agent in the application area, i.e. the hair is not bunched too tightly. This advantage can be achieved if the gaps in the first area, i.e. in the tip area, are narrower than in the application area. In particular, in the tip area, the gaps have their lowest width.

The constriction in the first section can be achieved during the production of the applicator already by a corresponding production of the teeth. The problem of hair that is too tightly bunched in the application area and thus inadequately moistened also depends, however, on the physical properties of the active agent. In principle, it is therefore advantageous to provide a system of application devices that have different constrictions in the first area, i.e. constrictions of various widths in the first section. However, in manufacturing, this is expensive. It is therefore advantageous to provide a possibility that the gap width in the first section can be adjusted even after the applicator has been manufactured. This can be achieved with an attachment to the teeth, with which the widths of the gaps in the first area can be adjusted. By using a suitable tool, the attachment can be attached to the tips in such a way, for example, that an individual attachment is placed on each tip by means of which the tooth width is broadened in the desired manner.

It is likewise possible to slide an insert into the first area from the interior, i.e. through the application volume, which decreases the gap widths to the desired dimension.

The second area, i.e. the upper wall of the teeth is the least sensitive to the physical properties of the active agent with respect to the application tightness, as the hair is introduced into the applicator from the top through the upper wall, and the active agent is therefore pushed back into the application volume and the active agent furthermore rather leaks out of the gaps downward than upward. In spite of that, with respect to various active agents, the following gap widths have shown to be particularly advantageous:

Advantageously, the gaps have, at least in their upper wall, a width of between 0.03 mm and 1.5 mm, in particular, between 0.05 mm and 0.5 mm, further, in particular, between 0.05 mm and 0.35 mm.

Further, it is advantageous if the gap width extending over the length of a gap is uniform.

With respect to the depth, the gaps in the upper wall can vary in width. Thus, for example, a funnel that tapers from the top to the bottom is advantageous in order to introduce the hair into the gap especially well. However, it is also possible that the gap width remains constant over the entire depth of an upper wall.

Advantageously, the upper wall has a suitable gap depth between 0.2 mm and 1.5 mm; well suitable it is between 0.35 mm and 3.0 mm and especially well suited between 0.5 mm and 2.0 mm.

Advantageously, the gaps are wider at an outlet section than at an introduction section. The introduction section can be a section in the upper wall and the outlet section an area in the lower wall. The gaps should not release any active agent on the top, as this leads to undesired coloring effects because the hair then absorbs color independent of the coloring gap at those accretions when it is combed. It is therefore advantageous when the gaps of the upper wall are more leak-proof with respect to their application tightness than those in the lower wall. Advantageously, area 4 is configured tighter than area 3 with respect to its application tightness.

Advantageously, the gap width in the outlet section is 1.2 times to twice as wide than in the introduction section, in particular, at a gap width in the introduction section of more than 0.2 mm.

Further, it is advantageous if the gap width in the outlet section is 2 to 4 times wider than in the introduction section, in particular, at a gap width in the introduction section below 0.2 mm.

Further, in particular, the gap width in the outlet section is 4 to 7 times wider than in the introduction section, in particular, at a gap width in the introduction section of up to 0.15 mm.

As explained above, the gap width of the gaps of the applicator should be advantageously adapted to the tasks and, in particular, to the active agent. This can be done by various embodiments of an otherwise similar applicator. However, it is especially advantageous if the applicator includes an adjustment means for an—in particular, manual—adjustment of the gap widths in such a way that at least the width of the preponderant number of the available gaps is adjusted synchronously by a readjusting of the adjustment tool.

Such an adjustment can be made easier if the teeth are elastically connected with each other at their tooth base. In this variant of an embodiment, the adjustment tool can have the effect that the adjustment changes an alignment of the teeth toward each other. Thus, for example, the tooth tips can be moved toward each other and the gap can thus be decreased, or the tooth tips can be moved further apart from each other and the widths of the gaps can thereby be enlarged.

It is especially advantageous if the tooth base is elastic in such a way that the gap widths of all gaps are decreased by the same amount when the teeth are pressed together laterally. This also makes a uniform adjustment of the gap widths possible.

The gap profile determines good guidance of the hair within the applicator. The gap profile shows itself in a lateral cross sectional view as illustrated, for example, in FIGS. 49 through 51. The profile is determined by the top side of the upper wall, the top side of the tip area, the lower side of the tip area and the lower side of the application area, whereby the gap profile deviates from the shape of the supporting surface or its profile, if the gap outlet immerses into a recess of the supporting surface. This is shown by way of example in FIGS. 50 and 51.

The hair can be drawn into the gap easily if the gap profile has a semicircular concave curve at its top side, the deviation of which from a circle over a length of at least 80% of the gap top side, in particular, over a length of 100% of the gap top side, is a maximum of 20% of the radius of the circle, in particular, a maximum of 10%.

Even a comb angle that opens has positive characteristics for guiding hair into the gap. Advantageously, the comb angle is enlarged toward the rear in such a way that the gap profile deviates at its bottom side over the foremost 2 cm by a maximum of 5 mm, in particular, a maximum of 3 mm from a straight line. Thus, if a tangent is placed on the lower profile 2 cm behind the tip, the tip projects from the straight tangent by a maximum of the cited number of millimeters.

It is especially advantageous in the rear application area if the gap profile at the gap's rear side has a section that is at least 5 mm long, which, with a deviation of a maximum of 1 mm, extends parallel to the furthest rear section of the top side of the upper wall.

In particular, in the case of a highlighter it is advantageous if the gap profile at its lower posterior end is aligned in such a way that it extends to the upper posterior end. This is shown, for example, in FIG. 51, in which the gap outlet in area 4*b* extends upward to the top side in area 2.

Figure 52:
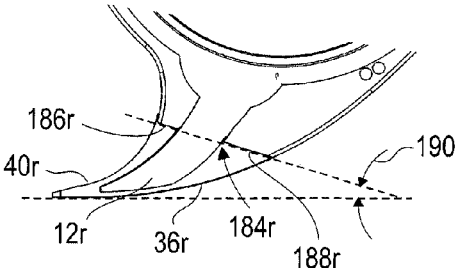
FIG. 52 through FIG. 54 shows lateral cross sections of three different applicators.
Figure 53:
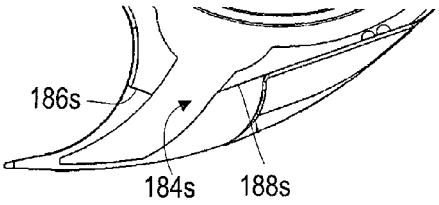
Figure 54:
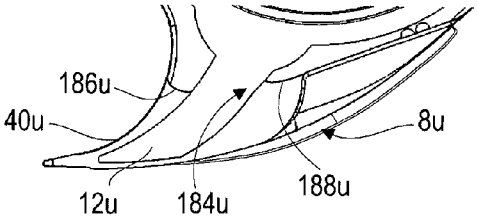

In the embodiment of the applicator with a comb having a row of teeth aligned in parallel and gaps between then, the gaps advantageously end toward the rear at a gap base that limits the length of the gaps. An example of this is shown in FIGS. 52 through 54. Gap base 184 hereby extends respectively from top side 40 to lower supporting surface 36 and can be subdivided by application volume 12 into a forward gap base 186 and a rear gap base 188.

Advantageously, the gap base is located in a straight line that forms—in the direction of the tooth tips—an angle between 10° and 30°. This is shown by way of example in FIG. 52. In this exemplary embodiment, angle 190 is 17°. Hereby, the forward gap base 186 as well as rear gap base 188 can be included in the same angle 190 in the direction of the tooth tips, the two gap bases 186,188 thus parallel to each other, in particular, aligned flush.

However, it is particularly advantageous when the forward gap base is located at an angle to the rear gap base. This is illustrated by way of an example in FIG. 53. Forward gap base 186 has an angle between 10° and 30° with respect to the direction of the tooth tips. Located at an angle to this is rear gap base 188*s*, which is likewise angled in the direction of the tooth tip, however, negative on the other side—depending on the definition of the angle. Both gap bases 186*s*, 188*s* can hereby respectively form one plane. As a result of the angling of the forward gap base with respect to the rear gap base, it can be achieved that hair that is pulled along the entire gap base can be guided through the applicator with less friction.

The same advantage is provided if the gap base in the lower wall, i.e. the rear gap base, is rounded convexly upward in forward direction into the application volume.

In order to simplify the introduction of hair into the gaps, it is furthermore advantageous if the gap base in the upper wall, i.e. the forward gap base is rounded convexly in lateral profile.

It is especially advantageous if it enters into a top side of the applicator without a bend. These details of the invention are shown in FIG. 54. Rear gap base 188*u* is rounded forward into the application volume upward, so that the formation of a sharp edge by rear gap base 188*s* as in FIG. 53 is avoided. In order to facilitate sliding the hair along the front edge of the gap base, forward gap base 186*u* in FIG. 54 is also rounded toward the front and toward the top. In this exemplary embodiment, the gap base extends into top side 40*u* of applicator 8*u* without a bend. Hereby as well, an anterior sharp edge of forward gap base 186*u* can be avoided, so that hair that is being introduced into the gap from the top can be guided into the gap at the curve with little friction.

Figure 55:
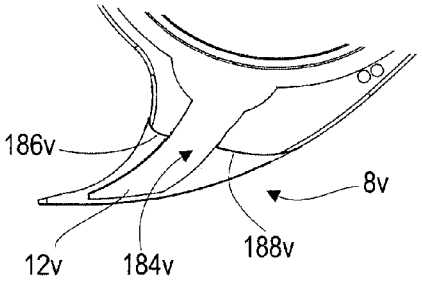
FIG. 55 shows a rounded tooth base.

At the lower end of the gap, hair that is moistened with active agent is guided out of the applicator. Here, it is advantageous if the geometry is designed in such a way that the active agent is not stripped off, or as little as possible is stripped off the hair. To achieve this, it is proposed that the gap base in the lower wall is curved convexly upward toward the rear, and, in particular, runs into a supporting surface of the applicator without any bends. This is shown by way of example in FIG. 55. Rear gap base 188*v* is curved convexly upward toward the rear and in this exemplary embodiment, also runs into supporting surface 36*v* without any bends, so that a transition without any bends is established from gap base 188*v* into supporting surface 36*v*.

The application volume is advantageously that volume of the applicator that is filled with active agent, and through which the hair can be drawn. Advantageously, none of those volumes into which no active agent should flow and/or into which tautly held hair that is guided through the applicator cannot immerse, are components of the applicator volume.

Figure 56:
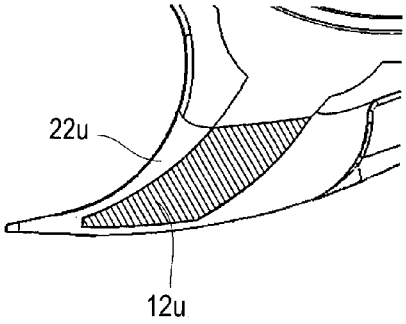
FIG. 56 and FIG. 57 shows a lateral and a schematic perspective illustration of an application volume.
Figure 57:
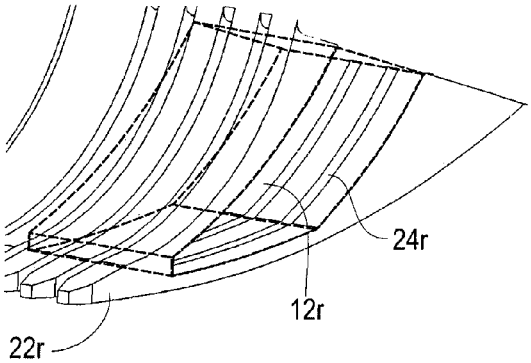

In FIGS. 56 and 57, examples of two application volumes 12 are shown. Application volume 12*u* in FIG. 56 includes the hollow tooth volume of teeth 22*u*, and also that part of the gap between teeth 22*u*, the lateral profile of which is equal to the hollow tooth volume. In the perspective view in FIG. 57, this is shown clearly. Application volume 12*r* is shown dotted into the perspective view of four teeth. It is a volume that continues through several teeth, in particular, with the same lateral profile, at least extending over the course of several teeth. Advantageously, the application volume surrounds the inner volume that extends continuously perpendicular to the gap planes and at least through several, in particular, all hollow tooth volumes of the comb.

This is shown in FIG. 57. Application volume 12*r* that is shown as a dotted line extends over four teeth—it includes four hollow tooth volumes and those volumes of the three gaps 24*r* that lie between the four teeth—corresponds to the hollow tooth volume in its lateral profile.

Advantageously, the application volume extends through all teeth of the applicator that are equipped with a hollow tooth volume.

In the following, an expanded application volume can be defined in such a way that in addition to the hollow tooth volume, it includes the entire volume of the gap. This is expedient especially then, when it is envisaged that the active agent should penetrate into the gap in order to achieve a good moistening result. The expanded application volume, in the following and in the foregoing sections, also described as "application volume", thus includes, for the sake of simplicity, a larger volume than that shown by way of example as application volume 12 in FIGS. 56 and 57. However, both application volumes have in common that the hollow tooth volume is limited at its rear edge by the line of taut hair along the gap base. This can be seen in FIG. 56. Although at the inner edge of its lower wall, the gap reaches even further upward because of the upward curve of the rear gap base than was specified by a line of taut hair along the forward and rear gap base. But as the area above this line can no longer be reached by taut hair, the area that lies above is no longer considered to be a part of the application volume as per the definition.

The application volume is advantageously completely surrounded by the teeth of a comb of the applicator to the extent that only the transition to the reservoir volume or a transition volume through the teeth remains open.

Advantageously, the application volume is radially open toward the outside via the gap. As a result, hair can be guided radially inward through the application volume.

With respect to the size of the volume, at least two parameters must be considered: A volume that is too small is emptied too quickly by the hair that is guided through it, so that an end section of the hair will perhaps not be sufficiently moistened with active agent. To that extent, a large application volume is advantageous. However, a large application volume means that a large mass of active agent is in the application volume, which presses into the gap at high pressure upon an abrupt motion of the applicator during use, because of the mass inertia, so that a large mass of active agent favors a leakage. For a good compromise with respect to this application volume, it is beneficial if the application volume in a lateral profile, i.e. a profile parallel to the gap planes of the cross sectional profile of the applicator, is at least twice as long as it is deep. This is shown by way of example in FIGS. 36 and 37. The example in FIG. 38 does not illustrate this detail. This is because the example in FIG. 38 is particularly suitable for coloring small strands, in which the active agent is highly viscous and thus does not penetrate very easily through the gap to the outside. In this case, a large mass of active agent can be tolerated, without generating any leakage.

For a good moistening result it is also favorable if the application volume towards the front, i.e. towards the tooth tips is tapered to a tip. Hair immerses early into the application volume already, i.e. very far in the front, so that a moistening near the roots is favored.

Moreover, it is advantageous if the application volume is curved over its longitudinal extension, in particular, bent upward. This is also shown in the exemplary embodiments in FIG. 36 through 38 in various curved patterns.

It is likewise favorable for moistening near the roots when the application volume reaches closer than 2 mm, in particular, closer than 1 mm, further, in particular, closer than 0.7 mm downward to a lower side of the applicator, i.e. in particular, to a supporting surface. This advantageous embodiment is shown, in particular, in FIGS. 49 and 50 in areas (3).

Especially when coloring close to the roots it is furthermore advantageous when the tip of the applicator is very pointed and the application volume reaches very far forward, i.e. into an area having low height. Advantageously, the application volume reaches into an area of the applicator with its foremost tip that has a maximum height of 3 mm, in particular, a maximum of 2 mm. Hereby, the areas close to the roots of the hair can be brought into contact with the active agent directly after being introduced into the comb already, when the hair's friction in the comb is still very low because of the low height. Hereby, the tendency of the hair to bend over forward because of the friction is very low, so that all or substantially all hair is captured and can be colored close to the roots.

A further advantageous embodiment provides that the application volume is guided over a distance of at least 5 mm downward, parallel to the supporting surface of the applicator, and has a tip zone anterior to this parallel zone, which is brought closer to the supporting surface, i.e. the parallel zone. This is shown by way of example in FIG. 38. Lower wall 150*t* has a tapering toward the anterior in the forward application area 162*t*, by means of which the application volume is brought closer to supporting surface 36*t* than in the parallel zone in main application area 164*t*.

For a good moistening it is further favorable if the inner side of an upper wall and the inner side of a lower wall of the teeth extend parallel to each other over an application volume length of at least 5 mm, in particular, at least 10 mm. As an example for this, main application area 164*r* in FIG. 36 and main application area 164*s* and rear application area 166*s* in FIG. 37 can be consulted. The inner side of the upper wall in forward application area 162*r* also extends parallel to the inner side of the lower wall in main application area 164*r*, 164*s*. In both exemplary embodiments, the length of the parallelism extending over length 192 of application volume 12, is more than 10 mm.

If the application device is held with the applicator pointing downward, and if the application volume is filled with active agent, a relatively large portion of active agent mass impinges on the forward end of the application volume so that there, the difficulty arises of ensuring the application tightness. This difficulty can be countervailed with the correct adjustment of the bevel angle of the application volume.

The bevel angle is that angle at which the application volume opens between its top inner side and its lower inner side at its forward tip toward the rear. Advantageously, the bevel angle has an angular range of between 7° and 18°, in particular, between 10° and 15°. Bevel angles 194 are shown in FIGS. 58 and 59 by way of example. Bevel angle 194*w* in FIG. 58 is 12° and is especially suited for an active agent with rather low viscosity, in particular, coloring agent for coloring close to the roots.

The bevel angle ensures that the amount of active agent in the forward tip area of the application volume is low. In this area, the comb advantageously has thin walls, in order to ensure coloring close to the roots. The small amount of active agent has the advantage that less static pressure is exerted on the gap. Moreover, relative to the volume, relatively strong adhesive forces act upon the active agent that is present, as the surface per volume is very large. For an active agent having a viscosity smaller than 4 Pa*s, a bevel angle of 7° to 18° is well suited, and between 10° and 15°, especially well suited.

Moreover, such a narrow bevel angle ensures that the pump effect by means of which active agent is pumped from the reservoir volume into the application volume is lowered because of the relatively high friction. The small bevel angle only poses a problem relative to filling, as even the foremost area of the application volume should be filled with active agent. Due to the low viscosity of the active agent, however, even the pointed tip of the forward application volume can be filled. The small bevel angle has the additional advantage that the back-flow tendency is strongly throttled because of the relatively large adhesive forces compared to the amount of active agent. This is primarily important in an overhead application in which the applicator's tip points upward.

Further, it is advantageous when the bevel angle of the application volume has an angle between 20° and 40°, in particular, between 22° and 36°. Such an angle is especially suited for more viscous, firm and sticky application agents that can be foam or pulp-like. In particular, such a bevel angle is suitable for active agents with viscosities of more than 4 Pa*s, in particular, of more than 40 Pa*s. The larger bevel angle is advantageous in order to be able to also reliably fill the tip of the application volume with the more viscous application agent. Because of the lower flow properties, tightness and back-flow take on a subordinate role. In spite of that, the angle should be limited toward the top in order to ensure an ergonomic use and to prevent back-flow or a break of the active agent in the application volume when it is used overhead.

A further advantageous embodiment of the invention provides that the application volume has at least two volume portions that continuously extend respectively perpendicular to the gap planes through several hollow tooth volumes and that a separator element is located between the volume portions.

The separator element can have two functions. In one function, it can separate the two volume portions from each other impervious to active agent. Advantageously, the separator element separates a passage perpendicular to the gap planes from one volume portion to the other volume portion. This detail of the invention is shown by way of example in FIG. 60. FIG. 60 shows a perspective view of applicator 8*y* from the front, which has an application volume 12*y* with two volume portion 196, 198 in its interior. A separator element 200 is located between the volume portions, which separates the two volume portions 196, 198 impervious to active agent. Hereby, the imperviousness to active agent refers only to the interior of the applications device, so that the active agent could, of course, penetrate from one volume portion through the gap and along a path outside of the application device and in turn could penetrate into the other volume portion through the gap, which is, however, irrelevant for customary applications. This embodiment is especially suited for highlighters, for example, when two small strands are to be colored with different colors. Two different active agents can be applied to the hair at the same time, so that an application can be speeded up significantly.

Advantageously, the separator unit extends from the application volume all the way into the reservoir volume, so that two different active agents can be stored separately and impervious to active agent in the reservoir volume. Even this detail is indicated in FIG. 60. Separator element 200 extends from application volume 12*y* all the way into reservoir volume 10*y*, so that two different active agents can be stored and flow separately in the reservoir volume.

Advantageously, the separator element is located in a bypass area of the applicator. Hereby, two gap groups can be separated from each other impervious to active agent, which is particularly advantageous when coloring small strands.

A second function is the filling of dead space that is not needed for active agent. This is particularly advantageous in a bypass area between two gap groups with respectively several gaps. Here, the lower area of separator element 200 can be used as fill element 202, whereby the upper part of separator element 200 can be dispensed with.

Advantageously, the separator element or the fill element fills a volume between the volume portions having a width that is at least as wide as the gap group width. Hereby, dead space of the application volume can be reduced relative to one volume portion passing to another through the application volume. This is expedient in order to have a residual amount that is as small as possible in an emptied applicator. The separator element or the fill element should hereby have a distance of at least one gap width, in particular, at least two gap widths from the outer gap of the gap groups. This benefits the moistening with active agent, as hereby, more active agent is available in the outer gaps for long coloring lengths.

These details are also shown in FIG. 60. Fill element 202 is wider than the width of the gap groups, i.e. wider than the width of the four gaps. Moreover, fill element 202 is located at a distance of three times the gap width from the two outermost gap groups of the gap groups, whereby those outermost gaps are meant that face fill element 202 in the gap group.

In an advantageous refinement of the invention, the application volume has a rear convexity with a back wall. Such a convexity 204*x* is shown, for example, in FIG. 59. The term convexity can be defined thereby, that a back wall of the application volume first moves away from the upper wall when passing through the convexity and then over its further course extends toward it again. This can be seen by way of example in FIG. 59. At its upper end, back wall 206*x* extends again to upper wall 148*x*, so that there is a position in back wall 206*x* that has a maximum distance from upper wall 104*x*. Starting at this point, rear wall 206*x* again extends toward the upper wall in both directions.

Holding the hair in the gaps can be facilitated if the lower back wall has a perpendicular position relative to the direction of the tooth tips. The direction of the comb tips specifies the comb movement through the hair and thereby also essentially the position of the hair within the comb and thus within the application volume. With the indicated embodiment, the hair can be held in the gap easily, and it can be moistened especially well all around, even with viscous active agent.

The same advantage is provided when the back wall is round-bellied and curved over a length of a maximum of 1.5 cm, in particular, only a maximum of 1 cm in an angular range of 70°, in particular, at least 90°. As can be seen in FIG. 59, back wall 206*x* is curved in the area of convexity 204*x* extending over an angular range of approximately 90°. This takes place over a distance of approximately 7 mm.

In an overhead use of the application device it should be avoided that active agent runs out of the application volume back into the reservoir volume. In order to countervail such a back-flow, a back-flow barrier is advantageous that stops the back-flow of active agent from the application volume into the reservoir volume. Advantageously, the back-flow barrier is located in a transition area between the application volume and the reservoir volume.

Further, it is advantageous when the back-flow barrier has surface irregularities on a surface facing the application volume and or the transition volume, e.g. the gap. The surface irregularities are at least 1 mm deep and can be designed as ribs or points. Transverse ribs and/or shingling counter to the direction of flow from the application volume to the reservoir are especially advantageous.

These features are shown by way of example in FIG. 58. Back-flow barrier 208*w* includes several inclined and thus transverse ribs located somewhat shingle-like in intermediate volume 14*w* between application volume 12*w* and reservoir volume 10*w*. The ribs are transverse ribs as they—aside from their slant—are directed transverse to the flow direction from application volume 12*w* to reservoir volume 10*w*. For the sake of clarity, it is also shown in FIG. 58 that such transverse ribs can be located on upper wall 148*w* and/or lower wall 150*w*, i.e. directly in the application volume 12*w*.

The ribs then advantageously do not cover the gap, but are only located at the teeth and project from there parallel to the gap plane into the application volume.

Advantageously, the back-flow barrier has a break constriction that promotes a break of a portion of active agent having a suction effect at the application volume. Advantageously, the break constriction is located in a transition volume between the reservoir volume and the application volume. In FIG. 58, such a narrow position or break constriction is shown on the shingles that project furthest into the intermediate volume on both sides. Beginning at a certain viscosity, a break in the active agent flow from the application volume into the reservoir volume is favored, so that active agent remaining the application volume is not sucked out by the active agent flowing back into the reservoir volume.

The previously described gaps are level gaps from the front to the back and from the top to the bottom, they are thus in one plane, in particular, each lateral gap surface lies in one plane. Further, the gaps lie perpendicular to the supporting surface.

In order to countervail that hair falls out of the gaps it can, however, be advantageous if the gaps are inclined to the supporting surface, in particular, also to the lateral surfaces of the reservoir. This is shown by way of example in FIG. 67. Gaps 24*aa* are slanted at an angle of 12° from vertical to the supporting surface. Especially advantageous is a slanting between 8° and 25° relative to vertical. Hair introduced into slanted gaps tends to fall in the direction of the slant so that the hair is then no longer positioned in the gap direction and is thus retained more firmly in the gap.

A further advantageous embodiment of the invention provides that the gap is curved or bent from the top downward and/or from the front to the rear. An example of this is shown in FIG. 68. The direction of gaps 24*ab* oscillates from the front to the rear. In the direction from the top to the bottom, they are designed in a straight line, so that the hair can be guided linearly through the gap, as a result of which the frictional resistance in the gap remains low.

Especially advantageous, a gap has a trapping bend, in particular, at its rear half. Hereby, the hair can be retained especially stable in a trapping area. The trapping area of the gap can extent behind the trapping bend. Hair in the trapping area extends advantageously through the largest passage length of the application volume, i.e. through the longest area of the application volume from the top to the bottom.

The bend does not need to be sharp, as shown by way of example in FIG. 68. Gaps 24*ac* are bent in their rear half, doubly oscillating so that the trapping area 228 comes to lie in the rear-most third, which extends linearly backward, perhaps somewhat inclined, whereby that is not necessary. The hair within trapping area 228 is retained especially securely against falling out or sliding out of gap 24*ac*.

FIG. 69 shows a highlighter with two gap groups. The gap shape of both groups is the same, however, the gaps in one group are arranged in a mirror image of the gaps in the other group. Hereby, an undesired lateral offset movement of the application device can be countervailed in the event of such a motion during application. The mirror image results from a mirror surface placed parallel to a main direction of the application device from the front to the rear.

Gap Outlet

Figure 61:
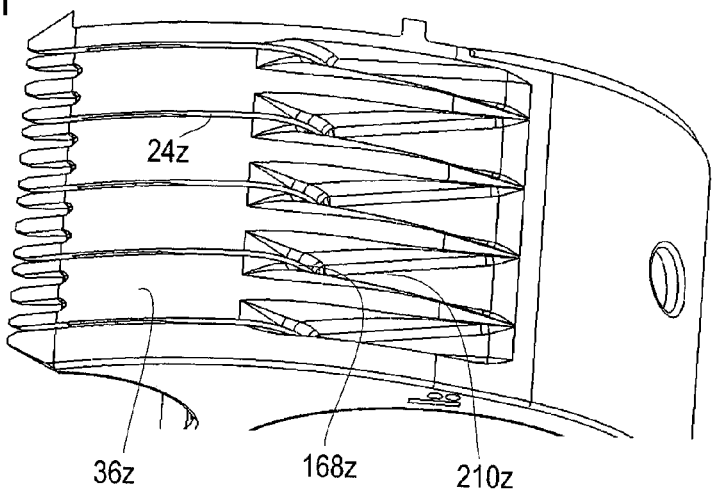
FIG. 61 shows a perspective view transversely from below of five discharge chambers of a marbling device.

As shown in FIG. 39, it is possible that gap 24*r* at its lower side in the rear ends without transition into lower supporting surface 36, so that this supporting surface 36 forms a smooth and continuous surface. Depending on the application of the application device and the use of different active agents it is, however, advantageous if the gap ends in a chamber at its lower and posterior end. Hereby, two fundamental and different embodiments can be differentiated. A single gap ends in a chamber, so that one chamber is available for each lower and rear gap outlet. This is shown by way of example in FIGS. 61 and 62. In the other embodiment, several rear, lower gap ends flow into a single chamber, which thereby functions as collecting chamber. This is shown by way of example in FIGS. 44, 45, and 63. While the first embodiment is especially suited for marbling, i.e. for coloring a small segment of a large amount of hair, the second embodiment is especially suited for coloring single strands that include a relatively large segment of adjacent hair.

In particular with respect to the first embodiment, it is advantageous when the rear gap outlet of a gap widens into a chamber. This is shown by way of example in FIGS. 61 and 62. Five gaps 24*z* of a marbling device respectively end individually in chamber 210*z* at their gap outlet 168*z*, so that only one gap 24*z* ends in each chamber 210*z* with rear outlet 168*z*. However, it is not necessary that the chamber has a recess in the lower supporting surface of the applicator. FIG. 44 shows how four gaps 24*t* respectively end in one single chamber 210*t*, which is formed by two spacers 212*t*. In the exemplary embodiment shown in FIG. 43, although chamber 210*t* also lowers itself into supporting surface 36*t*—this can be seen in FIG. 38—this is, however, not necessary. It is sufficient if chamber 210*t* is formed only by spacers 212*t*. It is described relative to FIGS. 38, 44 and 45 that spacers 212*t* are guide surfaces 174*t* that guide and bundle hair exiting gaps 24*t*. This is a special embodiment and is not necessarily required. Spacers 212*t* can also be at such a distance from gaps 24*t* that they essentially do not have a guiding function, but only a chamber-forming function.

Advantageously, the width of the chambers increases with increasing distance from the gap outlet. Moreover, it is advantageous if the chambers decrease in depth with increasing distance from the gap outlet. These two details can be seen in FIGS. 61 and 62.

Figure 62:
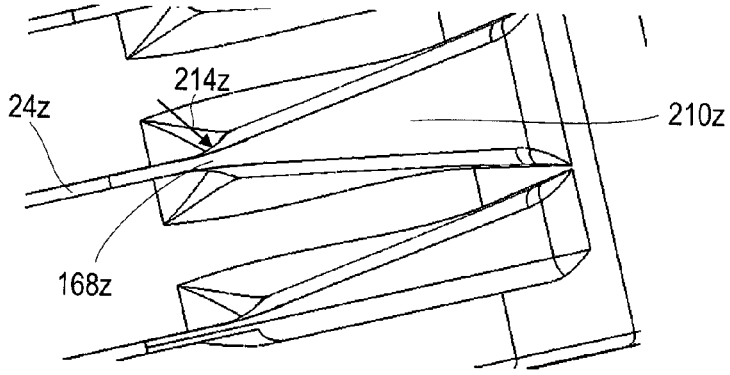
FIG. 62 shows a cut-out of the drawing in FIG. 61 in a view from below.

In order to avoid a stripping off of active agent at rear gap outlet 168, it is advantageous if the gaps at the gap outlets end in a continuous widening into the chamber. Thus, a stripping edge can be avoided at the gap outlet. An example of this is shown in FIG. 62 by way of explanation. At gap outlet 168*z*, gap 24*z* widens with a radius 214*z* by at least 5 mm, so that a very soft and continuous transition is formed from gaps 24*z* into chamber 210*z*.

In particular with respect to the second embodiment, it is advantageous when spacers are located on the lower side of the applicator, so that the rear gap outlets—upon contact by the applicator on a fibrous substrate, for example, a scalp, have a distance of at least 0.5 mm, in particular, at least 1.5 mm from the fiber substrate. Hereby, especially with respect to the second embodiment, hair exiting the gap can be bundled without being squeezed between the fibrous substrate and the supporting surface after exiting the gap outlet. Advantageously, the spacers are located on both sides around the gap outlets.

Further, it is advantageous if the spacers are spacer guides that project downward out of the supporting surface of the applicator.

Good bundling of the hair exiting the gap outlets that is moistened with active agent can be achieved if the spacers converge toward the rear.

Advantageously, the spacer guides form a gap in which the hair exiting a gap outlet and directed toward the rear, can be bundled.

Moreover, it is advantageous when respectively two spacers are located around a group of gap outlets on both sides. In particular, there is one distance without a gap between two such groups.

Figure 45:
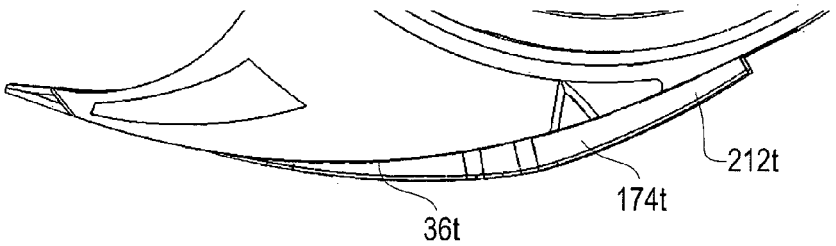
FIG. 45 shows a lateral view of the lower part of the applicator.
Figure 63:
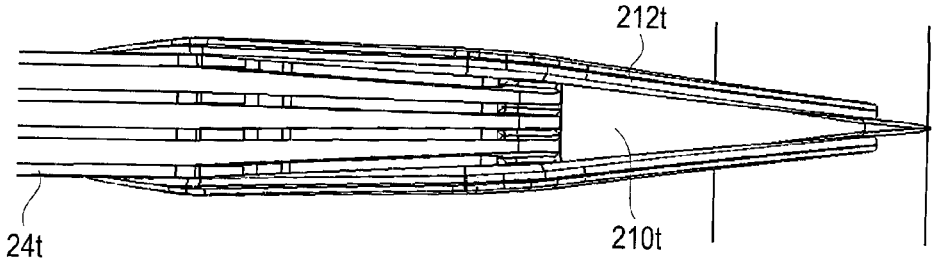
FIG. 63 shows a view from below of a small strand-formation chamber of a highlighter.

All of these features can be seen in FIGS. 44, 45, and 63. Respectively four gaps 24*t* end in a chamber 210*t* that is flanked by two spacers 212*t*, which function as guide elements 174*t*. Spacers 212*t* converge toward the rear so that the hair flowing out of several gaps 24*t* are bundled into a strand between spacers 212*t*. As chamber 210*t* becomes more flat toward the rear, this bundling occurs not only laterally, but also from the top and the bottom—provided the applicator has contact on a fibrous substrate, for example, a scalp.

It is generally advantageous if several gap outlets end in a chamber in which fibers guided out of gaps are combined. In particular, the chamber is formed in such a way that fibers from several gaps are combined into a single bundle in the chamber. Hereby, at kneading through of the moistened hair and thus an even color distribution or bleaching agent distribution can be achieved in the hair. Moreover, drying out is slowed down and thus the duration of an action by the active agent is extended. Further, the advantage is achieved that a differentiation of moistened and un-moistened hair, or colored and uncolored hair is made easier, because these are collected in easily visible and moistened strands and bundled in such a way that they can easily be identified visually.

Some details of the invention described above can be formulated as follows: The application device includes a separator unit that has a comb-like structure with at least two gaps. The gaps can also be described as application gaps. At least one separator element is located between the gaps, which is, for example, designed in the shape of a tooth. To that extent, a tooth can also be described as a separator element between two gaps. The separator elements or teeth are advantageously formed by a part of the housing of the application device, which also limits the application volume, in particular, with the separator elements. The gaps formed between the separator elements advantageously transition into the application volume.

Especially advantageously, the housing has, in at least one area of the tooth, a wall thickness that is less than 2 mm. All of these features are shown in the areas (3) of FIGS. 49 and 50.

Moreover, it is advantageous if the housing in the area of the tooth in which the wall thickness is less than 2 mm forms at least one supporting surface that is intended for contact on an application surface consisting of fibrous material, which can also be described as fiber substrate.

It is especially advantageous if the housing has a wall thickness in at least one area of the supporting surface that is less than 1.0 mm. These features are also met in the exemplary embodiments of FIGS. 49 and 50.

Advantageously, the housing walls decrease in thickness in at least one area along an application direction. The application direction is a direction from the rear to the front, as the applicator is moved in this direction during an application.

In order to prevent leakage, it is advantageous if the gaps have a width that is smaller than a barrier width starting at which the active agent automatically discharges from the application gaps. Advantageously, the width of the gaps, at least in one area of a supporting surface, is significantly smaller than a barrier width, starting at which the active agent automatically discharges from the gaps.

It is advantageous with respect to the dimensions, if at least one of the teeth has an average width that is less than 4 mm. Moreover, it is advantageous if the gaps respectively have a single gap volume (coloring volume) that is larger than 4 $mm^3$ and smaller than 40 $mm^3$. Hereby, a good coloring result can be obtained in combination with application tightness.

For good guidance of the hair in the gaps, it is favorable if the gaps have a base surface, this is, in particular, a gap base that includes a sharp angle with the supporting surface.

In order to countervail leakage of the active agent from an upper wall, it is advantageous if at least one of the application gaps in the upper wall has a deeper depth than along the supporting surface. This especially applies to the closest opposite points of the upper wall and the lower wall. Thus, for example, any point on the upper wall can be specified, and the corresponding point on the lower wall is that point on the lower wall that comes closest to the point on the upper wall.

Advantageously, the top side has an average curve radius that is smaller than an average curve radius of the supporting surface.

Preferably, the average curve radius of the supporting surface and/or the average curve radius of the top side of the applicator are in a range of between 15 mm and 80 mm, in particular, between 20 mm and 65 mm and especially advantageous, between 25 mm and 55 mm.

With respect to the gap exits, it is advantageous if several gaps, respectively at their gap outlets, end in a single chamber that is advantageously designed as recess in a supporting surface. The fibers can thus be expanded by the tooth tips that function as comb and distributed to several gaps and upon exiting, i.e. after having been moistened by active agent, combined into a compact strand. The chamber can include guide surfaces that bundle the hair. The guide surfaces can be movable, rotatable or fixed relative to the supporting surface. If they are flexibility, an adjusted setting can advantageously be locked, for example, by clamping the guide surfaces at a component.

Pump

Generally, the reservoir volume will be significantly larger than the application volume in order to make enough active agent available so that a large amount of the hair on a human head can be moistened with active agent. This brings it about that active agent from the reservoir volume must enter into a constriction to reach the application volume. Especially in the case of highly viscous active agents, this will not happen by itself or simply due to gravity. It is therefore advantageous if the application device has a pump for pumping active agent from the reservoir volume into the application volume.

The pumping can be performed thereby, that an elastic element in the reservoir volume or on the reservoir volume is compressed, thereby increasing the pressure in the reservoir volume and thus driving active agent into the application volume. Due to the customarily significantly larger dimensions of the reservoir volume than those of the application volume, such pumping is difficult to dose so that it can easily happen that the active agent is pumped too forcefully and unintentionally leaks out of the gaps. This problem can be countervailed if the pump is located between the reservoir volume and the application volume. Here, pumping quantities can be dimensioned small, so that, for example, with one pump stroke only a relatively small amount of active agent enters into the application volume. Unintentional heavy pumping can be countervailed easier.

Any suitable pumping means can be used. Particularly good dosing combined with an easy producibility can be achieved, however, if the pump has a pump element generating a pump output that is displaceable as mass moved through the active agent. Hereby, the pump output is advantageously achieved thereby, that the pump element displaces at least a part of the active agent as it moves through the active agent and the active agent is thereby pressed into the application volume as a result of this displacement.

It could be the case during pumping that suction is generated behind the pump element due to the previous displacement, which has the tendency of sucking the active agent out of the application volume again. Such a sucking out can be countervailed if the pumping is done in such a way that the application volume is held below the pump element and the reservoir volume is held above the pump element. Although there is displacement as a result of the motion of the pump element and suction is generated once again, as a result of the gravitational forces; however, an overall, downward pumping effect is created, i.e. into the application volume.

The pumping effect can further be reinforced if the application device is guided in a circular motion during pumping so that a centrifugal force acts upon the active agent and drives it outward. Hereby, the application device is advantageously held in such a way that this centrifugal force drives the active agent out of the reservoir volume into the application volume, reinforced or excited by the motion of the pump element in the active agent.

For achieving a good pumping effect it is advantageous if the pump element can be moved back and forth in lateral direction. Thus, it can be displaced parallel to the head line and thus along a laterally directed application volume, and fill such evenly.

Advantageously, the application device has a pump housing that is shaped in such a way that the pump output is achieved by a to and fro motion of the pump element at the pump housing.

Advantageously, the pump element is a sphere. In general, the pump element can also be a pendulum or be designed as another volume-displacing body for which, in particular, the vibrations generated by its motions can also be utilized.

Moreover, it is advantageous if the pump element and the pump housing are coordinated with each other in such a way that the pump element can roll on the pump housing.

Figure 64:
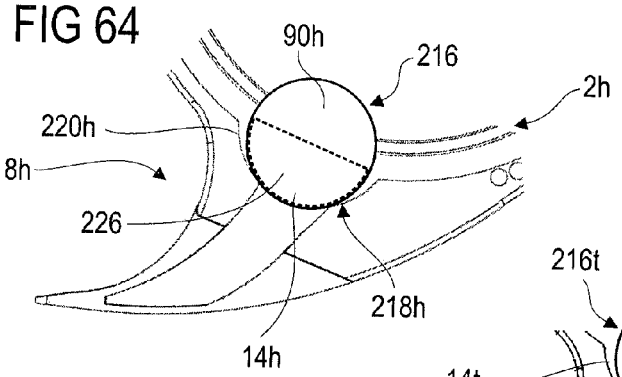
FIG. 64 through FIG. 66 shows three different pumps in various application devices.
Figure 65:
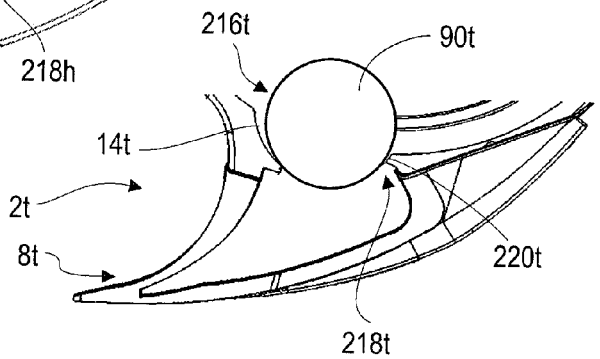
Figure 66:
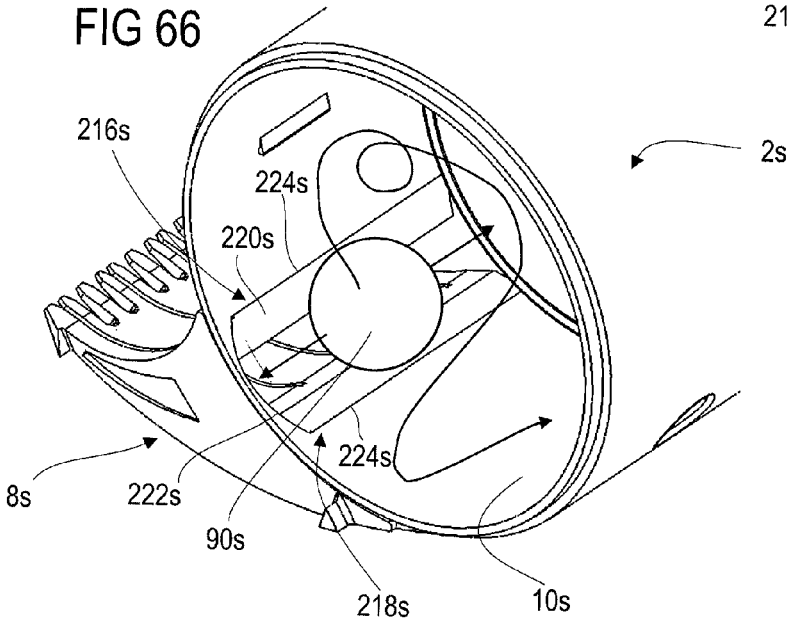

All of these details are illustrated by way of example in FIGS. 64 through 66. All three exemplary embodiments have a pump 216 with respectively one pump element 90 that is designed as a sphere. Pump element **90*h* is a metallic sphere, pump element 90*t* a ceramic sphere and pump element 90*s* has a surface irregularity that is at least as irregular as conventional printer paper. Pump element 90 is respectively located in intermediate volumes 14 and can roll on a pump guide 218, that has two guide tracks 220** extending parallel to each other.

If a pump guide with two guide tracks is present, it is advantageous when the rear guide track is smaller than the anterior guide track. Hereby, a particularly good pump output can be achieved in the rear area, as a result of which the active agent can be filled into the rear area particularly well. This is especially advantageous in an applicator with a rear convexity in the application volume, because that it where most of the active agent is used.

In the exemplary embodiments shown in FIGS. 64 and 65, pump element 90*h* runs on a pump guide 218*h* that has a relatively large surface very close to the surface of pump element 90*h*. If sphere 90*h* runs on such a guide, a large portion of active agent must be displaced through a small gap underneath the sphere, as a result of which friction increases and resistance is higher. This design is especially advantageous when using active agents with rather low viscosity. Hereby, it can be accomplished that the pump element does not already abut forcibly at the housing upon very small movements, but transmits the impression of a guided motion. This is advantageous with respect to feeling the pumping effect, i.e. the haptic during pumping, or when the application device is moved. Moreover, this rather ductile and braked motion transmits the feeling for doing the pumping correctly. However the greatest advantage is that due to the increased resistance, not too much active agent is not pumped too quickly or in spurts into the application volume, and dosing of the pumping can therefore be done with significantly more feeling than when pump element 90*h* forcibly abuts against the housing.

In contrast, pump guide 218*t* in FIG. 65 has a very small guide track 220*t* on one side. A small guide track is not only limited to one side, but can also be used on both sides. This embodiment is particularly advantageous when using highly viscous active agents. An embodiment such as that in FIG. 64, if used with highly viscous active agents, could have the effect that the sphere does not roll correctly on the pump guide, and instead slides through the active agent without guidance in the proximity of the pump guide. Thus, the pump output would be more uncontrolled and lower. As the result of a very small pump guide 220*t*, the pump resistance can be lowered so that pump element 90*t* moves pleasantly perceptible and secure and primarily, is capable of being dosed easily with active agent.

Generally speaking, it is advantageous if in a system having at least two application devices of which the first is provided for use with a first active agent and the second for use with a second active agent having a viscosity that is at least 20 Pa*s higher than the viscosity of the first active agent, the second application device has a pump guide with a guide track that is smaller than the guide track of a pump guide of the first application device.

In all three exemplary embodiments of FIGS. 64 through 66, pump element 90 is mounted in such a way that it can be removed from pump 216 and freely moved through reservoir volume 10. This is shown figuratively by the long arrow in reservoir volume 10*s* in FIG. 66.

It is especially advantageous if the housing around the reservoir volume has two engaging housing elements that jointly enclose the reservoir volume, whereby the housing element engaging toward the inside has an opening that connects the reservoir volume with the application volume in a corresponding position of the housing elements relative to each other, and the pump housing is designed in such a way that the pump element can be rolled laterally within the opening.

Advantageously, the housing is rounded outward lateral to the guide track, so that a lateral cut-out is created in the housing into which the pump element can roll. Such a cut-out 222*s* is shown by way of example in FIG. 66. In this way, a larger lateral arc of contact of pump element 90*s* is achieved, as a result of which a good pump output can be achieved.

Advantageously, the pump element is an element with a specific weight of at least 2.5 g per $cm^3$. Metal is especially suitable. Because of its high specific weight it can be avoided that the pump element floats on the active agent and thus renders the pump output insufficient. Advantageously, the pump element is made of ceramic, in particular, glass ceramic. Hereby, a very good chemical reliability can be achieved against aggressive active agents with a small and cost-effective manufacturing effort. For visual reasons, glass ceramic is especially advantageous. When the active agent is mixed in the reservoir, attention is not drawn too much to the movement of the pumping, but the operator will pay more attention to the active agent and observe its mixing, as glass ceramic is transparent and cannot be observed as easily as a metal sphere. Therefore, more concentrated attention will be paid to the mixing, thereby countervailing insufficient mixing. A good pumping output can be achieve if the pump element has a volume of at least 0.3 $cm^3$ In order to achieve a good pumping output it is advantageous when the pump element has a surface roughness that is at least as rough as conventional printer paper. To simplify the manufacture of such a pump element it is advantageous when the pump element has a surface coating on a base substance. The surface coating can be adjusted to the desired surface roughness.

Prior to applying the active agent to the hair it will normally be necessary to mix the active agent in the reservoir volume thoroughly. If the pump element is simultaneously a mixing element that can freely move through the reservoir volume, an additional mixing element can be dispensed with. Advantageously, the pump element is mounted relative to the reservoir volume in such a way that the reservoir volume can be moved from a pumping position in such a way that it reaches at least 85% of the reservoir volume. The narrower inner edges of the reservoir volume are thus designed in such a way that they consist of less than 15% of the entire reservoir volume.

Advantageously, a pump guide is available in such a way that the pump element is guided by it on two sides and can be rolled on it. In particular, the pump guide includes two parallel guide tracks.

Good pump output can be achieved if the pump guide permits a rolling movement of the pump element from one side of the reservoir volume all the way to the opposite side of the reservoir volume.

Advantageously, the reservoir volume includes a cut-out that forms a pump volume, whereby the pump element is designed in such a way that the active agent is pushed out of the pump volume into the application volume when the pump is activated. Alternatively, it is possible that the pump volume is located in an intermediate volume or a transition volume between the reservoir volume and the application volume. Advantageously, the pump guide is located in the cut-out. The profile of pump volume 226 is shown by way of example as a dotted line in FIG. 64.

It also contributes to a good pump output if the guide and the pump element are coordinated with each other in such a way that the pump element rolling on the guide, is at least primarily located in the cut-out, i.e. at least 50% of its volume is located in the cut-out.

Further, it is advantageous if the guide is formed by a separator element between the reservoir volume and the application volume. The separator element advantageously forms a constriction between the application volume and the reservoir volume. An undesired back-flow can be countervailed, because as a result of the location of the pump element on the separator element, it influences the pumping effect only to an insignificant degree.

It is advantageous, particularly in the case of active agents with high viscosity when the pump guide is formed by at least one edge in the transition from the reservoir volume to the cut-out. This edge 224*s* is shown by way of example in FIG. 66. Pump element 90*s* is thus to be conceived in such a way that it is so large that it rolls on the two edges 224*s* that are opposite each other. Pump element 90*s* must therefore be significantly larger than shown in FIG. 66.

It is further conducive for the manageability of the application device if the pump guides are angled at an angle of at least 60°, in particular, at least 80° relative to the direction of the tooth tips. Especially favorable is a parallel arrangement with the head line of the applicator.

An operator can perform a pumping motion especially easily, if the reservoir volume is at least substantially cylindrical and the pump guide runs parallel to the cylinder axis.

Advantageously, a pump volume is located between the reservoir volume and the application volume, whereby the pump is designed in such a way that upon a pumping motion, the content of the pump volume is at least partially pressed into the application volume. It is expedient when the pump volume becomes smaller in the direction of the application volume. Moreover, it is advantageous if the pump volume is bordered on both sides by a guide, on which a pump element can be rolled. The pump volume can be described as that volume through which the pump element rolls with that part that is facing the application volume. In the case of a sphere it is that volume that would pass to and fro in a sliding motion on the pump guide, whereby the half-sphere is directed toward the application volume.

It is further advantageous when the pump volume is limited by a concavely curved front wall and a concavely curved back wall. Advantageously, the two walls are between the reservoir volume and the application volume.

Moreover, it is advantageous if the pump volume has a linear shape and a constant pump profile throughout.

With respect to a good applicability of the application device in combination with application tightness, it is advantageous if the application volume flattens with increasing distance to the pump. With the same advantage, the wall thickness of the gap becomes thinner with increasing distance to the pump.

Alternatively or additionally, further pump mechanisms are advantageous. Thus, a connection channel between the reservoir volume and the application volume can be provided, in particular, when pumping while using an elastic deformation of the reservoir volume. The connecting channel advantageously reaches at least 3 mm into a transition volume between the reservoir volume and the application volume.

Figure 70:
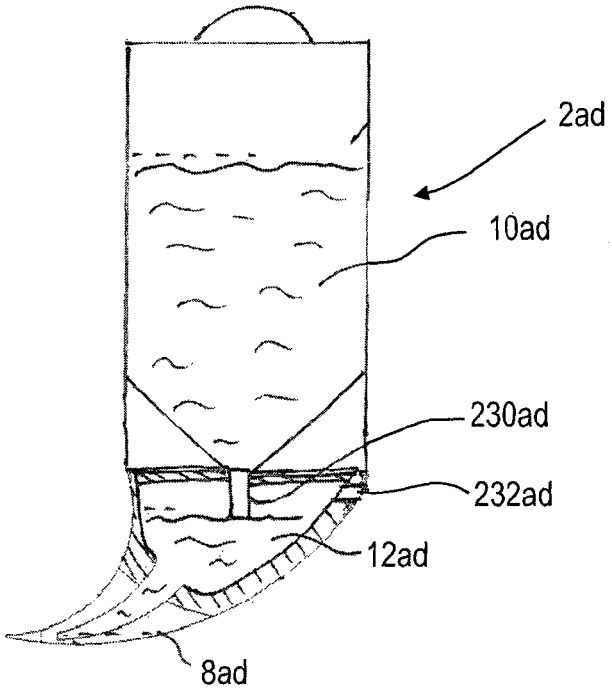
FIG. 70 and FIG. 71 shows applicators with an external reservoir volume.

This is shown by way of example in FIG. 70. The outlet of connecting channel 230*ad* in the transition volume is below the maximum upper interior height of the transition volume. Hereby an air space can be created above application volume 12*ad*. The air space is advantageously larger than the volume moved through connecting channel 230*ad* by a one-time, intended, maximum, manual pumping motion, preferably at least twice as large. The directional information "above" hereby relates to an applicator that is held downward, in particular, in such a way that the tooth tips form the lowest point of application device 2*ad*. In general, round cross sectional shapes are advantageous, but other cross sectional shapes are also conceivable, for example, rectangular or slot-shaped.

FIG. 70 depicts a corresponding embodiment of an application device 2*ad*, its reservoir volume 10*ad* communicating with the application volume 12*ad* through a connecting channel 230*ad*. The housing unit about the reservoir volume 10*ad* is embodied elastically so that it may be compressed using manual forces. Alternatively, a pump element, e.g. a pump ball, may be provided that causes pumping by squeezing and volume displacement. The volume that is displaced by a manual force of 10 N is advantageously less than 2 ml, preferably less than 1.5 ml, and particularly advantageously is between 3 ml and 0.2 ml. It is likewise possible to cause the displacement manually or electrically using additional volume-displacing components.

The fill height of the application volume 12*ad* is defined by the penetration depth of the connecting channel 230*ad* into the applicator 8*ad*. When the reservoir volume 10*ad* is released, application agent above the connecting channel 230*ad* is drawn back into the reservoir volume 10*ad*. Measured from the head line to the opening for the connecting channel into the application volume that is farthest away, the maximum fill height for the application volume is advantageously less than 35 mm and in particular is advantageously between 20 and 60 mm.

In principle it is also possible for reservoir volume 10*ad*, matched to the viscosity of the application agent, to be embodied hard in the manner already described in the foregoing. Gravity then causes the application means to exit. Overfilling the application volume 12*ad* is prevented in that there is no more aeration of the reservoir volume 10*ad* by the connecting channel 230*ad* when the unit is overfilled.

Another detail of the invention is the configuration of the connecting channel between the reservoir volume and the application volume. The volume of the channel is chosen to be small enough that the quantity of one dispensing stroke is greater than the volume of the connecting channel. What this achieves is that during dispensing application agent is reliably conducted from the reservoir into the application volume. In principle a plurality of connecting channels may also be provided, for instance in order to attain improved distribution of the application agent in the application volume.

The volume of the connecting channel or the cumulative volume of the connecting channels is advantageously less than 300 $mm^3$, preferably less than 100 $mm^3$, and particularly advantageously is between 1 $mm^3$ and 100 $mm^3$. The minimum through-opening for the individual connecting channel or channels is selected such that, at the given viscosity of the application agent, there is no independent, outflow of the application agent into the application volume, or the independent outflow is only minor, since the application volume closes off the through-opening and the reservoir volume cannot be aerated by the connecting channel. The through-opening for the individual connecting channel or channels is advantageously less than 30 $mm^2$, preferably less than 20 $mm^2$, and particularly advantageously is between 1 $mm^2$ and 20 $mm^2$.

It is particularly advantageous when one or a plurality of venting openings, e.g. a venting opening 232*ad* shown FIG. 70, are present in the transition volume above the lower end of the connecting channel. What this can achieve is that no internal pressure occurs in the application volume when the application agent is being fed from the reservoir volume into the application volume.

The total opening width for the venting openings is advantageously greater than 0.5 $mm^2$, preferably greater than 1 $mm^2$ ml, and particularly advantageously is between 0.5 $mm^2$ and 3 $mm^2$. The inner width or the diameter of possible openings is limited so that when the applicator is tilted during use the active agent does not exit through the venting openings. The maximum width of the one or plurality of venting openings, shown as the diameter of a cylindrical body that can be inserted into the opening, is advantageously less than 1.5 mm, preferably less than 1 mm, and particularly advantageously is between 0.01 mm and 3 mm.

Using the depicted arrangement of the reservoir volume above the application volume, and the arrangement of the connecting channel such that an air space is created above the active agent, that is, between the active agent in the reservoir volume and the active agent in the application volume, and in particular using the venting opening, it is possible for the volume displacement in the reservoir volume and for gravity to feed the active agent into the application volume, and for the release movement and the associated increase in volume in the reservoir volume for the excess application agent that is located up to the discharge opening of the connecting channel or thereover, to be drawn back into the reservoir volume. In principle it is also possible for the filling and drawing back of excess application agent during release to occur using two separate connecting channels that are both opened and closed by check valves.

This effects a largely constant fill quantity in the application volume, without producing excess pressure during filling.

In FIG. 70, the venting opening 232*d* is added in above the application volume to prevent pressure from building up in the application volume. It is arranged such that as a rule active agent does not cover it during use.

Figure 71:
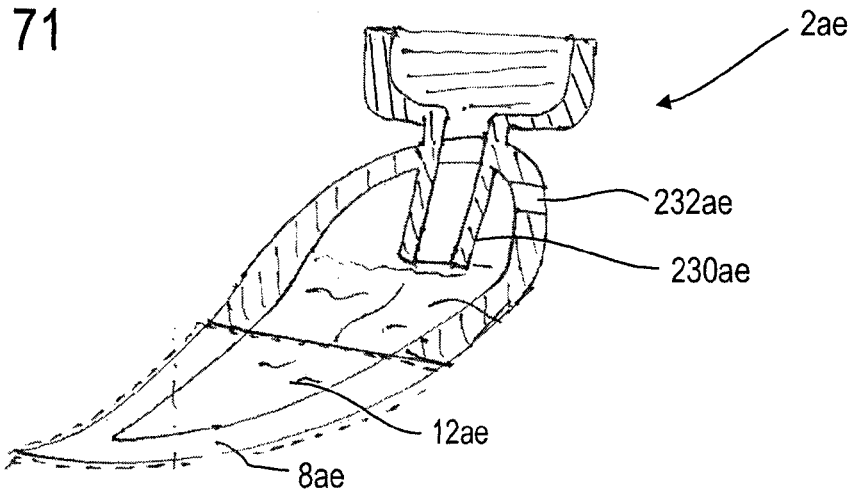

FIG. 71 depicts another embodiment of an application device 2*ae* in which only the applicator 8*ae* is shown. In this case, the applicator 8*ae* may be coupled to the housing unit of the reservoir volume by a threaded connection 234*ae*. Alternatively, other types of connections are also possible, such as e.g. a bayonet joint or snap connection.

FIG. 4 depicts another embodiment of an application, in this case only the housing unit application volume 32*b* being shown. In this case, the housing unit application volume may be coupled to the housing unit reservoir volume using a threaded connection. The connecting channel in this case is designed such that the volume of the connecting channel is smaller than the volume that is displaced by actuating a pump element or that is displaced by squeezing the bottle. What this achieves is that air that is disposed in the connecting channel is pressed out and application agent can be fed. The cross-sectional surface area is selected such that the application agent is prevented from exiting independently and such that no air can enter the reservoir volume/bottle and nothing escapes because of the resultant vacuum.

One additional advantageous embodiment of the invention provides that the applicator has a comb-like structure with at least two gaps and at least one separating element that is arranged between the at least two gaps and that is embodied as a tooth, at least part of the housing embodying the at least one separating element and delimiting the application volume into which the at least two gaps transition.

The housing, which may also be called a housing unit, advantageously has in at least one area of the at least one tooth a wall thickness that is less than 2.0 mm. Using this embodiment, it is possible to provide a housing by means of which particularly advantageous wetting with the active agent may be attained, it being possible in particular using the wall thickness of the housing to ensure that the hairs or fiber-like materials are wetted with the active agent across nearly their entire length. An active agent may be construed to be a liquid, paste, or powder agent, especially a hair dye agent, hair treatment agent, hair gloss, dispersions, agent for structural change, and/or pharmaceutical hair treatment that is provided for application to hair. The active agent may in principle be embodied as a single-component agent or a multi-component agent. "Single component agent" shall be construed to mean an agent that is stored ready to use in the active agent container. "Multi-component agent" shall be construed in particular to mean an agent in which at least one component is added to another prior to application, especially an agent that has two separately stored components that are provided for being mixed with one another for a specific use. "Gap" shall be construed to mean in particular an intermediate space between two teeth that is provided for collecting hairs to which the active agent is applied. For creating the gap, the applicator preferably has a plurality of teeth, most of which include at least one tip, that define the spikes of the comb-like structure.

"Application volume" shall be construed in particular to mean a volume for accommodating and storing the active agent and from which the active agent is applied directly to hairs or other fiber-like materials. In this context, "transition" shall be construed to mean in particular that at least one part of the gap is embodied as part of the application volume, so that an active agent added to the application volume fills the gap. The application volume is preferably at least one milliliter in size and with particularly advantageously has a size of several milliliters. Furthermore, a "wall thickness in the range of the at least one tooth" shall be construed to mean a wall thickness of the housing, which wall thickness has the housing in the area of the applicator into which the hairs are collected. "Provided" shall in particular be construed to mean specially programmed, equipped, and/or designed.

It is furthermore suggested that the housing, in the at least one area in which the wall thickness is less than 2.0 mm, embodies at least one contact surface that is provided for support on an application surface having fiber-like materials. Especially during use on hairs, this can attain particularly advantageous wetting that extends down to the roots. "Contact surface" shall be construed in particular to mean a surface area of the housing that is positioned in a planar manner during proper use of the application device on the application surface, which may be embodied for instance as the scalp. In principle the contact surface may be structured, such as for instance fluted, in order to save plastic. In such cases, the contact surface shall be construed to be a type of envelope surface of the structural surface. For a "wall thickness less than 2.0 mm" in the area of the contact surface, it shall in particular be understood that the wall of the application volume that is embodied by the housing, in at least one area in which the wall embodies the application surface, has this wall thickness. Dimensions that are provided with a unit of length in the description shall be construed here and in the following with a precision at which the given decimal point deviates by at most one point, that is, 2.0 shall be construed as 2.0±0.1.

In one advantageous embodiment, in at least one area the housing has a wall thickness that decreases along the use direction. This makes it possible to realize particularly advantageous wetting. "Use direction" shall be construed to mean in particular a direction along which the application device is guided during use. The gaps preferably open along the use direction, i.e. the use direction is advantageously oriented by a base line of the gaps towards a head line of the gaps. A "head line" shall be construed to be in particular a virtual connecting line that connects the tips of adjacent teeth to one another. "Base line" shall be construed to be in particular a connecting lines between points on adjacent gaps at which these gaps terminate.

In one particularly advantageous embodiment, in at least one area of the contact surface the housing has a wall thickness that is less than 1.0 mm. This can improve wetting. The wall thickness of the housing is preferably less than 1.0 mm only in some areas and is greater than 1.0 mm in other areas.

It is furthermore suggested that the gap have a structural a width that is smaller than a barrier width from which the active agent independently escapes from the gaps. This can prevent continuous, undesired escape of active agent, so that the application device is particularly simple to operate. In particular, this can prevent excess active agent from being applied to the scalp, which advantageously makes it possible to reduce toxic loading of the scalp with active agent, in particular to nearly zero. "Width of the gaps" shall be understood in particular to a distance between two opposing walls of the teeth, i.e. the distance that each of the teeth has. A "barrier width" shall be construed to be in particular a gap width that may have a gap at the corresponding location, without the active agent escaping from the gap at a pressure that corresponds to a liquid gap of the active agent of 5 centimeters. The active agent preferably merely penetrates part way in an area between walls of the gap because of this, a penetration depth of less than 90% of the wall thickness being in this sub-area.

The barrier width is thus a function in particular of structural features of the gap, such as for instance gap geometry, wall thickness, allocation of lateral surfaces to one another, edge contours, gap width, surface quality, and the like, as wells a properties of the active agent, such as for instance adhesive force, cohesive force, frictional force, viscosity, capillary force, flow resistance, pressure, streams, and/or temperature. The structural width of the gaps is therefore adapted to the active agent used with the application device, so that the structural width of the gaps is less than the barrier width. The gaps may have different gap widths depending on the active agent used. In principle it is also possible to provide the separation device with an adjusting element for adjusting the gap width and/or the opening width of the gaps.

It is particularly preferred that the width of the gaps is significantly smaller than the barrier width at least in one area of the contact surface. What this can achieve is that the gap in this sub-area in the area of the wall is merely partially filled with the active agent, so that it is possible to prevent, with good reliability, active agent from escaping. "Significantly" shall be construed to mean in particular that in one area of the contact surface the active agent merely penetrates somewhat into an area between the walls of the gap, penetration depth being less than 70% of the wall thickness, advantageously less than 60% of the wall thickness, and particularly preferred less than 50% of the wall thickness.

It is furthermore suggested that the at least one tooth have an average width that is less than 4 mm. In this way it is possible to provide an application device that covers an advantageously large number of hairs. "Width" shall in particular be construed to mean a dimension of one single tooth in a direction parallel to a transverse extension, and "average width" shall be construed to mean a width that that has been averaged for a length of the individual tooth. The width of the at least one tooth is preferably in a range of 0.2 to 4.0 mm, a range of 0.2 to 2.5 mm being advantageous, and a range of 0.2 to 2.0 mm being particularly advantageous. The height of the at least one tooth, especially in the area of the head line, is preferably less than 1 mm. In the area of the head line the teeth advantageously have a cross-sectional surface area that is less than 3 $mm^2$, preferably less than 1 $mm^2$, and particularly advantageously less than 0.5 $mm^2$. "In the area of the head line" shall be construed to mean especially an area between the head line and a cross-sectional plane that is disposed 0.5 mm behind the head line. The length of an individual tooth, i.e. a distance between the head line and the base line, is advantageously more than 10 mm, preferably more than 15 mm, and particularly preferred between 15 mm and 40 mm.

It is furthermore suggested that the gaps have an individual gap volume greater than 4 $mm^3$ and less than 40 $mm^3$. This makes it possible to achieve a particularly advantageous color, especially for hairs. "Individual gap volume" of a gap shall be construed to mean in particular a sub-volume of the application volume that is disposed between two opposing teeth. The individual gap volume of a gap is thus in particular the sub-volume of the gap in which hairs or other materials added to the gap may move freely. The individual gap volume is advantageously less than 40 $mm^3$, 7 $mm^3$ to 35 $mm^3$ being advantageous and 10 $mm^3$ to 30 $mm^3$ being particularly advantageous.

The contact surface is advantageously convex in at least one area along an application direction. Because of this the application device can be advantageously guided simply along the application surface.

In one particularly advantageous embodiment, the gaps have a base surface that with the contact surface forms an acute angle. What this can achieve is that in particular hairs can be moved towards the application surface when the application devices is guided through them so that in particular it is assured that the active agent can reliably coat. "Base surface" of a gap shall be construed to mean in particular a surface area by which the gap is limited in its depth, i.e. a surface area that defines the maximum insertion depth for a hair into the gap. "Acute angle between the contact surface and the base surface" shall in particular be construed to mean that an angle that is formed by the base surface of the gap and the contact surface of the housing is less than 90 degrees.

The housing preferably has a top side that faces away from the contact surface and has a smaller depth along the at least one of the gaps than along the contact surface. This causes the base to be inclined towards the use direction, so that a particularly advantageous passage through the hair can be achieved. "Depth of a gap along the top side or bottom side" shall be construed in particular to mean a distance between the common head line and the base line that the gap has along the top side or bottom side. In principle the housing may be embodied in multiple parts.

In addition, it is suggested that the top side of the housing have an average radius of curvature that is smaller than a mean radius of curvature of the contact surface. What this can achieve is that the teeth taper towards the use direction and the application device is particularly easy to handle. The average radius of curvature for the contact surface and/or the average radius of curvature for the top side are preferably in a range between 15 mm and 80 mm, a range between 20 mm and 65 mm being advantageous and a range between in particular 25 mm and 55 mm being particularly advantageous.

In addition it is advantageous when at least some of the gaps have a different average depth in at least one operating mode. What this can achieve is that a different color may be attained for different hairs, so that overall a more uniform color appearance may be attained. "Average depth" shall be construed in particular to mean a depth that is averaged across an entire height of the at least one gap.

In addition, a hair root dyer is suggested that has an application device with an applicator that has a comb-like structure with at least two gaps and at least one tooth arranged between the at least two gaps, and with a housing that delimits at least one application volume into which the at least two gaps transition, and that embodies at least one contact surface that is provided for placing on an application surface that has the fiber-like materials, in particular with an inventive application device.

Figure 74:
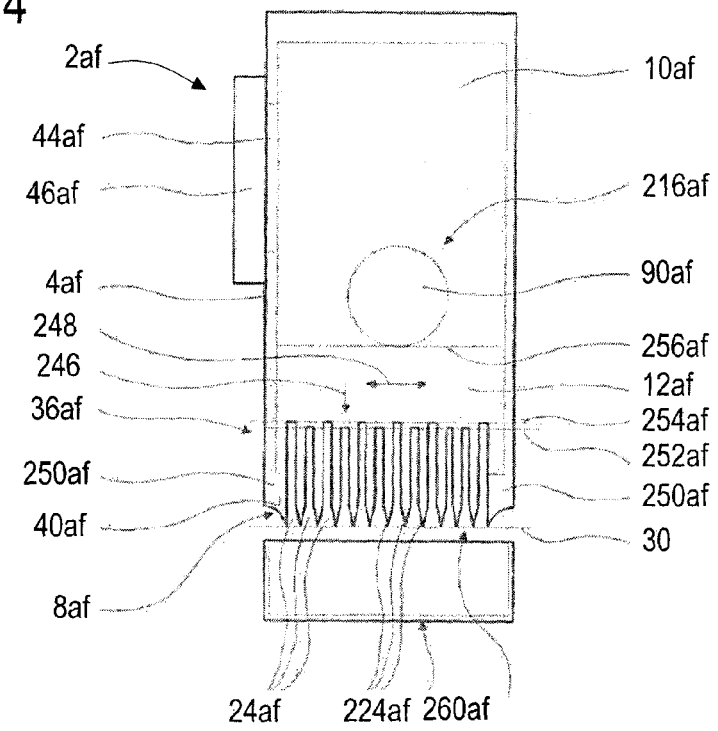
FIG. 74 and FIG. 75 shows schematized further exemplary embodiments of application devices according to the invention that are not shown according to scale.
Figure 75:
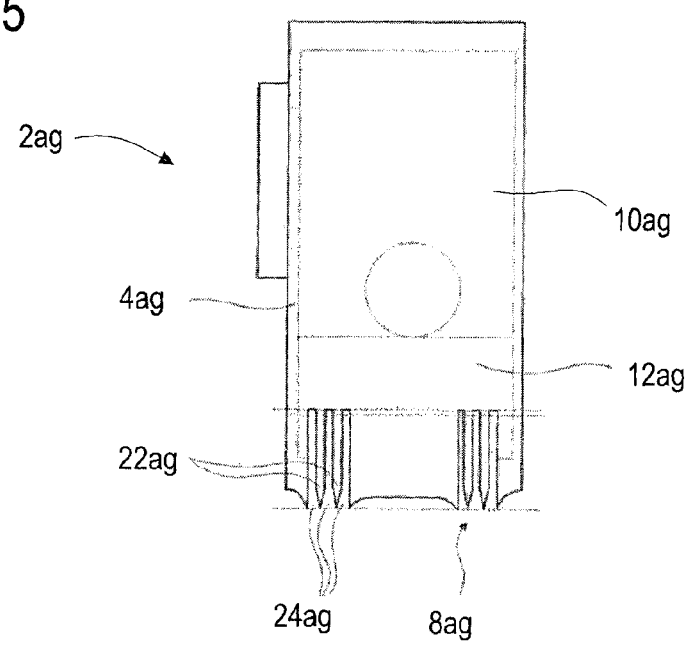

The inventive details are illustrated in FIGS. 74 and 75.

FIG. 74 is a diagram of an inventive application device 2*af* embodied as a hair root dyer and having an applicator for applying an active agent to hair. The application device is provided for private use and for profession employment. A variety of different active agents, such as for instance hair dye agents, hair treatment agents, hair gloss, dispersions, structure modification agents, and/or other pharmaceutical hair treatment agents, may be applied to the hair by means of this application device. The application device is provided in particular for use on hair on the heads of human beings. In the present application, the active agent is embodied as a hair dye agent, "hair dye agent" being construed to mean all agents that are provided for changing the shade of hair, such as in particular semi-permanent hair dye agents. The application device is not limited to use with hair. Although in the following exemplary embodiment the use described is for hair on a scalp, this may be analogously replaced by use on any desired fiber-like and/or hair-like materials that are arranged on any application surfaces.

The application device 2*af* is in particular embodied as a hair dye agent application device. The application device is provided for wetting hair guided through it as completely as possible with active agent. The hair root dyer is embodied as an all-over dyer, which means that essentially all of the hairs that are disposed within the comb structure are wetted with the active agent. The application device is provided for wetting the hairs with the active agent only in the root area, across some of their length, or across virtually their entire length. The application device simultaneously prevents the scalp from being wetted with the active agent. A length starting from the scalp along which the hairs remain untreated is less than 1 mm.

For separating the hairs and for applying the active agent, the application device 2*af* includes an applicator 8*af* that has a comb-like structure. The applicator 8*af* includes a plurality of gaps 24*af* and a plurality of teeth 22*af*. The teeth 22*af* are each arranged between two adjacent gaps 24*af*. The application device further 2*af* further includes a housing 4*af* that embodies the applicator 8*af*. The housing 4*af* delimits an application volume 12*af* into which the gaps 24*af* transition. The housing 4*af* further embodies a contact surface 36*af* that is provided for contacting the application surface, which in this exemplary embodiment is embodied by the scalp. In principle the inventive application device 2*af* may be used to apply almost any desired liquid or paste active agent to any desired fiber-like or hair-like materials that are arranged on an application surface.

The application device 2*af* has an application direction 246 along which it is passed when the active agent is being applied through the hair. The teeth 22*af* of the applicator 8*af* embody the comb-like structure. The teeth 22*af* have a main extension direction that is essentially parallel to the application direction 246. The teeth 22*af* are arranged adjacent to one another along a transverse extension 248*a* that is perpendicular to the application direction 246.

The applicator 8*af* furthermore has two outer edge elements 250*af* that merely delimit one of the gaps 24*af* on one side. The teeth 22*af* are arranged along the transverse extension 18*a* between the two edge elements 250*af*. The two edge elements 250*af* each have a flank that laterally delimits one of the two outer-most gaps 24*a*. The teeth 22*af* each include two flanks, each of which laterally delimits two adjacent gaps 24*af*. In this exemplary embodiment, the flanks of the teeth 22*af* and the edge elements 250*af* run almost parallel to the application direction 246. In principle, however, it is also possible for the gap widths to vary over their course or to be different for different gaps 24*af*. Likewise, the widths of the teeth 22*af* may vary. In the arrangement of the edge elements 250*af* and teeth 22*af* along the transverse extension 18*a*, the flanks of the teeth 22*af* oppose one another in pairs, i.e. the flank of the adjacent edge element 250*af* or tooth 22*af* opposes the flank of one of the teeth 22*af* or of one of the edge elements 250*af*. In principle it is also possible for the flanks of the teeth to be embodied non-parallel. This makes it possible to influence a barrier width and to influence how the individual gaps 24*af* to collect and/or guide hair. In addition, a stroke through the hair may be influenced if for instance the gap contour of the top side is crossed compared to the gap contour of the bottom side.

The opposing flanks of the teeth 22*af*, among which the edge elements 250*af* shall be included in the following, each span an intermediate space. The intermediate spaces that are spanned by the opposing pairs of flanks form the gaps 24*af*. All of the gaps 24*af* that are formed by the teeth 22*af* begin at a common head line 30. However, in principle it is also possible for some of the gaps 24*af* not to begin at a common head line 30 and/or not to terminate at a common base line. In order to attain a more uniform shade for the hair, the gaps 24*af* terminate at different base lines 252*af*, 254*af*. In the exemplary embodiment depicted, the gaps 24*af* terminate at the two different baselines 252*af*, 254*af* that are offset parallel to one another. In principle, however, it is also possible for the application device 2*af* to have three or more base lines.

Thus, starting from the head line 30 the gaps 24*af* have at least one different length. It is in particular possible for the application device 2*af* to have an adjusting unit that is provided for adjusting the length of the gaps 24*af*. Regardless of the rest of the design of the application device 2*af* it is also in principle possible to have a design in which all of the gaps 24*af* are equal in length. The adjusting unit may then be provided for changing the length of all of the gaps 24*af* simultaneously. However, it is also possible for the adjusting unit to be provided for changing the length of only some of the gaps 24*af*, in order for instance to selectively set the same or different lengths for the gaps 24*af*.

The gaps 24*af* have different depths along the contact surface 36*af*, which is embodied by a bottom side of the housing 4*af*, and along a top side 40*af* of the housing 4*af*. The gaps 24*af* each have a base surface that forms an acute angle with the contact surface 36*af*. When all of the gaps 24*af* are the same length, the base surfaces of the gaps 24*af* may be described by a single surface having a width that is equal to the width of the applicator 8*af*. The base surfaces are defined by a course of the base lines 252*af*, 254*af* on the bottom side of the housing 4*af* and by a course of the base lines 252*af*, 254*af* on the top side 40*af* of the housing 4*af* of the corresponding gap 24*af*. The base surface of the individual gaps 24*af* may thus be described as a surface that is essentially the maximum depth that a hair may pass into the gap 24*af*.

Proceeding from the bottom side, the base surfaces of the gaps 24*af* are inclined towards the application direction 246. The length of the gaps 24*af* along the top side 40*af* is shorter than the length of the gap along the contact surface 36*af*. The acute angle that the base surfaces form with the contact surface 36*af* opens towards the application direction 246. The angle that the contact surface 36*af* forms with the base surfaces is approx. 20° to 85°, advantageously 25° to 70°, particularly advantageously 35° to 60°.

The teeth 22*af* have a mean width that is less than 4 mm and greater than 0.2 mm. The teeth 22*af* all have essentially the same width. During a pass, the teeth 22*af* are each provided for guiding the hairs in one of the two adjacent gaps 24*af* so that all or at least nearly all of the hairs that are arranged in the area of the applicator 8*af* move into one of the gaps 24*af* during a use. The teeth 22*af* are embodied prong-like and have a tip that separates the hairs as they pass and move them into one of the adjacent gaps 24*af*.

In the exemplary embodiment illustrated, the width of the teeth 22*af* is approx. 1.5 mm over nearly its entire length so that the mean width is also approx. 1.5 mm. A suitable width is less than 4.0 mm, advantageously less than 2.5 mm. A width of 1.8 mm to 0.2 mm is particularly advantageous. The teeth 22*af* are embodied tapered to a point only in the area of the head line 30. A height or depth of the teeth 22*af*, which may be defined by a notional line perpendicular to the contact surface 36*af*, increases continuously across the entire length of the teeth 22*af*. In the area of the head line 30 the teeth 22*af* have a height of less than 1 mm. In a cross-sectional plane that is disposed 0.5 mm behind the head line 30 the teeth 22*af*, each with a height of approx. 0.6 mm and a width of approx. 1.5 mm, have a cross-sectional surface area of approx. 0.9 $mm^2$. The cross-sectional surface area decreases towards the head line 30. The cross-sectional surface area increases towards the base lines 252*af*, 254*af*. This cross-sectional surface area on the head line is in particular less than 3 $mm^2$, advantageously less than 1 $mm^2$, and particularly advantageously less than 0.5 $mm^2$.

The bottom side, which embodies the contact surface 36*af*, and the top side 40*af* of the housing 4*af* run together at an acute angle at the head line 30. The bottom side, which embodies the contact surface 36*af*, is provided for being placed onto the application surface, which in one design as a hair application device is embodied as the scalp. The top side 40*af* faces away from the application surface and thus also from the contact surface 36*af*. The contact surface 36*af* and the top side 40*af* are in part embodied by the teeth 22*af*.

Some of the application volume 12*af* into which the gaps 24*af* transition is partly enclosed by the teeth 22*af* that are embodied by the housing 4*af*, i.e. the teeth 22*af* form a part of one wall that delimits the application volume 12*af*. In this exemplary embodiment, the application device merely has the application volume 12*af*. In principle, however, it is also possible for the application devices to include a plurality of application volumes that are preferably arranged adjacent to one another along the transverse extension 248. The teeth 22*af* delimit the application volume 12*af* merely in one area facing the head line 30 and in this area form part of the contact surface 36*af*. The rest of the contact surface 36*af* is embodied by the housing 4*af*, which in this area also embodies part of the wall of the application volume 12*af*. In addition, the application volume 12*af* is delimited by the top side 40*af* of the housing 4*af*. The housing 4*af* is produced integrally, at least in the area of the applicator 8*af* and the application volume 12*af*, from a preferably transparent plastic. In principle, however, a multi-part design of the housing 4*af* is also possible.

In this exemplary embodiment, the contact surface 36*af* and the top side 40*af* are curved, at least in areas. The contact surface 36*af* is convex. The top side 40*af* is concave. The top side 40*af* has a mean radius of curvature that is smaller than a mean radius of curvature that the contact surface 36*af*, and thus the bottom side, has, at least in the area of the contact surface 36*af*. The mean radius of curvature for the contact surface 36*af* is approx. 40 mm. The contact surface 36*af* may also be embodied flat in some areas. The mean radius of curvature of the contact surface 36*af* is greater than the mean radius of curvature of the top side 40*af*. The teeth 22*af* thus have a shape that tapers to a point towards the application direction 246.

During use, the contact surface 36*af* is placed onto the scalp and passed through the hair in a crochet-like movement, i.e. a movement that includes a tilting and a linear movement. The applicator 8*af* thus exerts a tensile force on the hairs guided through the gaps 24*af*. The application device 2*af* is guided along the scalp by means of the contact surface 36*af*. The curvature of the contact surface 36*af* defines the tilt movement.

The application direction 246 for the application device is defined by tangents to the contact surface 36*af*. The user may guide the application device linearly along the application surface along this application direction 246. The preferred application direction 246, which is always used as reference, should be established by an area of the contact surface 36*af* that is directly adjacent to the first base line 252*af*. In principle a user may guide the application device, especially according to the desired resulting color, along any desired directions that run tangential to the application surface 36*af*.

Within the housing 4*af*, the application volume 12*af* extends in particular across an area in which the housing 4*af* embodies the teeth 22*af* and in which the gaps 24*af* are thus also arranged. The application volume 12*af* is embodied as a volume spanned by the housing 4*af* and in which the active agent is stored immediately before it is applied to the hair. The application volume 12*af* has a width that is essentially equal to a width of the applicator 8*af*. In principle, however, there may also be a plurality of application volumes. The application volume 12*af* is delimited laterally by the edge elements 250*af*. Since the gaps 24*af* transition into the application volume 12*af*, a hair that is moved into one of the gaps 24*af* also engages in the application volume 12*af*.

In a cross-sectional plane that runs perpendicular to the transverse extension 18*a* the housing 4*af* has an inner contour that follows an outer contour, especially in the area of the teeth 22*af*. In the area of the teeth 22*af*, the housing 4*af*, which forms a wall for the application volume 12*af*, has a wall thickness that is less than 5.0 mm. At least the part of the housing 4*af* that forms the contact surface 36*af* has the wall thickness of less than 5.0 mm. The wall thickness in this exemplary embodiment is greater than 0.4 mm.

The housing 4*af* has different wall thicknesses proceeding from the base lines 252*af*, 254*af* towards the head line 30. The wall thickness is at its thickest in the area of the base lines 252*af*, 254*af* and decreases continuously along the application direction 246 towards the head line 30. A creep distance, i.e. a distance that the active agent must cover in order to be able to exit from the gap 24*af*, is thus greater in the area of the base lines 252*af*, 254*af* than at a front end of the teeth 22*af* that faces the head line 30. Due to the wall thickness, which compared to the head line 30 is enlarged, the gaps 24*af* set an elevated exit resistance against the active agent in the area of the base lines 252*af*, 254*af* compared to the forward end of the teeth 22*af*. The wall thickness of the housing 4*af* is approx. 4.0 mm in the area of the base lines 252*af*, 254*af*. The wall thickness is less than 1.00 mm in the area of the head line 30. In this exemplary embodiment the wall thickness at the thinnest point is 0.44 mm. In principle wall thicknesses down to film thickness, i.e. a few micrometers, are possible.

The inner contour of the housing 4*af*, which delimits the application volume 12*af*, essentially follows the outer contour of the housing 4*af*. One part of the inner contour, which together with the bottom side delimits a lower part of the housing 4*af*, is concave. One part of the inner contour, which together with the top side 40*af* delimits a top part of the housing 4*af*, is convex. The convex part of the inner contour has a larger curvature than the concave part of the inner contour. The application volume 12*af* has a cross-section that has a continuously decreasing height proceeding from the base lines 252*af*, 254*af* towards the head line 30. The wall thickness of the housing 4*af* is thus at most approx. 5.0 mm, in particular in the area of the teeth.

The flanks of the teeth 22*af* have a triangular structure. Proceeding from the tips, the flanks each have an upper wall, also called the upper leg, and a lower wall, also called the lower leg. The upper leg of the flank forms the top side 40*af*. The lower leg forms the contact surface 36*af*. The top side 40*af* and the bottom side thus form a part of the wall of the application volume 12*af*. The hairs moved into the gaps 24*af* thus intrude into the application volume 12*af* that Is partly enclosed by the teeth 22*af*. The application volume 12*af* and the gap 22*af* transition into one another in one area. The area in which the gaps 24*af* transition into the application volume 12*af* extends from an area behind the head line 30 towards the base lines 252*af*, 254*af*. At least some of the teeth 22*af* may be embodied as hollow elements. The teeth 22*af* have a width of approx. 0.3 mm.

An effective gap width for the individual gaps 24*af* is less than 1 mm across the entire depth of the gap 24*af*. The opening width that the gaps 24*af* have at the head line 30 is greater than the gap width. In the area of the head line 30 the opening width transitions continuously into the effective gap width. The opposing flanks of adjacent teeth 22*af* run essentially parallel to one another. In this exemplary embodiment, gap widths between 0.1 mm and 0.65 mm are possible for the gaps 24*af*, the selected gap width of approx. 0.3 mm to 0.4 mm being particularly advantageous. In principle the gap width may also be less than 0.4 mm, however.

The depth of the gaps 24*af* is at least 10 mm. In principle good wetting of the hairs with the active agent may be attained with a depth of 10 mm to 20 mm. For particularly advantageous wetting, the depth in the depicted exemplary embodiment is greater than 20 mm. In this exemplary embodiment, the depth of the gaps 24*af*, which is equal to the length of the teeth 22*af* along the application direction 246, is approx. 25 mm. The gaps 24*af* thus each have an individual gap volume that is approx. 15 $mm^3$ to 25 $mm^3$.

The gap width for the gaps 24*af* is less than a barrier width from which the active agent is prevented from exiting due to adhesion forces. The active agent has a surface tension caused by the adhesion forces. In the area in which the gaps 24*af* and the application volume 12*af* transition into one another, the gap width of the gaps 24*af* is so small that properties of the active agent, such as for instance surface tension, adhesion, and cohesion, prevent the active agent from exiting from the application volume 12*af* during non-use, i.e. in particular during an interruption in application.

The barrier width of the gaps 24*af* is a function of the structural design of the gap 24*af* and in particular of the wall thickness of the housing 4*af*. The greater the wall thickness of the housing 4*af* is in an area, the greater the barrier width is in this area, as well. The housing 4*af* has the thinnest wall thickness on the contact surface 36*af*, in the area of the head line 30. The wall thickness of the housing 4*af* increases steadily along the contact surface 36*af* toward the base lines 252*af*, 254*af*. The gap width of the gaps 24*af* is approximately equal to the barrier width in the area of the head line 30. The hairs are therefore wetted nearly down to the scalp because of this. In the rear area of the contact surface 36*af*, that is, in the area of the contact surface close to the base lines 252*af*, 254*af*, the width of the application gaps 24*af* is significantly smaller than near the head line 30. A barrier effect is therefore greater near the base lines 252*af*, 254*af* than in the area of the head line 30. The hairs are therefore provided with the active agent essentially in their upper area towards the hair tips in the area of the base lines 252*af*, 254*af*.

The application volume 12*af* occupies only a portion of the volume spanned by the housing 4*af*. In addition to the application volume 12*a*, the application device includes a reservoir volume 10*af* that communicates with the application volume 12*af*. The reservoir volume 10*af* occupies a portion of the housing 4*af* that is adjacent to the applicator 8*af*. The portion of the housing 4*af* that the reservoir volume encloses is configured as a handle. The application device is provided for single-hand use. A user who wants to pass the application device through hair grasps the housing 4*af* in the area in which the reservoir volume 10*af* is arranged. The reservoir volume 10*af* is between 20 mL and approx. 100 mL. Overall the application device in this exemplary embodiment is provided for holding approx. 30 mL of active agent.

The housing 4*af* is embodied from a dimensionally stable plastic. The shape-stable housing 4*af* prevents the active agent from being pressed out via the gaps 24*af* during use, especially when the housing 4*af* is grasped by the user. The housing 4*af* is embodied rigid, at least in this area.

The reservoir volume 10*af* and the application volume 12*af* are fluidically decoupled from one another, at least in part. A separator element 256*af* is arranged between the reservoir volume 10*af* and the application volume 12*af*. In an area in which the reservoir volume 10*af* is adjacent to the application volume 12*af* the inner contour of the housing has a narrowing through which the active agent, due to its adhesion forces, is able to flow only in certain conditions. In the exemplary embodiment depicted, the inner contour of the housing 4*af* has two opposing shoulders that form the narrowing. In this exemplary embodiment the two opposing shoulders are approx. 5.0 mm from one another.

The narrowing forms a through-opening. The active agent can flow through the through-opening from the reservoir volume 10*af* into the application volume 12*af*. In this exemplary embodiment the through-opening has a slit-like shape. Perpendicular to the transverse extension 248 the through-opening has an extension that corresponds to the distance between the two shoulders. Parallel to the transverse extension 248 the through-opening has an extension that is significantly longer than the extension perpendicular to the transverse extension 248. The extension of the through-opening parallel to the transverse extension 248 is longer than 1 centimeter. In the exemplary embodiment depicted, it is approx. 2.5 centimeters. In principle the through-opening may also have a different shape. In particular it is also possible to have a design with a plurality of adjacently arranged through-openings, for instance in the form of bores.

In order to feed the active agent from the reservoir volume 10*f* into the application volume 12*af* or at least to support independent filling of the application volume 12*af*, the application device includes a pump unit 216*af*. The pump unit 216*af* includes a movable pump element 90*af* that is provided in order to effect a turbulent flow or vibrations, at least in the area of the separator unit 256*af*. The pump element 90*af* is movably attached to the reservoir volume 10*af*. The pump element 90*af* is embodied as a ball. The ball has a diameter that is greater than the extension of the through-opening perpendicular to the transverse extension 248. Thus the pump element 90*af* cannot travel through the through-opening from the reservoir volume 10*af* into the application volume 12*af*. In principle the pump element 90*a* may also be embodied as a pendulum or as a different mass body that displaces volume and whose vibrations, which are produced by its movement, may be used.

The pump element 90*af* is manually operable using its free mobility. The pump element 90*af* is moved using a movement of the housing 4*af*, for instance a shaking movement. The pump element 90*af* thus embodies a mixing element. A movement and/or vibrations of the pump element 90*af* in the reservoir volume 10*af* excite a turbulent stream in the reservoir volume 10*af*, which stream mixes the active agent. The pump element 90*af* is moved by a user who moves the housing with a shaking movement. Thus it is possible to perform a mixing process, especially a mixing process of a multi-component agent, inside the housing 4*af*.

Alternatively, the pump unit 216*af* may also be embodied to be driven by something. In particular a pump unit with an electrical drive is possible. Furthermore, an additional pump element may be arranged in the application volume 12*af*. Alternatively, it is also possible for the pump element 90*af* to have an extension that permits it to migrate through the through-opening into the application volume 12*af*.

For filling, the housing 4*af* has a fill opening 44*af* and the application device has a closure means 46*af* that closes the fill opening 44*af*. The entire application device is reusable, i.e. in particular the closure element 46*af* may be used multiple times. In principle it is also possible, however, to configure part of the application device or the entire application device as a disposable product. In principle it is possible to use a wide variety of fill options with the application device. However, it is also possible to design the application device as a disposable product with no fill option.

The fill opening 44*af* has a diameter that is larger than an extension of the pump element 90*af*. When manufacturing the application device, the pump element 90*af* may therefore be inserted into the housing 4*af* through the fill opening 44*af* after the housing 4*af* has been completely molded. The housing 4*af* is preferably manufactured in a single manufacturing step using thermoplastic molding of a blank. In principle it is also possible initially to design the housing 4*af* in multiple parts and then to combine them into one component using a suitable joining method. Individual parts are preferably joined to one another in a material fit so that the housing 4*af* is embodied in a single piece.

For applying the active agent, the application device is passed through the hair. Due to the design of the applicator 8*af*, the active agent is applied to almost all of the hairs. While the application device is passing through the hairs, the teeth 22*af* separate the hairs into the different gaps 24*af*. Except for an insignificant portion, which travels under the contact surface 36*af* and thus does not move into one of the gaps 24*af*, all of the hairs are provided with the active agent.

In this exemplary embodiment, the application device includes a cover unit 260*af* for transport or storage. The cover unit 260*af* is provided for placing onto the applicator 8*af*. The cover unit 260*af* placed onto the applicator 8*af* encloses and/or closes off the teeth 22*af*. The cover unit 260*af* has a width that is smaller, at least in areas, than a width of the applicator 8*af* oriented along the transverse extension 18*a*. When in place, the cover unit 260*af* exerts a force on the edge elements 250*af* that is oriented towards the center teeth 22*af*.

The edge elements 250*af* and teeth 22*af* are embodied at least somewhat flexible. The edge elements 250*af* and the adjacent teeth 22*af* are bent inward by the cover unit 260*af* when it is in place. When the cover unit 260*af* is in place, the gaps 24*af* therefore have a gap width that is almost zero. By pressing the teeth 22*af* together and by enclosing the applicator 8*af*, the cover unit 260*af* prevents the active agent from escaping. In principle, however, the application device may also be embodied without this feature.

FIG. 75 depicts a second embodiment of an application device 2*ag* that is also embodied as a hair root dyer. The hair root dyer is embodied as a streak dyer. Analogous to the preceding exemplary embodiment, for applying a liquid or paste active ingredient to hair the application device 2*ag* includes an applicator 8*ag* that has a comb-like structure with a plurality of gaps 24*ag* and teeth 22G arranged between the gaps 24*ag*. The application device 2*ag* further includes a housing 4*ag* that forms the teeth 22G and delimits the at least one application volume 12*ag* into which the gaps 24*ag* transition. In one area of the teeth 22*ag* the housing 4*ag* has a wall thickness that is less than 2.0 mm. In one particularly simple embodiment, the at least one application volume 12*ag* may be identical to the reservoir volume 10*ag*.

In contrast to the preceding exemplary embodiment, the applicator 8*ag* has a sub-area or bypass that is free of gaps. Hairs that during a use are disposed in this sub-area are not wetted with the active agent, so that the hairs are wetted almost completely with active agent only in one sub-area. These sub-areas then form streaks in which the hairs are treated, such as for instance are dyed or bleached, while the hairs in the sub-areas disposed therebetween remain untreated.

In the exemplary embodiment depicted, the application device 20*ag* is embodied for streak dying. Alternatively, it is also possible to provide for a design in accordance with the first exemplary embodiment a cover unit that merely closes off some of the gaps, so that an all-over dyer may also be used for dying streaks.

Active Agent

The invention also relates to an active agent for dying fibers, in particular for dying hairs, in particular with an application device as described above. The active agent usefully includes one or a plurality of dying substances and an adjusting substance for adjusting a liquid parameter.

It is particularly advantageous if the adjusting substance includes solid particles, the length of which is more than 5 times longer than their width and height. With such an active agent it is possible to counter-act undesired escape of the active agent through a gap. The solid particles may be rod-shaped. It is particularly advantageous when the solid particles are fibers.

The invention further relates to an active agent container having a bag that has a film wall, in particular for use with an application device as described above. The active agent container is advantageously provided for use in a reservoir volume of an application device as described above. The active agent container is advantageously suitable for dying agents, especially for hair dyes.

In one advantageous embodiment of the invention, the active agent container includes a plurality of chambers in which different active agent components are stored separately by chamber. The chambers are usefully separated from one another so that the active agents are sealed off from one another.

With respect to the arrangement of the chambers, it is advantageous when the active agent container has a plurality of chambers one after the other. It is also possible for the active agent container to have a plurality of adjacently arranged chamber elements, all attached to one location. The arrangement is usefully adapted by the preparation of application-ready active agents. As described above, an active agent container may be opened by compression. This can press the bag-like active agent container along its length, starting at one end and continuing to the opposing end of the bag. If a plurality of chambers are arranged one after the other in the bag, these are opened successively by the opening process. This causes the different active agent components to enter the reservoir volume one after the other. This may be advantageous with respect to thorough mixing and/or a chemical reaction that active agent components are involved in together.

If the chambers of the active agent container are arranged adjacent to one another, the active agent components stored in adjacent chambers are added to the reservoir volume essentially simultaneously. This is especially advantageous if it is not necessary or reasonable to add them successively.

In addition, it is possible for the reservoir volume to include one or a plurality of active agent containers (bags), each having at least one chamber. The bags may be attached above one another, in particular such that when squeezed along their length they come to be disposed above one another and pressed above one another. In this case, as well, essentially simultaneous opening of the chambers may be achieved so that a plurality of active agent components may be added to the reservoir volume essentially simultaneously.

The opening time for each bag may be control controlled by how the bag is dimensioned. Dimensions are preferably selected such that the metal-coated bag is opened first.

The bags are advantageously joined to one another in a material fit. For instance, they may be glued or welded to one another or joined to one another via an adhesive band. A fastening element is advantageously provided on the active agent container. Such a fastening element is usefully used for fastening to a housing element of an application device that is as described above. If there are a plurality of bags, they may be connected to one another by means of a common fastening element. The fastening element may be embodied for instance like a curtain rod.

When there are different active agent components, especially for dying hair, it is advantageous when at least one active agent component has a dry material and another active agent component has liquid material. The dry active agent component may be a powder, granulated, or corned. The liquid active agent components may also be viscous. The grained active agent may be $H_2O_2$.

The active agent container advantageously includes two chambers made from a different wall. Thus for instance it is advantageous to use oxygen-permeable materials for H2O2, and to use oxygen-dense materials for active agents that are sensitive to oxygen. The active agent container usefully includes a center seam bag. It may be embodied in a particularly space-saving manner on the sides without losing room.

Good interior pressure-guided opening of the active agent container may be attained if it has two points on two opposing walls that are securely joined to one another and for which the connection is surrounded, especially circularly surrounded, across an angular range of at least 270°. The same interior pressure prevails on such a solitary tear point—there may also be a plurality of tear points. The tear point is heavily loaded even when interior pressure are low and may therefore be opened with a small amount of force. The connection usefully forms a tear connection between 0.5 $mm^2$ and 6.0 mm2 with a connecting surface for the two walls. Particularly preferred is a range from 0.5 $mm^2$ to 2 $mm^2$. These sizes represent a compromise between a simple opening and an opening of adequate size, from which the active agent may exit. The smaller the tear connection, the easier it opens.

It is furthermore advantageous when the connection forms a connecting surface with an external spike. Since the tearing open occurs more easily by itself with angular or sharp edge contours, such as cross, circular, triangular, stripe, or semi-circular contours, than without such contours, an external spike contributes to the active agent container opening easily. The one or plurality of spikes is usefully oriented towards the greatest possible inflation of the active agent container. A deviation from the geometrically precise direction of ±30° is not taken into account here.

In particular if the active agent container has a longer longitudinal direction and a shorter transverse direction, it is advantageous when the external spike is embodied longitudinally. A tolerance of ±30° is permissible here, as well.

Simple production of the connection may be achieved using point welding. Point welding may be performed with the active agent container unfilled or already filled with active agent. Point welding while it is filled has the advantage that it is possible to avoid the active agent container from tearing open in an undesired manner during filling. Point welding is usefully performed with an external pressure of at least one kilo per square millimeter. In this manner, especially with a convex welding tip, there may be a displacement of the film material that is flowable when heated. The point welding is usefully performed with at least one convex welding tip. A convex welding tip has the advantage that it may be driven in the center on a mechanical block and in the rounded area still produces a ring of melted material that is continuously less pressed in the outward direction.

Advantageously, the center of the connection includes a hole in at least one plastic layer in at least one wall of the active agent container. What this can provide is that if there is a separation in wall the in an undesired manner such that walls do not both tear open, an opening in the wall still occurs. Even if metal film is still closed, the opening is easy to create because the metal film tears easily. Usefully, in its center the connection tears a hole through both walls. Such a hole is usefully produced after welding, for instance by means of the two walls being punctured. The hole may be reliably produced in this manner. It is furthermore possible for the target opening to be created using a releasable connection (e.g. peel seam).

The primary component of the wall of the active agent container is usefully polypropylene and/or polyethylene. There are primary components when both materials are used.

The active agent container usefully includes a wall made of film that in particular permits diffusion, usefully for oxygen. With respect to an opening process, especially with an application device as described above, it is advantageous when the film is a multi-layer film having an outer slide coating made of plastic and an additional inner metal film.

For causing the active agent container to open, it is advantageous when the film bears an imprint that is visible from the exterior. It may be read through a housing, in particular the application device, so that it helps to prevent mishandling.

It is furthermore advantageous when the film wall has a metal film that is coated on both sides with plastic, e.g. plastic film, or paint. Aluminum is particularly advantageous.

The active agent container is advantageously arranged in the reservoir volume such that a pressure means, e.g. the pressure means 110 in FIG. 22, moves along on the slide coating. The wall of the active agent container that comes to rest on the outer wall of the inner housing may also be slide coated, the slide coating not being as important there as it is on the pressure means.

The main component of the active agent is advantageously a polypropylene that is has been stretched in at least one direction, in particular in two directions. BOPP, that is, biaxially oriented PP, is a material that welds comparatively poorly. A weld seam of stretched polypropylene leaks somewhat very easily. However, especially when using $H_2O_2$, this may not be a critical issue since a small leak has an effect similar to the wall permitting diffusion, especially when using $H_2O_2$. Stretched material, especially bi-stretched material, has the good advantage of resistance to tear propagation, that is, if there is a small tear in the wall, the tear continues with almost no force. The bag opened in the application device by squeezing may be emptied very easily because of this.

The active agent containers may be constructed homogenously from one or in a plurality of layers from various materials that improve the containers' properties with respect to storability, ease of manufacture, and ease of use.

If the film wall is fashioned with at least one metal and one non-metal layer, an aluminum layer is particularly advantageous for the metal layer and especially polyethylene is advantageous for the non-metal layer. The layers are usefully produced using coextrusion. Under aggressive chemical conditions, a coextruded layer, especially an Al-PE film, is durable and has only a slight tendency to roll due to the different longitudinal expansions of aluminum and polyethylene.

The invention furthermore relates to an application method for applying an active agent to fiber-like material, especially hairs.

In this regard, the underlying object of the invention is to provide a method for applying an active agent to fiber-like material, with which method reliable manual application is possible.

This object is attained using a method in which at least a sub—are of an applicator of an application devices, especially of an application device as described above, is moved through fiber-like material such that active agent is applied by the applicator to the fiber-like material. Useful embodiments of this inventive method are provided in the individual method steps in the description of the application device.

The applicator advantageously encloses an application volume that is drawn through the fiber-like material, hereinafter called hair for the sake of simplicity. In this manner it is possible to wet all of the hairs in a simple and reliable manner. One useful embodiment of the invention provides that the applicator has teeth that are arranged in a comb-like manner and that each have a tip, and the tips of the teeth are guided forward through the hair. The direction of movement is usefully in the orientation direction of the tips.

While the applicator is moving through the hair, the applicator is advantageously moved through the hair in the orientation of the tips and then is thus moved over a fiber base, especially a scalp, such that the tips lift upward, a contact surface positioned behind the tips remaining on the fiber base and being guided along it. This movement of the teeth is similar to that of the nose of an aircraft that is just starting to take off and that lifts upward during a forward movement. Because of the lifting, the hairs can be drawn into the gaps well and thus reliably wetted with active agent.

During a pass by the unit, the hairs are advantageously divided into at least two gaps and then guided through an application volume, the hairs being wetted with an active agent. After leaving the two gaps, the hairs are advantageously guided together through a bundling chamber and at least some are collected into a strand. In this way the hairs are formed into a strand and rendered visible and stable.

The wetting and collecting of the fibers into a strand advantageously occurs in one work movement.

For adding the active agent to the application volume it is advantageous when the application device has a pump with a movable pump element and the application device is moved back and forth and because of this movement the pump element pumps active agent from a reservoir volume into an application volume enclosed by an applicator.

The application device is advantageously held with the applicator oriented downward for pumping. It is likewise advantageous that the back and forth movement is transverse to an application direction in which the applicator is guided through the hair.

In addition, it is advantageous when the application device has a reservoir volume for storing active agent and a reservoir volume movable mixing element and the application device is shaken and this causes the mixing element to move in the reservoir volume so that the active agent is mixed in the reservoir volume. The active agent may be prepared in a simple and reliable manner this way.

At the beginning of the application, that is, the application of active agent to the hairs, it is advantageous when the reservoir volume, after mixing, is opened to an application volume enclosed by the applicator and the mixing element is brought into a pumping position in a pump volume, in particular between the reservoir volume and the application volume, and the mixing element is moved in the pump volume by a movement of the application device and this causes the active agent to be pumped from the reservoir volume into the application volume.

The wall of the active agent container is advantageously at least largely made of film. A film is less expensive to produce and is simple to adapt to chemical properties of the active agent. It is particularly advantageous when the film permits diffusion, for instance for oxygen ($O_2$). What this can attain is that excess oxygen may be outgassed out of the active agent.

It is furthermore advantageous when the film is a multi-layer film having an outer slide coating made of plastic and another interiorly disposed metal film. The plastic coating can impart stability to the film and is also smooth such that it may be covered in a low-friction manner.

Similar effects may also be attained using an additional added slide film. The latter is moved in the same manner together with the active agent container. It reduces friction and produces a smooth surface in that it evens out wrinkles in the metal film. These optimizing measures can facilitate the squeezing of the active agent container. It is furthermore advantageous when the film bears an imprint that is outwardly visible. Such an imprint usefully includes instructions for operating the application device, other notes, for instance safety notes, also being advantageous.

In general it is advantageous when the active agent container has a flexible bag in which active agent is held. In order to limit loss of room in the small space of the reservoir volume, it is advantageous when the active agent container has a center seam bag. A plurality of center seam bags, in particular counter-supported center seam bags, are also advantageous.

REFERENCE LIST

2 Application device
4 Housing
6 Reservoir
8 Applicator
10 Reservoir volume
12 Application volume
14 Intermediate volume
16 Hair
18 Active agent
20 Comb
22 Tooth
24 Gap
26 Tooth tip
30 Head line
32 Width
34 Length
36 Contact surface
38 Depth
40 Top side
42 Closure element
44 Fill opening
46 Closure means
48 Passage
50 Recess
52 Housing element
54 Housing element
56 Rotation surface element
58 Rotation surface element
60 Rib
66 Zone
68 Groove
70 Front edge
72 Groove
74 Molded element
76 Blocking element
78 Handle element
80 Blocking element
82 Blocking element
84 Blocking element
86 Rotational direction
88 Fill opening
90 Pump element
92 Active agent container
94 Attaching element
96 Attaching means
98 Cut-out
100 Edge
102 Weld seam
104 Interior molded element
106 Predetermined breaking point
108 Wall
110 Pressure means
112 Expelling element
114 Volume expansion
116 Undercut
118 Introduction means
120 Housing part
122 Connecting means
124 Catch means
126 Recess
128 Scalp
130 Return element [this may change]
132 Comb angle
134 Double arrow
136 Height
138 Applicator depth
140 Plate
146 Spacer element
148 Upper wall
150 Lower wall
152 Sheet metal element
154 Bending edge
156 Applicator leg
158 Tooth base
160 Tip area
162 Forward application area
164 Main application area
166 Rear application area
168 Gap outlet
170 Bypass gap
172 Cut-out
174 Guide surface
176 Wall thickness
178 Bypass
180 Bypass tooth
182 Transition tooth
184 Gap base
186 Forward gap base
188 Rear gap base
190 Angle
192 Length
194 Bevel angle
196 Volume portion
198 Volume portion
200 Separator element
202 Fill element
204 Convexity
206 Back wall
208 Back-flow barrier
210 Comb
212 Spacer
214 Radius
216 Pump
218 Pump guide
220 Guide track
222 Cut-out
224 Edge
226 Pump volume
228 Trapping area
230 Connecting channel
232 Vent
234 Threaded connection
240 Length
242 Channel width
244 Channel width angle
246 Application direction

248 Transverse direction
250 Edge element
252 Base line
254 Base line
256 Separator element
258 Pump element
260 Cover unit

The invention claimed is:

1. An application device for applying an active agent to a filament material, the application device comprising:

a housing defining therein a reservoir volume for storing the active agent, said housing having a proximal end and a distal end; and an applicator defining an application volume for applying the active agent disposed in said application volume to the filament material, said applicator having a proximal end coupled to the distal end of the housing, an opposing free distal end and a concave upper wall and a convex lower wall having a number of hollow teeth formed therein said teeth having base portions and opposing terminal distal ends which define the distal end of the applicator, wherein said teeth extend upwardly and rearwardly along a curved path from the distal ends to the base portions and have a width in a plane transverse to said curved path where said width progressively increases in a proximal direction from said distal ends to said base portions;

said teeth providing gaps there between for introducing the filament material into said application volume, said gaps defining rear gap outlets proximate said base portions of said teeth and introduction sections proximate said terminal distal ends of said teeth section, said lower wall defining a lower contact surface with a recess formed therein where at least one of said gaps in an area of said lower wall has a rear gap outlet that extends from said lower contact surface into said recess and wherein said rear gap outlets are positioned at an angle which extends inwardly from a closest area of the lower contact surface in a direction toward the upper wall.

2. The application device according to claim 1, wherein said gaps are narrower in said upper wall than in said lower wall.

3. The application device according to claim 1, wherein said lower wall has a forward area proximate said distal ends of said teeth with a uniform thickness in a longitudinal direction.

4. The application device according to claim 3, wherein said lower wall has a uniformly thick segment defining a bottom side of said lower wall and a top side bending upward after said uniformly thick segment, wherein said uniformly thick segment is proximate said distal ends of said teeth.

5. The application device according to claim 1, wherein:

said lower wall has an interior side delimiting said applicator volume and said lower wall follows a path from a front distal end to a rear proximal end which extends at an angle to said lower contact surface of said applicator that increases to at least 70°.

6. The application device according to claim 5, wherein said interior side forms an angle of at least 60° to a hair that is guided taut and as deep as possible through said application volume.

7. The application device according to claim 5, wherein said application volume tapers upwardly and rearwardly.

8. The application device according to claim 1, wherein said angle is at least 70°.

9. The application device according to claim 8, wherein said recess forms a lateral gap broadening, into which said gap broadens laterally, and laterally releases fibers guided out of said gap.

10. The application device according to claim 8, wherein said recess increases in width and decreases in depth rearward as a distance from said rear gap outlet increases.

11. The application device according to claim 1, wherein said rear gap outlet of a plurality of said gaps open into a single chamber.

12. The application device according to claim 11, wherein said single chamber tapers laterally rearward so that hairs guided rearward through said single chamber are bundled.

13. The application device according to claim 12, wherein said single chamber becomes flatter towards a rear of said single chamber.

14. The application device according to claim 11, wherein said single chamber has lateral spacer elements that continuously hold said lower contact surface of said lower wall in an area of said rear gap outlets at least 0.5 mm from a fiber base such as a scalp.

15. The application device according to claim 1, wherein said gaps are disposed in at least two gap groups, between which groups a bypass gap is disposed, an extent of which is at least twice a gap distance of an opposing, outer-most gaps of one of said gap groups.

16. The application device according to claim 5, wherein said interior side forms an angle of at least 80° to a hair that is guided taut and as deep as possible through said application volume.

17. The applicator device according to claim 1, wherein a material of the housing is transparent.

* * * * *